US007254094B2

(12) United States Patent
Watanabe

(10) Patent No.: US 7,254,094 B2
(45) Date of Patent: Aug. 7, 2007

(54) TIMEPIECE WITH CALENDAR MECHANISM CONTAINING 2 DATE INDICATORS

(75) Inventor: Mamaru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 374 days.

(21) Appl. No.: 11/045,897

(22) Filed: Jan. 28, 2005

(65) Prior Publication Data

US 2005/0169108 A1 Aug. 4, 2005

(30) Foreign Application Priority Data

Jan. 30, 2004 (JP) ..... 2004-023148

(51) Int. Cl.
*G04B 19/20* (2006.01)
*G04B 19/24* (2006.01)

(52) U.S. Cl. ..... 368/37; 368/38

(58) Field of Classification Search ..... 368/28, 368/35–39, 77, 220, 221, 232, 233
See application file for complete search history.

(56) References Cited

U.S. PATENT DOCUMENTS 3,939,645 A * 2/1976 Charbonney ..... 368/35
4,257,113 A * 3/1981 Meister et al. ..... 368/35
4,271,494 A * 6/1981 Miyazaki ..... 368/34
6,711,100 B2 * 3/2004 Rochat et al. ..... 368/35
6,738,316 B2 * 5/2004 Gabathuler et al. ..... 368/28
6,958,952 B2 * 10/2005 Gabathuler et al. ..... 368/28
7,023,762 B1 * 4/2006 Burkhardt et al. ..... 368/35
7,102,962 B2 * 9/2006 Suzuki ..... 368/37
7,180,829 B2 * 2/2007 Watanabe ..... 368/37

FOREIGN PATENT DOCUMENTS

JP 3002969 10/1999
JP 00147145 5/2000
JP 3390021 8/2000
JP 00314779 11/2000

* cited by examiner

*Primary Examiner*—Vit Miska
*Assistant Examiner*—Jeanne-Marguerite Goodwin
(74) *Attorney, Agent, or Firm*—Adams & Wilks

(57) ABSTRACT

To provide a structure capable of performing a correction which surely and easily turns a date display back by rotating a 1st date indicator and a 2nd date indicator in both positive and reverse directions. A timepiece with a calendar mechanism possesses a 1st date indicator, a 2nd date indicator, and a date intermediate wheel which rotates the 2nd date indicator by a rotation of the 1st date indicator. Calendar shift teeth of the 1st date indicator possess a positive rotation unlocking part and a reverse rotation unlocking part. When a rotation center of the 2nd date indicator is defined as "CDA", a rotation center of the date intermediate wheel as "CMD" and a straight line passing through the "CDA" and the "CMD" as "LDM", a disposition of the calendar shift teeth before the 1st date indicator is unlocked in a 1st direction and a disposition of the calendar shift teeth under a state that the 1st date indicator has been finished to be unlocked in the 1st direction are axisymmertic with the straight line "LDM" being made a reference line.

8 Claims, 35 Drawing Sheets

TIMEPIECE WITH CALENDAR MECHANISM CONTAINING 2 DATE INDICATORS

BACKGROUND OF THE INVENTION

1. Field of the Invention

The present invention relates to a timepiece with a calendar mechanism containing a 1st date indicator displaying a place of units among dates, and a 2nd date indicator displaying a place of tens among dates.

2. Description of the Prior Art

Hereunder, it is explained about a constitution of the timepiece with the calendar mechanism containing the 1st date indicator displaying the place of units among dates, and the 2nd date indicator displaying the place of tens among dates.

(1) Timepiece with Conventional 1st Type Calendar Mechanism

A timepiece with a conventional 1st type calendar mechanism possesses a dial having a large window, and a rotating body (i.e., 1st date indicator) for the place of units in which there are disposed 31 numerals containing one numeral of "1" and 3 sets of numerals of "1" to "9" and "0" and there are provided 4 teeth, and additionally possesses a star-shaped plate for the place of tens having 4 teeth, and a rotating body (i.e., 2nd date indicator) for the place of tens in which there are disposed numerals "1" of "0", "1", "2", "3". The rotating body (i.e., 1st date indicator) for the place of units is directly rotating the rotating body (i.e., 2nd date indicator) for the place of tens (for example, refer to Japanese Patent No. 3390021 Gazette).

(2) Timepiece with Conventional 2nd Type Calendar Mechanism

A timepiece with a conventional 2nd type calendar mechanism contains a 1st date plate (i.e., 1st date indicator) displaying the place of units of dates, a 2nd date plate (i.e., 2nd date indicator) displaying the place of tens of dates, a date unlocking wheel driving the 1st date plate, an unlocking pawl provided in the 1st date plate, an intermediate wheel driven by the unlocking pawl, a 1st jumping control lever rotating the 1st date plate from an unlocking midway and causing it to remain in a stabilizes position, and a 2nd jumping control lever rotating the 2nd date plate from the unlocking midway and causing it to remain in a stabilized position. In the 1st date plate (i.e., 1st date indicator), there are disposed 20 numerals containing two sets of numerals of "1" to "9" and "0" (for example, refer to JP-A-2000-314779 Gazette).

(3) Electronic Timepiece Possessing Conventional Ultrasonic Motor

Additionally, an electronic timepiece in which a date indicator is rotated by a conventional ultrasonic motor possesses the ultrasonic motor for rotating the date indicator, a date indicator driving intermediate wheel which rotates on the basis of a rotation of the ultrasonic motor, a date indicator driving wheel which rotates on the basis of a rotation of the date indicator driving intermediate wheel to thereby rotate the date indicator, a contact spring provided in the date indicator driving wheel, a circuit base plate having plural contact patterns detecting a rotation state of the date indicator driving wheel by contacting with the contact spring, a motor drive circuit which inputs a rotation signal that the contact patterns output to thereby control the rotation of the ultrasonic motor, and a date jumper having a spring portion, for setting a position of the date indicator along a rotation direction by engaging with 2 internal teeth among internal teeth of the date indicator (for example, refer to Japanese Patent No. 3002969 Gazette).

(4) Timepiece with Conventional Hour Difference Corrector Mechanism

A timepiece with a conventional hour difference corrector mechanism possesses an hour gear wheel rotating on the basis of a rotation of a front train wheel, an hour display wheel rotating on the basis of a rotation of the hour gear wheel, a slip mechanism provided between the hour gear wheel and the hour display wheel, an hour display member for displaying an information relating to hour, which is attached to the hour display wheel, and an hour difference corrector train wheel which, under a state that an hour correction is possible, rotates by a rotation of a winding stem and can rotate the hour display wheel by one pitch at a time (for one hour of the hour display wheel, i.e., by (360/12) degrees) with respect to the hour gear wheel by slipping the slip mechanism (for example, refer to JP-A-2000-147145 Gazette).

(5) List of Patent Documents

Hereunder, there is shown a list of the Patent Documents relating to the timepiece with the conventional calendar mechanism mentioned above.

(1) Problems of Timepiece with Conventional 1st Type Calendar Mechanism

Since the timepiece with the conventional 1st type calendar mechanism possesses the rotating body for the place of units in which there are disposed 31 numerals containing numeral of "1" and 3 sets of numerals "1" to "9" and "0", a time at which the calendar mechanism must be corrected at the end of the month is respectively the end of February, April, June, September and November. That is, the number of times at which the calendar mechanism must be corrected is 5 times per year. However, in the timepiece with the conventional 1st type calendar mechanism, since the rotating body for the place of units directly rotates the rotating body for the place of tens, it has been impossible to dispose such that the rotating body for the place of units and the rotating body for the place of tens have the same rotation center. Accordingly, in this structure, when designing the 2 rotating bodies, there has been generated a restriction in a position where the date can be displayed by the 2 rotating bodies. Further, in the timepiece with the conventional 1st type calendar mechanism, it has been difficult to correct a date display in both of positive and reverse directions.

(2) Problems of Timepiece with Conventional 2nd Type Calendar Mechanism

In the timepiece with the conventional 2nd type calendar mechanism, in the 1st date plate, there are disposed two sets of numerals of "0" and "1"-"9", i.e., 20 numerals. Accordingly, the time at which the calendar mechanism must be corrected at the end of the month is respectively the end of every month. That is, the number of times at which the calendar mechanism must be corrected is 12 times per year. Further, in the timepiece with the conventional 2nd type calendar mechanism, it has been difficult to correct the date display in both of positive and reverse directions.

SUMMARY OF THE INVENTION

An object of the present invention is to provide a timepiece with a calendar mechanism, which does not increase the number of times at which the calendar mechanism must be corrected at the end of the month and whose operation property is good, in the timepiece with the calendar mechanism containing the 1st date indicator displaying the place of units among dates, and the 2nd date indicator displaying the place of tens among dates.

Further, other object of the present invention is to provide a timepiece with a calendar mechanism, in which a restriction in design is small by disposing a rotation center of the 1st date indicator and a rotation center of the 2nd date indicator in the same position.

Further, an additional object of the present invention is to provide a timepiece with a calendar mechanism in which, in the timepiece with the calendar mechanism containing the 1st date indicator displaying the place of units among dates and the 2nd date indicator displaying the place of tens among dates, it is also possible to correct a date display by rotating the 1st date indicator and the 2nd date indicator in the positive direction and, additionally, it is also possible to perform a correction which surely and easily turns the date display back by rotating the 1st date indicator and the 2nd date indicator in the reverse direction.

Further, a yet additional object of the present invention is to provide a timepiece with a calendar mechanism which, in the timepiece with the calendar mechanism containing the 1st date indicator displaying the place of units among dates and the 2nd date indicator displaying the place of tens among dates, possesses a 1st motor driving a train wheel for operating a hand displaying a time and a 2nd motor driving a train wheel for operating the 1st date indicator and the 2nd date indicator, which can perform an accurate time display and an accurate date display, and which can surely and easily correct the date display in both of positive and reverse directions.

Further, a still additional object of the present invention is to provide a timepiece with a calendar mechanism which, in the timepiece with the calendar mechanism containing the 1st date indicator displaying the place of units among dates and the 2nd date indicator displaying the place of tens among dates, can surely and easily correct the date display in both of positive and reverse directions, and which can surely and easily perform an hour difference correction of a display by an hour hand.

The present invention is constituted such that, in a timepiece with a calendar mechanism containing 2 date indicators, it possesses a 1st date indicator displaying a place of units among dates, a 1st date jumper for setting a position of the 1st date indicator in a rotation direction, a 2nd date indicator displaying a place of tens among dates, a 2nd date jumper for setting a position of the 2nd date indicator in a rotation direction, and a date intermediate wheel which rotates on the basis of a rotation of the 1st date indicator, thereby being capable of rotating the 2nd date indicator. In this timepiece with a calendar mechanism, a rotation center of the 1st date indicator and a rotation center of the 2nd date indicator are disposed so as to exist in the same position, the 1st date indicator contains 31 1st date indicator teeth parts formed as internal teeth and 4 calendar shift teeth formed as internal teeth, the 1st date indicator teeth parts are formed with a spacing of equal angle, and the calendar shift teeth comprise a 1st calendar shift tooth becoming a reference, a 2nd calendar shift tooth formed with a spacing of (360×2/31) degrees in a 1st direction (e.g., clock wise direction) with the 1st calendar shift tooth being made the reference, a third calendar shift tooth formed with a spacing of (360×10/31) degrees in the 1st direction (e.g., clockwise direction) with the 2nd calendar shift tooth being made a reference, and a 4th calendar shift tooth formed with a spacing of (360×9/31) degrees in a direction (e.g., counterclockwise direction) opposite to the 1st direction with the 1st calendar shift tooth being made the reference.

In this timepiece with a calendar mechanism, each of the calendar shift teeth possesses a positive rotation unlocking part for unlocking the 1st date indicator in the 1st direction and a reverse rotation unlocking part for unlocking it in a 2nd direction opposite to the 1st direction. In this timepiece with a calendar mechanism, it is characterized in that, when the rotation center of the 2nd date indicator is defined as "CDA", a rotation center of the date intermediate wheel is defined as "CMD" and a straight line passing through the "CDA" and the "CMD" is defined as "LDM", as to each of the calendar shift teeth, a disposition of the calendar shift tooth under a state before the 1st date indicator is unlocked in the 1st direction and a disposition of the calendar shift tooth under a state that the 1st date indicator has been finished to be rotated in the 1st direction are constituted in an axisymmetric relation whose reference line is made the "LDM". By this constitution, it is possible to correct a date display by rotating the 1st date indicator and the 2nd date indicator in a positive direction.

In a timepiece with a calendar mechanism of the present invention, it is desirable that, when a straight line passing through the rotation center "CDA" and a center part of each of the calendar shift teeth in a rotation direction is defined as "LDH", as to each of the calendar shift teeth, a positive rotation unlocking part and a reverse rotation unlocking part are formed in an axisymmetric shape whose reference is made the "LDH". By this constitution, it is also possible to correct the date display by rotating the 1st date indicator and the 2nd date indicator in the positive direction and, additionally, it is also possible to perform a correction which surely and easily turns the date display back by rotating the 1st date indicator and the 2nd date indicator in the reverse direction.

In a timepiece with a calendar mechanism of the present invention, it is desirable that a hand for displaying a time information is operated by a step motor, and the 1st date indicator is operated by an ultrasonic motor.

It is desirable that a timepiece with a calendar mechanism of the present invention is constituted such that it possesses a 24-hour signal detection part for detecting a rotation of the hand for displaying the time information and a rotation signal detection part for detecting a rotation of a train wheel for rotating the 1st date indicator, and an operation of the ultrasonic motor is controlled on the basis of an output signal that the 24-hour signal detection part outputs and the operation of the ultrasonic motor is controlled on the basis of an output signal that the rotation signal detection part outputs.

It is desirable that a timepiece with a calendar mechanism of the present invention is constituted such that it possesses a hand corrector mechanism for performing a correction of a hand for displaying a time information, and an operation of the ultrasonic motor is controlled on the basis of an operation of the hand corrector mechanism.

It is desirable that a timepiece with a calendar mechanism of the present invention is constituted such that it possesses an hour difference corrector mechanism for performing an hour difference correction of an hour hand for displaying a time information, and an operation of the ultrasonic motor is controlled on the basis of an operation of the hour difference corrector mechanism. By this constitution, it is possible to surely and easily correct the date display in both positive and reverse directions, and it is possible to surely and easily perform the hour difference correction of the display by the hour hand.

It is desirable that a timepiece with a calendar mechanism of the present invention is constituted such that it possesses an hour wheel for driving the hour hand for displaying the time information, the hour wheel contains an hour gear wheel, an hour jumper, an hour jumper pinion, an hour display wheel and a contact operation wheel, the hour gear wheel, the hour jumper, the hour jumper pinion, the hour display wheel and the contact operation wheel are constituted so as to monolithically rotate, and the operation of the ultrasonic motor is controlled on the basis of a rotation of the contact operation wheel.

It is desirable that a timepiece with a calendar mechanism of the present invention is constituted such that it possesses an hour wheel for driving the hour hand for displaying the time information, the hour wheel contains an hour gear wheel, an hour jumper, an hour jumper pinion, an hour display wheel and a contact operation wheel, the hour gear wheel, the hour jumper, the hour jumper pinion, the hour display wheel and the contact operation wheel are constituted so as to monolithically rotate, the hour hand is attached to the hour display wheel, additionally it possesses a 24-hour hour wheel which rotates on the basis of a rotation of the date jumper, and the 24-hour hour wheel performs one rotation in 24 hours.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Hereunder, embodiments of a timepiece with a calendar mechanism of the present invention are explained on the basis of the drawings. Generally, a machine body containing a drive part of the timepiece is referred to as "movement". A state made into a completed article by attaching a dial and hands to the movement and inserting them into a timepiece case is referred to as "complete" of the timepiece. Between both sides of a main plate constituting a base plate, a side in which a glass of the timepiece case exists, i.e., side in which the dial exists, is referred to as "back side" or "glass side" or "dial side" of the movement. Between both sides of the main plate, a side in which a case back of the timepiece case exists, i.e., side opposite to the dial, is referred to as "front side" or "case back side" of the movement. A train wheel incorporated into the "front side" of the movement is referred to as "front train wheel". A train wheel incorporated into the "back side" of the movement is referred to as "back train wheel".

(A) Timepiece with Calendar Mechanism Constituting Basic Technique of the Present Invention First, it is explained about a timepiece with a calendar mechanism constituting a basic technique of the present invention.

Figure 35:
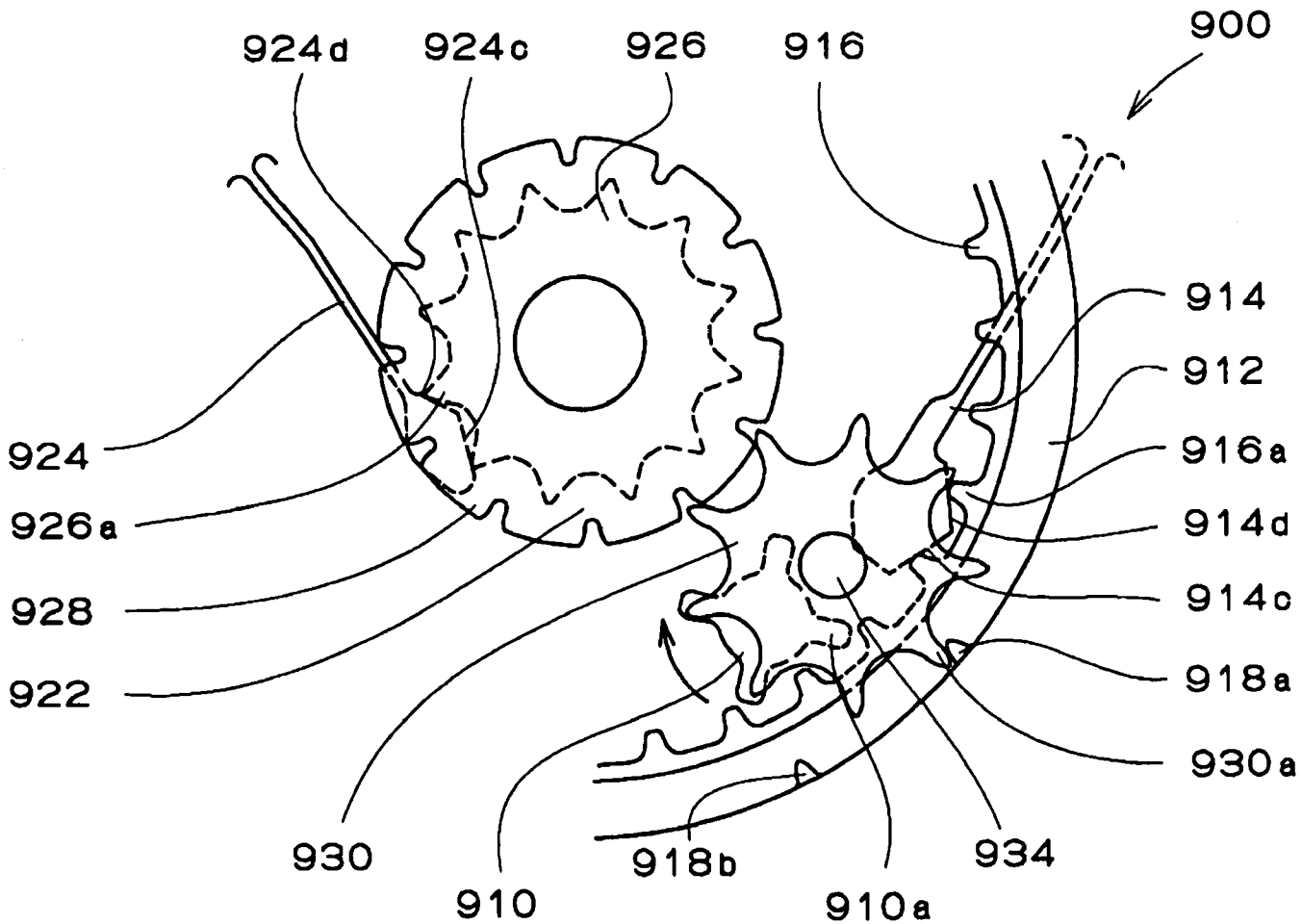
FIG. 35 is a partial plan view showing the structure of the back side of the movement seen from the dial side under the state that the 1st date indicator is attempted to be rotated in the positive direction in the timepiece with the calendar mechanism constituting a basic technique of the present invention.

(A.1) State that 1st Date Indicator is Attempted to be Rotated in Positive Direction FIG. 35 is a partial plan view showing a structure of the back side of the movement seen from the dial side under a state that a 1st date indicator is attempted to be rotated in a positive direction (clockwise direction) in the timepiece with the calendar mechanism constituting the basic technique of the present invention. Referring to FIG. 35, a movement 900 possesses a date indicator driving wheel 910 rotating by a rotation of a drive device (not shown in the drawing), a 1st date indicator 912 displaying a place of units among dates, a 1st date jumper 914 for setting a position of the 1st date indicator 912 in a rotation direction, a 2nd date indicator 922 displaying a place of tens among dates, a 2nd date jumper 924 for setting a position of the 2nd date indicator 922 in a rotation direction, and a date intermediate wheel 930 which rotates on the basis of a rotation of the 1st date indicator 912, thereby being capable of rotating the 2nd date indicator 922. In a case of an analog electronic timepiece, the drive device is constituted by a step motor. A rotation center of the 1st date indicator 912 and a rotation center of the 2nd date indicator 922 exist in the same position. That is, the rotation center of the 1st date indicator 912 and the rotation center of the 2nd date indicator 922 exist in a rotation center of an hour hand (not shown in the drawing). The date intermediate wheel 930 is provided so as to be rotatable with respect to a date intermediate wheel pin 934.

The 1st date indicator 912 possesses a ring-shaped 1st date letter display face (not shown in the drawing). The 1st date indicator 912 contains 31 1st date indicator teeth parts 916 formed as internal teeth, and 4 calendar shift teeth 918 formed as internal teeth. Setting parts 914*c*, 914*d* of the 1st date jumper 914 set the 1st date indicator teeth parts 916. The 1st date indicator teeth parts 916 are formed with a spacing of equal angle, i.e., spacing of (360/31) degrees. The calendar shift teeth parts 918 comprise a 1st calendar shift tooth 918*a* becoming a reference, a 2nd calendar shift tooth 918*b* formed with a spacing of (360×2/31) degrees in a clockwise direction with the 1st calendar tooth 918*a* being made the reference, a 3rd calendar shift tooth (not shown in the drawing) formed with a spacing of (360×10/31) degrees in the clockwise direction with the 2nd calendar shift tooth 918*b* being made a reference, and a 4th calendar shift tooth (not shown in the drawing) formed with a spacing of (360×9/31) degrees in a counterclockwise direction with the 1st calendar shift tooth 918*a* being made the reference. A spacing between the 1st calendar shift tooth 918*a* and the 4th calendar shift tooth is (360×9/31) degrees. 1st date letters (not shown in the drawing) consisting of 31 numerals are provided in the 1st date letter display face. The 1st date letters contain 4 sets of numerals. That is, the 1st date letters contain numerals of "1" to "9" and "0" which constitute a 1st set of 1st date letters, numerals of "1" to "9" and "0" which constitute a 2nd set of 1st date letters, numerals of "1" to "9" and "0" which constitute a 3rd set of 1st date letters, and numeral of "1" which constitutes a 4th set of 1st date letters. The 31 numerals constituting the 1st date letters are disposed in the 1st date letter display face with the spacing of equal angle, i.e., spacing of (360/31) degrees.

The 2nd date indicator 922 is formed so as to possess a disc-shaped 2nd date letter display face (not shown in the drawing). The 2nd date indicator 922 contains 12 positioning teeth parts 926 formed as external teeth, and 12 unlocking teeth 928 formed as external teeth. The positioning teeth parts 926 are formed with a spacing of equal angle, e.g., spacing of (360/12) degrees. The unlocking teeth 928 are formed with the spacing of equal angle, e.g., spacing of (360/12) degrees. 2nd date letters (not shown in the drawing) consisting of "1", "2", "3" and "0" are disposed in a 2nd date letter display face. Numeral of "1" and numeral of "2" are disposed in the 2nd date letter display face with a spacing of 30 degrees. Numeral of "2" and numeral of "3" are disposed in the 2nd date letter display face with the spacing of 30 degrees. Numeral of "3" and numeral of "0" are disposed in the 2nd date letter display face with the spacing of 30 degrees. Accordingly, in the 2nd date letter display face, there are disposed numeral of "1", numeral of "2", numeral of "3" and numeral of "0" so as to mutually form the spacing of 30 degrees. In the 2nd date letter display face, there are provided sets of numerals consisting of numeral of "1", numeral of "2", numeral of "3" and numeral of "0" by 3 sets. There is also a constitution in which, instead of providing numeral of "0", that position is made a "white paper" portion (i.e., blank portion in which no numeral is provided). Under the state shown in FIG. 35, in a date window of a dial of the timepiece with the calendar mechanism, there is displayed a state showing "31st day" in which a display of the 2nd date indicator 922 is "3" and a display of the 1st date indicator 912 is "1".

Setting parts 924*c*, 924*d* of the 2nd date jumper 924 set the positioning teeth parts 926. The date indicator driving wheel 910 contains 4 date indicator driving teeth 910*a* formed as external teeth. By the fact that the date indicator driving wheel 910 rotates in a direction (clockwise direction) shown by an arrow, the date indicator driving teeth 910*a* unlock the 1st date indicator teeth parts 916, thereby rotating the 1st date indicator 912 by (360/31) degrees in the clockwise direction once in one day. The date intermediate wheel 930 contains 9 date intermediate teeth 930*a* formed as external teeth. When the date letter displayed from the date window by the 1st date indicator 912 changes from "9" to "o"; by the fact that the 1st date indicator 912 rotates by (360/31) degrees in the clockwise direction, the 2nd calendar shift tooth 918*b*, or the 3rd calendar shift tooth 918*c* or the 4th calendar shift tooth 918*d* rotates the date intermediate teeth 930*a*, and the date intermediate teeth 930*a* rotate the unlocking teeth 928, thereby rotating the 2nd date indicator 922 in the counterclockwise direction by 30, degrees once in every 10 days. When the date letter displayed from the date window by the 2nd date indicator 922 changes from "3" t0 "0" (or, state of "white paper") and the date letter displayed from the date window by the 1st date indicator 912 changes from "1" to adjoining next "1", by the fact that the 1st date indicator 912 rotates by (360/31) degrees in the clockwise direction, the 1st calendar shift tooth 918*a* rotates the date intermediate teeth 930*a*, and the date intermediate teeth 930*a* rotate the unlocking teeth 928, thereby rotating the 2nd date indicator 922 by 30 degrees in the counterclockwise direction once in every 31 days.

(A.2) State that 1st Date Indicator is being Rotated in Positive Direction

Figure 36:
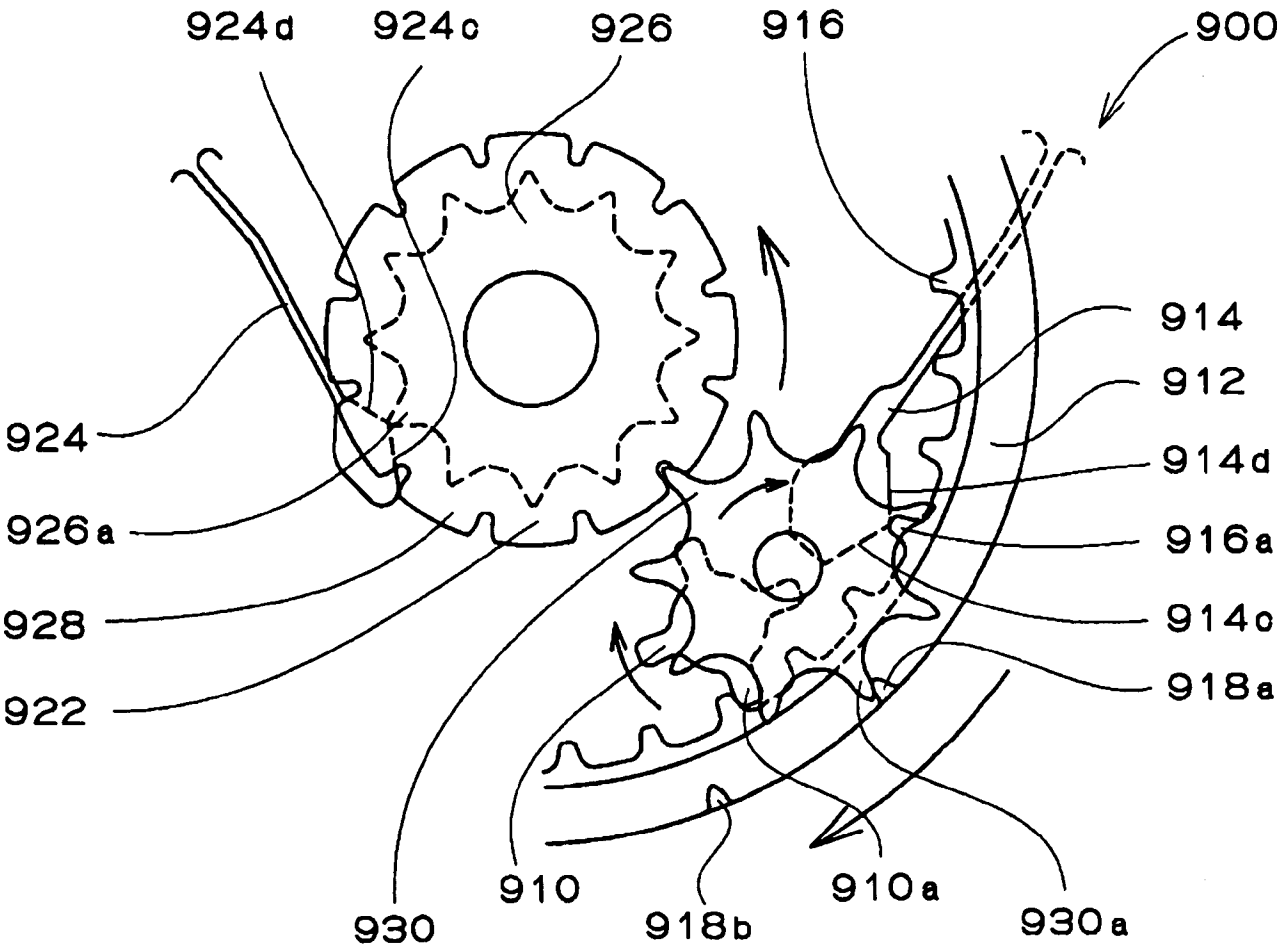
FIG. 36 is a partial plan view showing the structure of the back side of the movement seen from the dial side under the state that the 1st date indicator is rotating in the positive direction in the timepiece with the calendar mechanism constituting the basic technique of the present invention.

FIG. 36 is a partial plan view showing the structure of the back side of the movement 900 seen from the dial side under a state that the 1st date indicator 912 rotates in the positive direction and a tip part of the tooth part 916*a* of the 1st date indicator 912 contacts with a tip part where the setting parts 914*c* and 914*d* of the 1st jumper 914 intersect under a state that the 1st date indicator 912 is being rotated in the positive direction in the timepiece with the calendar mechanism constituting the basic technique of the present invention. Referring to FIG. 36, when the display of the 1st date indicator 912 is "1" and the display of the 2nd date indicator 922 is "3", the date indicator driving wheel 910 rotates in a direction shown by an arrow, and the date indicator driving tooth 910*a* rotates the 1st date indicator 91.2 in a direction shown by an arrow. In a midway of this unlocking state of the 1st date indicator 912, it becomes the state that the tip part of the tooth part 916*a* of the 1st date indicator 912 contacts with the tip part where the setting parts 914*c* and 914*d* of the 1st jumper 914 intersect. Further, by the fact that the 1st date indicator 912 rotates in the direction shown by the arrow, the 1st calendar shift tooth 918*a* rotates the date intermediate tooth 930*a*, and the date intermediate tooth 930*a* rotates the unlocking teeth 928, thereby rotating the 2nd date indicator 922 in the counterclockwise direction in a direction shown by an arrow. In a midway of this unlocking state of the 2nd date indicator 922, it becomes a state that a tip part of a positioning tooth part 926*a* of the 2nd date indicator 922 contacts with a tip part where the setting parts 924*c* and 924*d* of the 2nd jumper 924 intersect.

Figure 37:
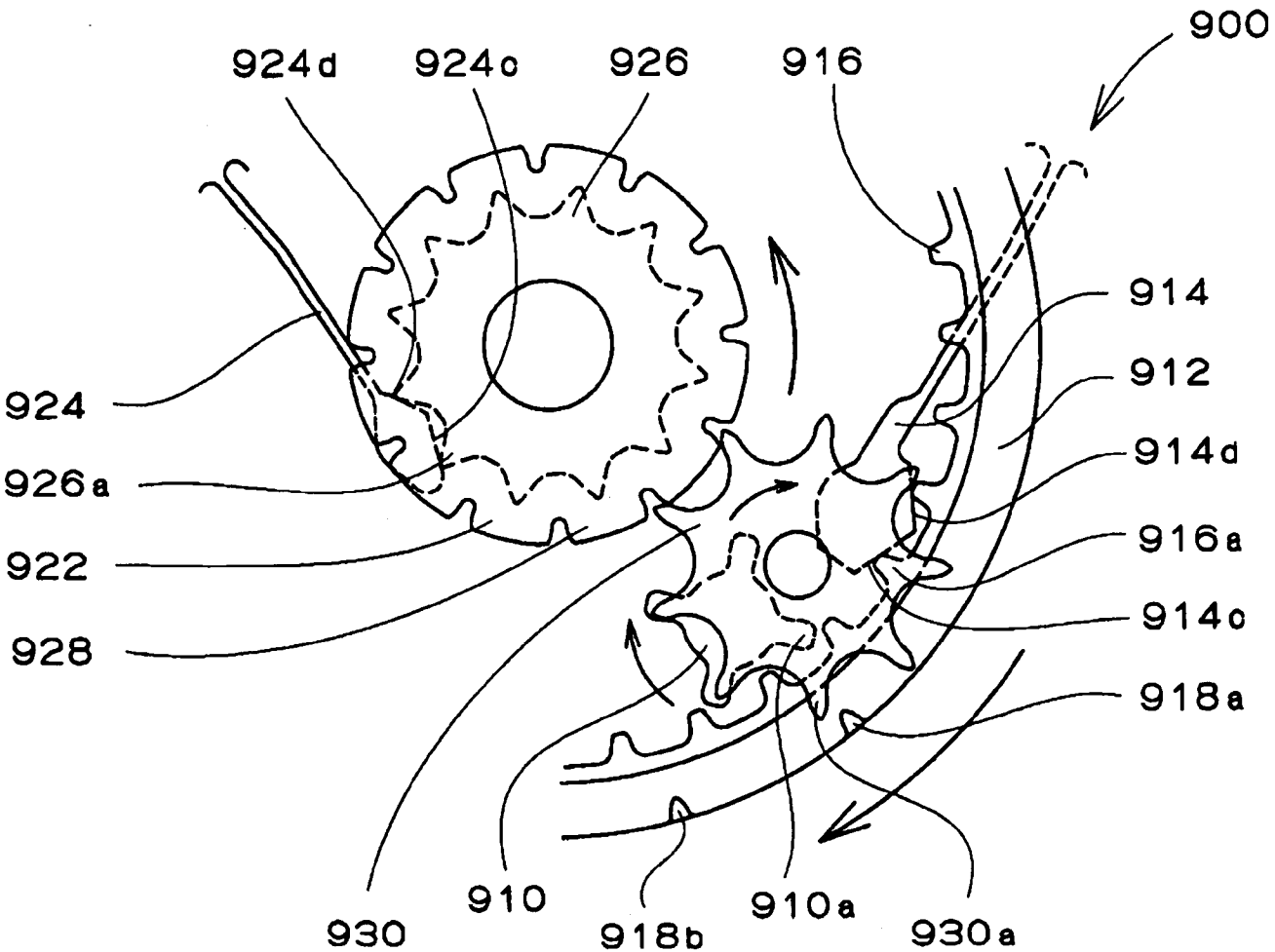
FIG. 37 is a partial plan view showing the structure of the back side of the movement seen from the dial side under the state that the 1st date indicator has rotated by one pitch in the positive direction in the timepiece with the calendar mechanism constituting the basic technique of the present invention.

(A.3) State that 1st Date Indicator has Rotated by One Pitch in Positive Direction FIG. 37 is a partial plan view showing the structure of the back side of the movement seen from the dial side under a state that the 1st date indicator 912 has rotated by one pitch (for one tooth of the 1st date indicator, i.e., by (369/31) degrees) in the positive direction in the timepiece with the calendar mechanism constituting the basic technique of the present invention. Referring to FIG. 37, if the date indicator driving wheel 910 additionally rotates in the direction shown by the arrow from the state shown in FIG. 36 and the date indicator driving tooth 910*a* rotates the 1st date indicator 912 in the direction shown by the arrow, by an elastic force of the 1st date jumper 914, the 1st date indicator 912 is positioned in a position rotated by (360/31) degrees in the clockwise direction from the state shown in FIG. 35. Further, by an elastic force of the 2nd date jumper 924, the 2nd date indicator 922 is positioned in a position rotated by 30 degrees in the counterclockwise direction from the state shown in FIG. 35. As a result, the display of the 2nd date indicator 922 is changed from "3" to "0" (or, state of "white paper"), and the display of the 1st date indicator 912 is changed from "1" to adjoining next "1". That is, under the state shown in FIG. 37, in the date window of the dial of the timepiece with the calendar mechanism, there is displayed "1st day" in which the display of the 2nd date indicator 922 is "0" (or, state of "white paper") and the display of the 1st date indicator 912 is "1". Under the state shown in FIG. 37, an interstice is generated between the 1st calendar shift tooth 918*a* and the date intermediate tooth 930*a*.

Figure 38:
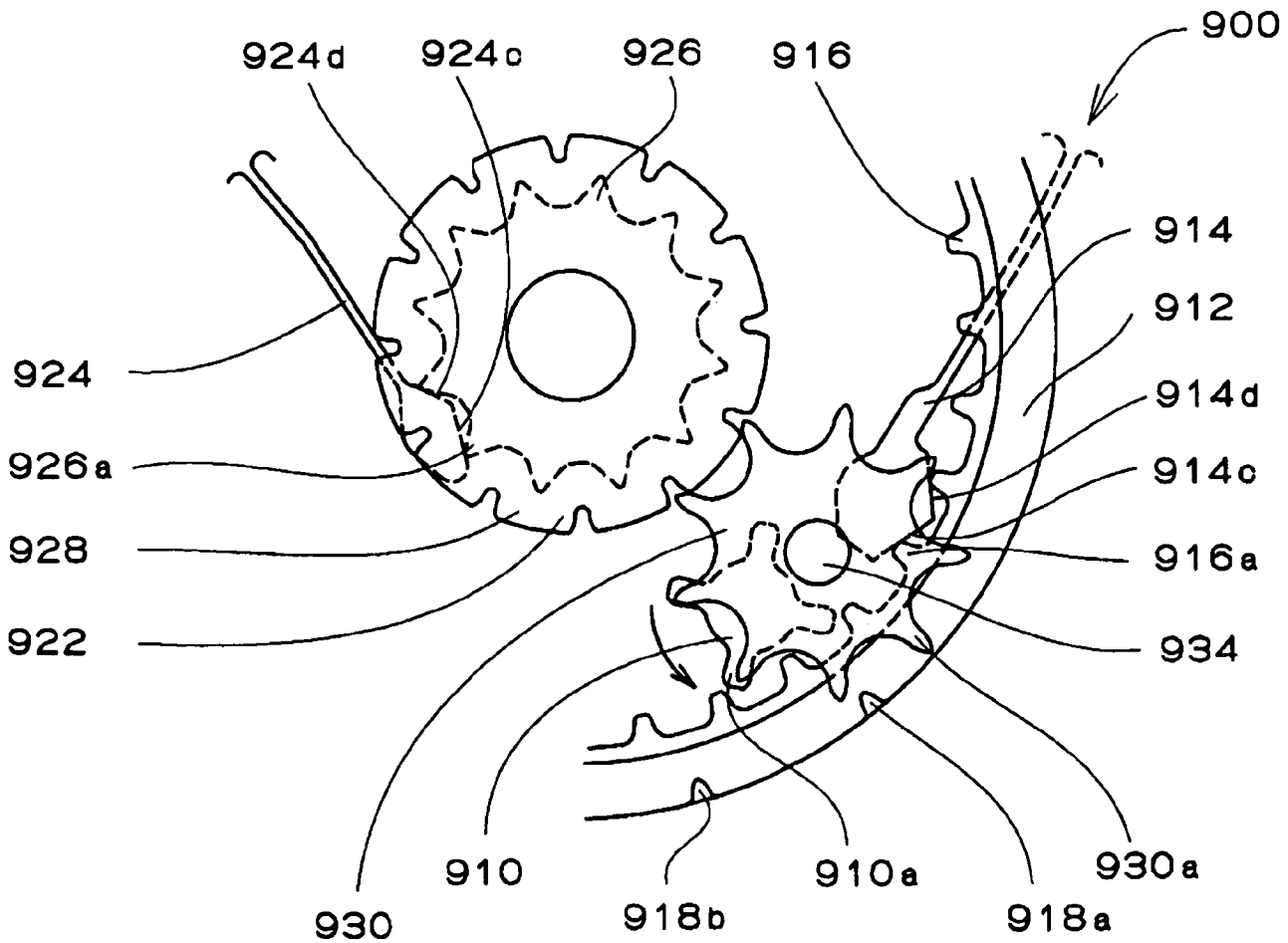
FIG. 38 is a partial plan view showing the structure of the back side of the movement seen from the dial side under the state that the 1st date indicator is attempted to be rotated in the reverse direction in the timepiece with the calendar mechanism constituting the basic technique of the present invention.

(A.4) State that 1st Date Indicator is Attempted to be Rotated in Reverse Direction FIG. 38 is a partial plan view showing the structure of the back side of the movement seen from the dial side under a state that the 1st date indicator is attempted to be rotated in a reverse direction (counterclockwise direction) in the timepiece with the calendar mechanism constituting the basic technique of the present invention. Referring to FIG. 38, by the fact that the date indicator driving wheel 910 rotates in a direction (counterclockwise direction) shown by an arrow, the date indicator driving tooth 910*a* goes to approach the 1st date indicator teeth parts 916.

(A.5) State that 1st Date Indicator is Being Rotated in Reverse Direction

Figure 39:
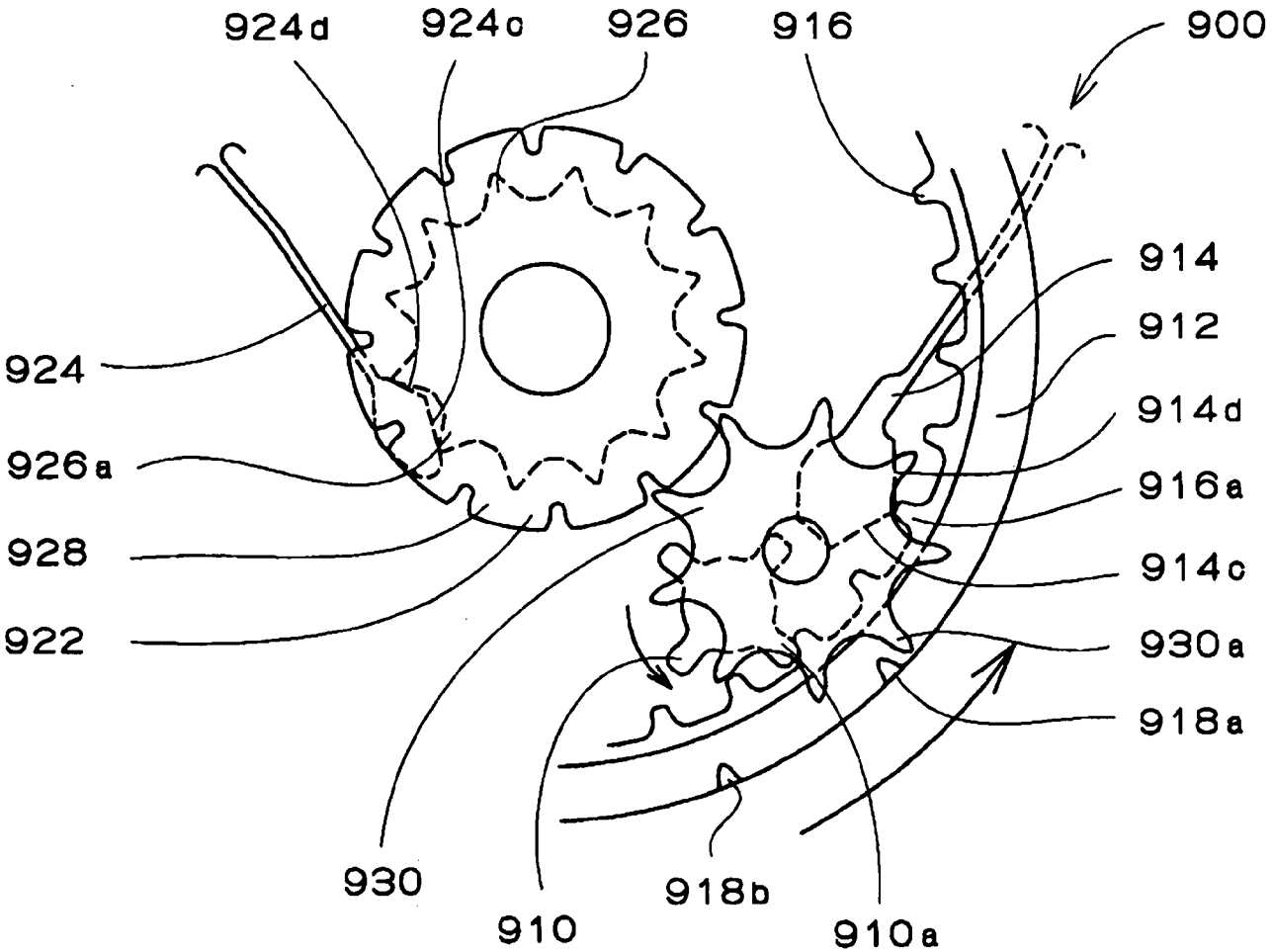
FIG. 39 is a partial plan view showing the structure of the back side of the movement seen from the dial side under the state that the 1st date indicator is rotating in the reverse direction in the timepiece with the calendar mechanism constituting the basic technique of the present invention.

FIG. 39 is a partial plan view showing the structure of the back side of the movement 900 seen from the dial side under the state that the tip part of the tooth part 916*a* of the 1st date indicator 912 contacts with the tip part where the setting parts 914*c* and 914*d* of the 1st jumper 914 intersect under a state that 1st date indicator 912 is being rotated in a reverse direction in the timepiece with the calendar mechanism constituting the basic technique of the present invention. Referring to FIG. 39, when the display of the 1st date indicator 912 is "1" and the display of the 2nd date indicator 922 is "0" (or state of "white paper"), the date indicator driving wheel 910 rotates in the direction shown by the arrow, and the date indicator driving tooth 910*a* rotates the 1st date indicator 912 in a direction shown by an arrow. In a midway of this unlocking state of the 1st date indicator 912, it becomes the state that the tip part of the tooth part 916*a* of the 1st date indicator 912 contacts with the tip part where the setting parts 914*c* and 914*d* of the 1st jumper 914 intersect. Under this state, the 1st calendar shift tooth 918*a* does not contact with the date intermediate tooth 930*a*. Accordingly, if the 1st date indicator 912 rotates up to become the state shown in FIG. 39, the 2nd date indicator 922 does not rotate.

Figure 40:
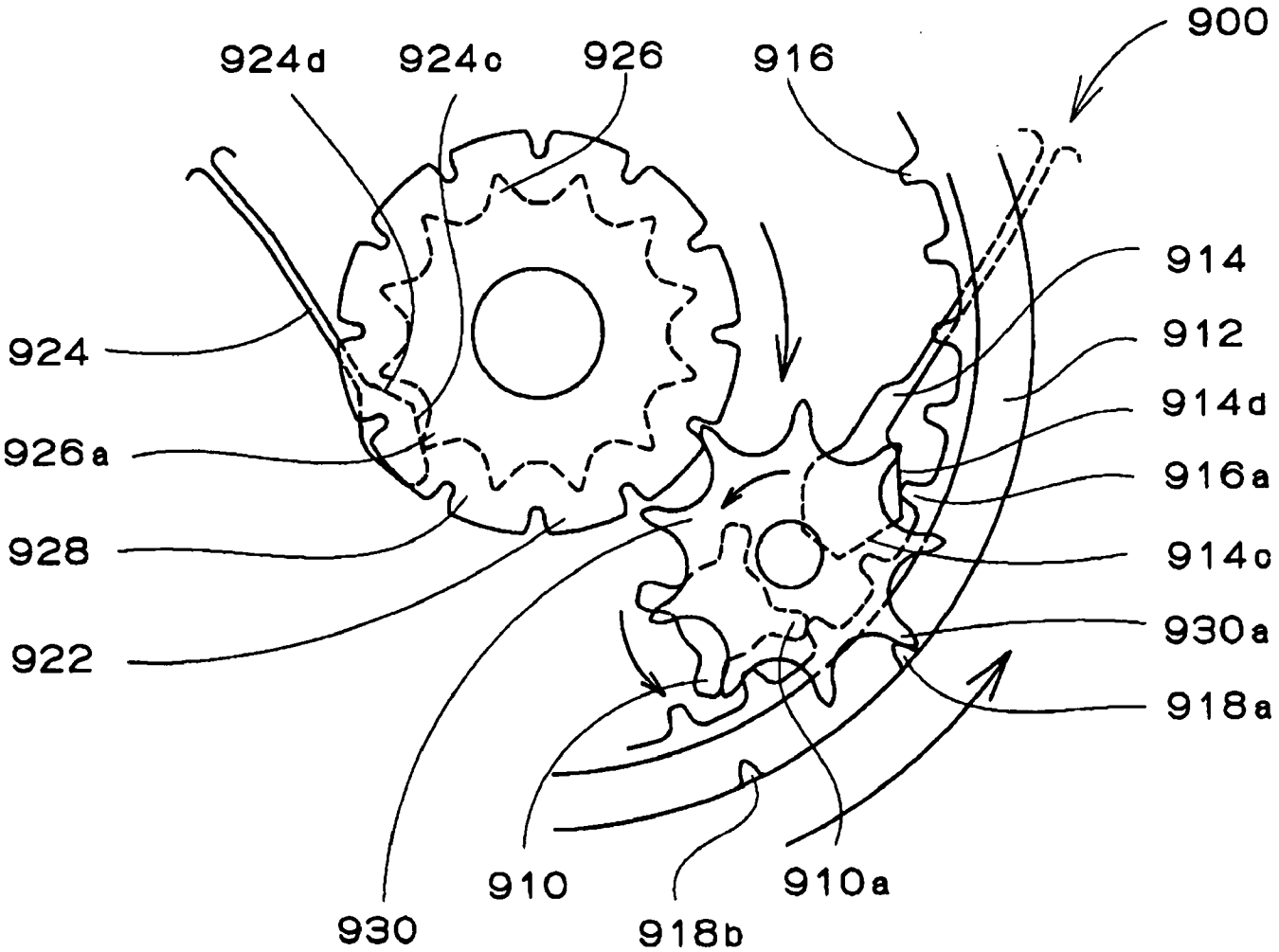
FIG. 40 is a partial plan view showing the structure of the back side of the movement seen from the dial side under a state that the 1st date indicator has been additionally rotated in the reverse direction in the timepiece with the calendar mechanism constituting the basic technique of the present invention.
Figure 41:
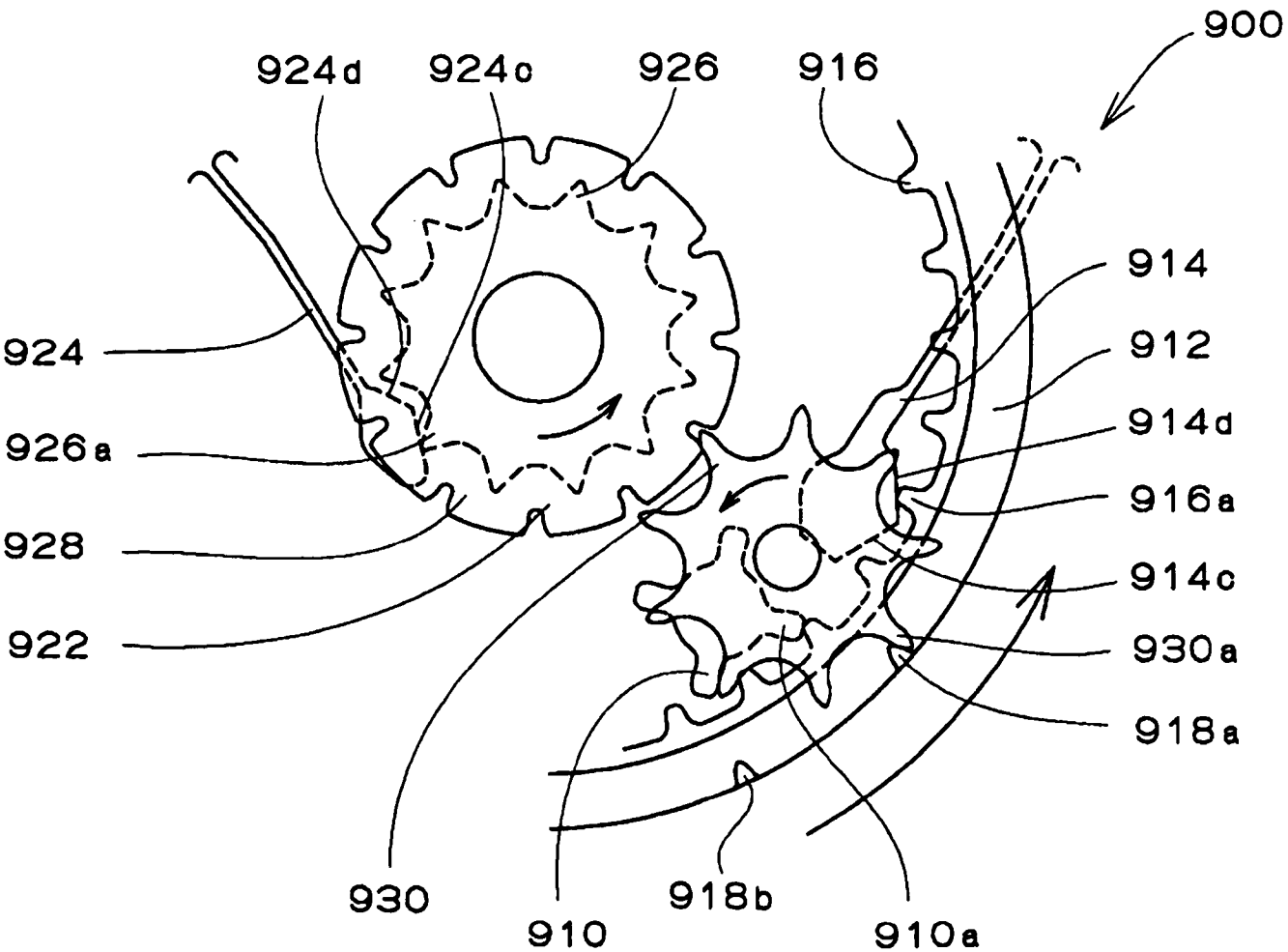
FIG. 41 is a partial plan view showing the structure of the back side of the movement seen from the dial side when a spring balance has been taken and thereby has become an equilibrium state in the timepiece with the calendar mechanism constituting the basic technique of the present invention.

(A.6) State that 1st Date Indicator has Been Additionally Rotated in Reverse Direction FIG. 40 is a partial plan view showing the structure of the back side of the movement seen from the dial side under a state that the 1st date indicator has been additionally rotated in the reverse direction in the timepiece with the calendar mechanism constituting the basic technique of the present invention. Referring to FIG. 40, if the date indicator driving wheel 910 additionally rotates in the direction shown by the arrow from the state shown in FIG. 39 and the date indicator driving tooth 910*a* rotates the 1st date indicator 912 in the direction shown by the arrow, by the elastic force of the 1st date jumper 914, the 1st date indicator 912 is positioned in a position rotated by ((360/31)—a) degrees in the counterclockwise direction from the state shown in FIG. 38. However, the 2nd date indicator 922 rotates merely by a slight angle in the clockwise direction from the state shown in FIG. 38. And, referring to FIG. 41, by the elastic force of the 2nd date jumper 924, the 2nd date indicator 922 rotates in the counterclockwise direction, and a spring balance is taken under a state shown in FIG. 41, so that it is impossible to display a regular date. Incidentally, in the timepiece with the calendar mechanism constituting the basic technique of the present invention, in order that the date indicator driving wheel 910 rotates in the direction (counterclockwise direction) shown by the arrow to thereby rotate the 1st date indicator 912 in the reverse direction (counterclockwise direction) and rotate the 2nd date indicator 922 in the reverse direction (clockwise direction), there is generated a necessity to device dimensions and shapes of components constituting the calendar mechanism.

(1) Structure of 1st Embodiment of Timepiece with Calendar Mechanism of the Present Invention Hereunder, it is explained about a 1st embodiment of a timepiece with a calendar mechanism of the present invention.

(1.1) Whole Constitution of Movement

Referring to FIG. 1-FIG. 4, in the 1st embodiment of the timepiece with the calendar mechanism of the present invention, a movement 100 is constituted by an analog electronic timepiece. The movement 100 contains a main plate 102 constituting a base plate of the movement 100, a date indicator maintaining plate 302, and a calendar platform 304. A dial 104 is attached to the movement 100 through a dial support 106. The dial 104 is attached to the dial side of the movement 100. In the movement 100, the "front side" denotes a side remote from the dial 104 between both sides of the main plate 102, i.e., the "case back side". In the movement 100, the "back side" denotes a side near to the dial 104 between both sides of the main plate 102, i.e., the "dial side". In the movement 100, the date indicator maintaining plate 302 and the calendar platform 304 are disposed in the "back side". A winding stem 110 is rotatably incorporated into the main plate 102. The winding stem 110 has an angular part 110*a*. A clutch 114 is incorporated into the angular part 110*a* of the winding stem 110. The clutch wheel 114 has the same rotation axis as a rotation axis of the winding stem 110. That is, the clutch wheel 114 has an angular hole, and is provided so as to rotate on the basis of a rotation of the winding stem 110 by the fact that this angular hole fits with the angular part 110*a*. A rocking device contains a setting lever 122, a yoke 124, and a yoke holder 125. In the movement 100, the rocking device is disposed in the "front side". In the movement 100, it is also possible to dispose the rocking device in the "back side".

(1.2) Constitution of Front Side of Movement

Hereunder, it is explained about a constitution of the front side of the movement. Referring to FIG. 2-FIG. 4 and FIG. 25, in the movement 100, a battery 140 constituting a power source of the timepiece is disposed in the case back side (front side) of the main plate 102. A crystal oscillator unit 750 constituting an oscillation source of the timepiece is disposed in the case back side of the main plate 102. A crystal oscillator oscillating at 32,768 Hertz for instance is accommodated in the crystal oscillator unit 750. In an integrated circuit (IC) 754, there are built in an oscillation part (oscillator) 702 outputting a reference signal on the basis of an oscillation of the crystal oscillator, a frequency-dividing control part 704 which frequency-divides an output signal of the oscillation part 702 to thereby perform a control of an operation of a motor and an ultrasonic motor, and a motor drive part (driver) 706 outputting a motor drive signal driving a step motor on the basis of the output signal of frequency-dividing control part 704. The integrated circuit 754 is constituted by a C-MOS or a PLA for instance. In a case where the integrated circuit 754 is constituted by the C-MOS, in the integrated circuit 754, there are built in the oscillation part 702, the frequency-dividing control part 704, and the motor drive part 706. In a case where the integrated circuit 754 is constituted by the PLA, it is constituted such that the oscillation part 702, the frequency-dividing control part 704 and the motor drive part 706 are operated by a program stored in the PLA.

The crystal oscillator unit 750 and the integrated circuit 754 are fixed to a circuit base plate 710. The circuit base plate 710, the crystal oscillator unit 750 and the integrated circuit 754 constitute a circuit block 712. The circuit block 712 is disposed in the case back side of the main plate 102. Additionally, in the timepiece with the calendar of the present invention, in compliance with a necessity, it is possible to use externally attached elements (712*a*-712*e* and the like) such as resistance, capacitor, coil and diode. The battery 0.140 is disposed in the case back side of the circuit block 712 through an insulating plate 714. In the case back side of the main plate 102, there are disposed a coil block 730 containing a coil wire wound around a magnetic core, a stator 732 disposed so as to contact with both end parts of the magnetic core of the coil block 730, and a rotor 734 containing a rotor magnet (not shown in the drawing) disposed in a rotor hole 732*c* of the stator 732. The coil block 730, the stator 732 and the rotor 734 constitute the step motor. It is constituted such that a fifth wheel & pinion 141 is rotated by a rotation of the rotor 734. It is constituted such that a second wheel & pinion 142 is rotated by a rotation of the fifth wheel & pinion 141. It is constituted such that a third wheel & pinion 144 is rotated by a rotation of the second wheel & pinion 142. It is constituted such that a center wheel & pinion 146 is rotated by a rotation of the third wheel & pinion 144. It is constituted such that a minute wheel 148 is rotated by a rotation of the center wheel & pinion 146.

The second wheel & pinion 142 is constituted so as to perform one rotation in one minute. A second hand 160 is attached to the second wheel & pinion 142. The center wheel & pinion 146 is constituted so as to perform one rotation in one hour. A minute hand 162 is attached to the center wheel & pinion 146. An hour wheel 180 is constituted so as to perform one rotation in 12 hours. An hour hand 164 is attached to an hour display wheel 188 of the hour wheel 180. A slip mechanism is provided in the center wheel and pinion 146. When correcting the hands, the minute hand 162 and the hour hand 164 can be rotated by rotating the winding stem 110 under a state that the second hand 160 is stopped by the slip mechanism. When correcting the hands, it is good to stop the second hand 160 by setting the second wheel & pinion 142 by a train wheel setting lever (not shown in the drawing). A center pipe 102*c* is fixed to the main plate 102. The center pipe 102*c* extends from the case back side of the main plate 102 to the dial side of the main plate 102. The center wheel & pinion 146 is rotatably supported in a hole part of the center pipe 102*c*. An abacus bead of the second wheel & pinion 142 is rotatably supported in a hole part of the center wheel & pinion 146. A train wheel bridge 158 is disposed in the case back side of the main plate 102. An upper axle part of the rotor 734, an upper axle part of the fifth wheel & pinion 141, an upper axle part of the second wheel & pinion 142, an upper axle part of the third wheel & pinion 144 and an upper axle part of the minute wheel 148 are rotatably supported by the train wheel bridge 158. A lower axle part of the rotor 734, a lower axle part of the fifth wheel & pinion 141, a lower axle part of the third wheel & pinion 144 and a lower axle part of the minute wheel 148 are rotatably supported by the main plate 102.

(1.3) Constitution of Hour Display Train Wheel

Figure 3:
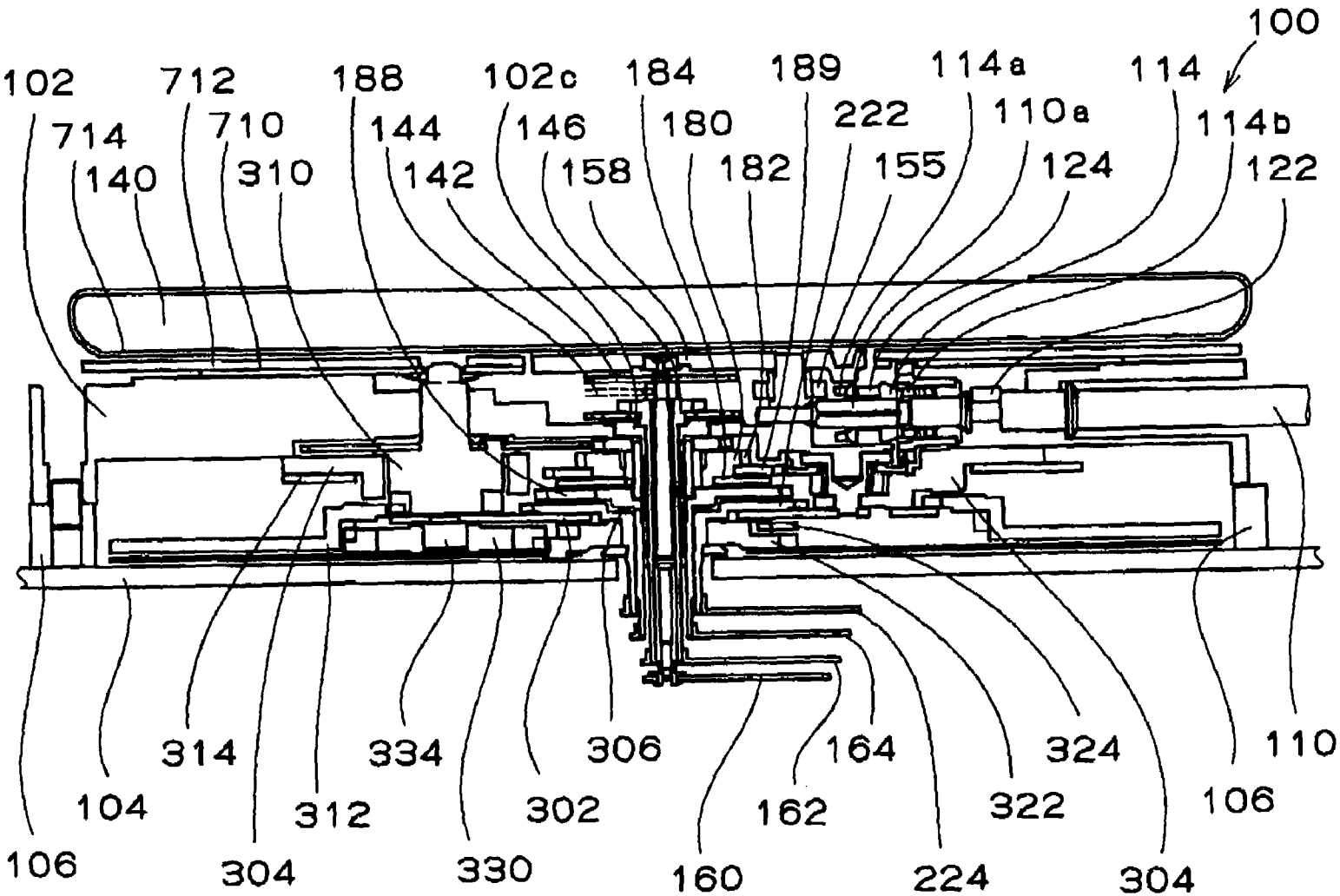
FIG. 3 is a partial sectional view showing a winding stem, a front train wheel and one portion of the calendar mechanism in the 1st embodiment of the timepiece with the calendar mechanism of the present invention.
Figure 4:
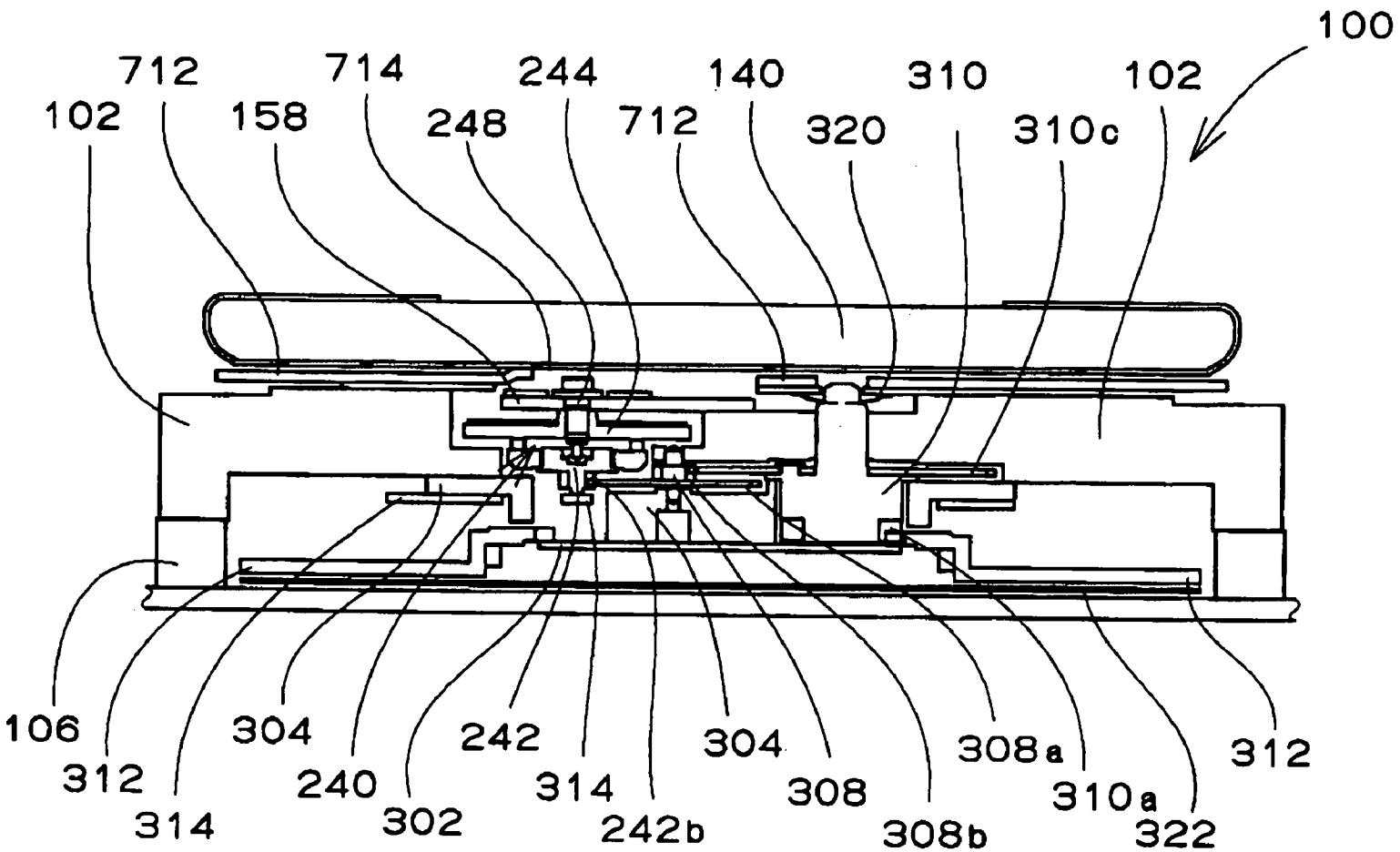
FIG. 4 is a partial sectional view showing an ultrasonic motor in the 1st embodiment of the timepiece with the calendar mechanism of the present invention.
Figure 25:
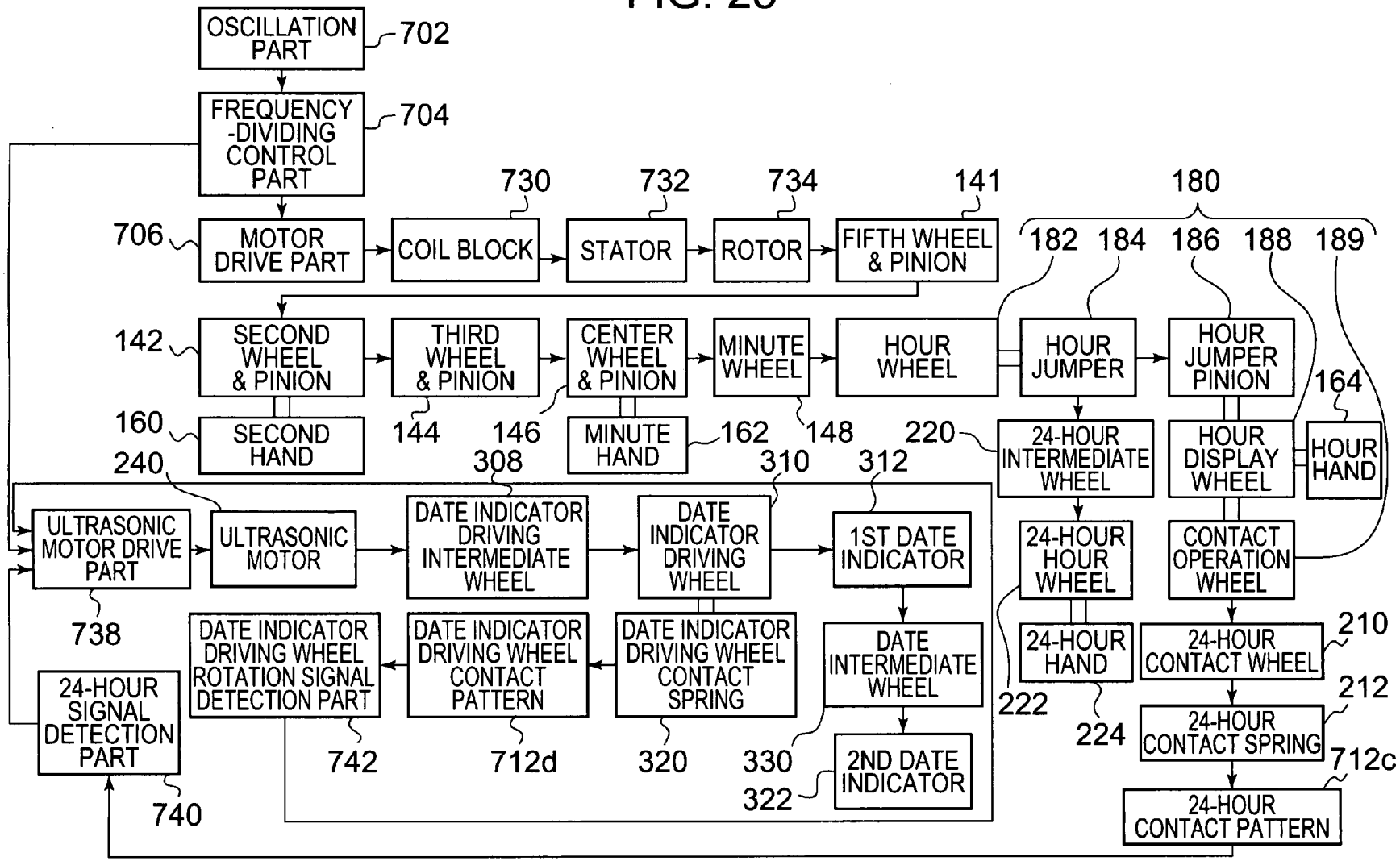
FIG. 25 is a block diagram showing the drive circuit, the front train wheel, the calendar mechanism, the ultrasonic motor, and the like in the 1st embodiment of the timepiece with the calendar mechanism of the present invention.

Hereunder, it is explained about a constitution of an hour display train wheel. Referring to FIG. 3, FIG. 4 and FIG. 25, in the movement 100, the hour wheel 180 is constituted so as to rotate by the rotation of the minute wheel 148. The hour wheel 180 contains an hour gear wheel 182, an hour jumper 184, an hour jumper pinion 186, an hour display wheel 188, and a contact operation wheel 189. It is constituted such that the hour gear wheel 182, the hour jumper 184, the hour jumper pinion 186, the hour display wheel 188 and the contact operation wheel 189 monolithically rotate. The hour wheel 180 performs one rotation in 12 hours. By the hour hand 164 attached to the hour display wheel 188 of the hour wheel 180, "time" is displayed by a "12-hour system" in which one revolution becomes 12 hours. A 24-hour contact wheel 210 is constituted so as to rotate by a rotation of the contact operation wheel 189. The 24-hour contact wheel 210 has a 24-hour contact spring 212. The 24-hour contact spring 212 is disposed so as to be capable of contacting with a 24-hour contact pattern 712*c* of the circuit block 712. A 24-hour intermediate wheel 220 is constituted so as to rotate by the rotation of the hour wheel 180. A 24-hour hour wheel 222 is constituted so as to rotate by a rotation of the 24-hour intermediate wheel 220. The 24-hour hour wheel 222 performs one rotation in one day (24 hours). By a 24-hour hand 224 attached to the 24-hour hour wheel 222, "hour" is displayed by a "24-hour system" in which one revolution becomes 24 hours.

(1.4) Constitutions of Rocking Mechanism and Hand Corrector Mechanism

Figure 1:
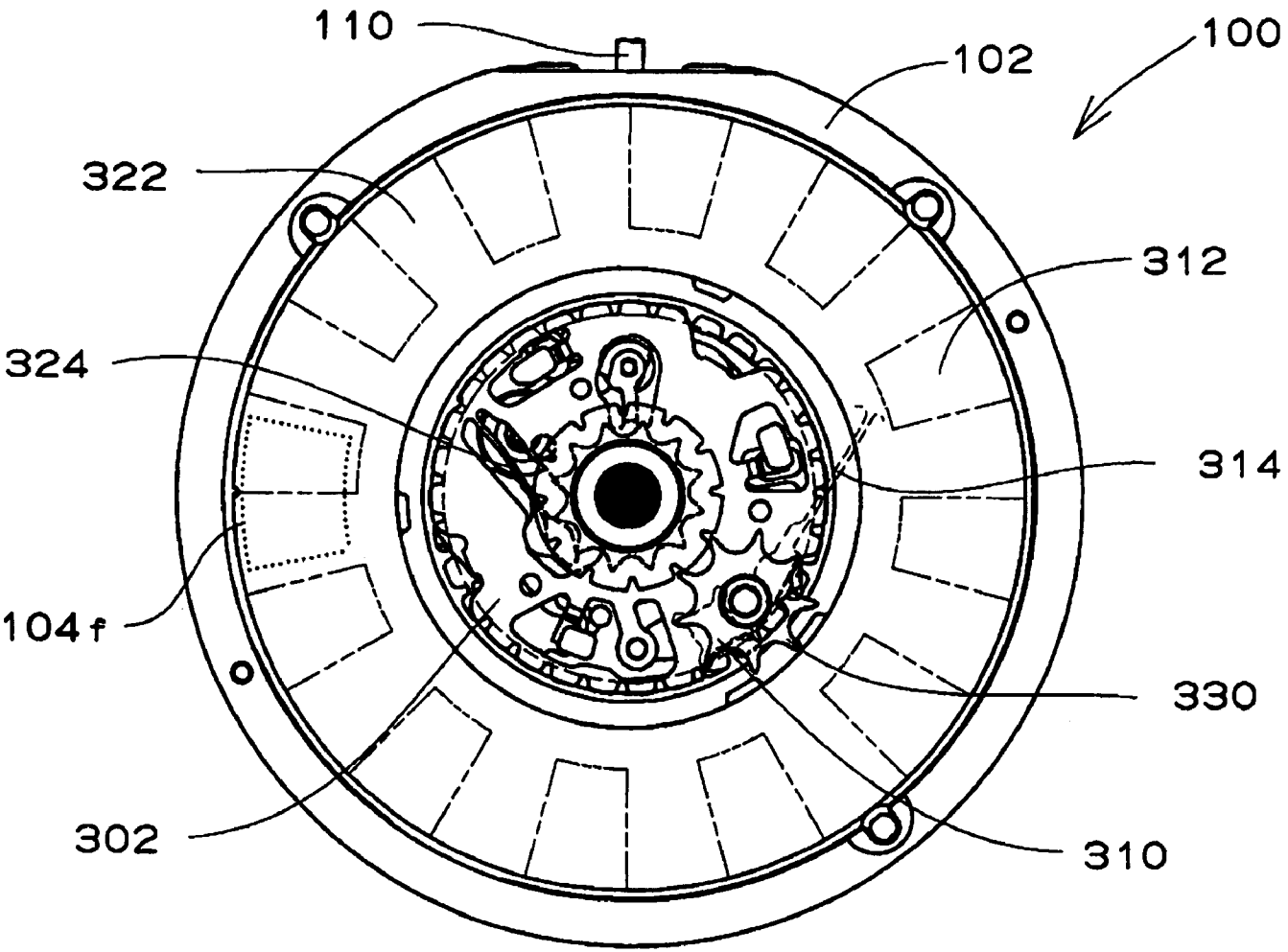
FIG. 1 is a schematic plan view showing a structure when a movement is seen from a dial side in a 1st embodiment of a timepiece with a calendar mechanism of the present invention.
Figure 2:
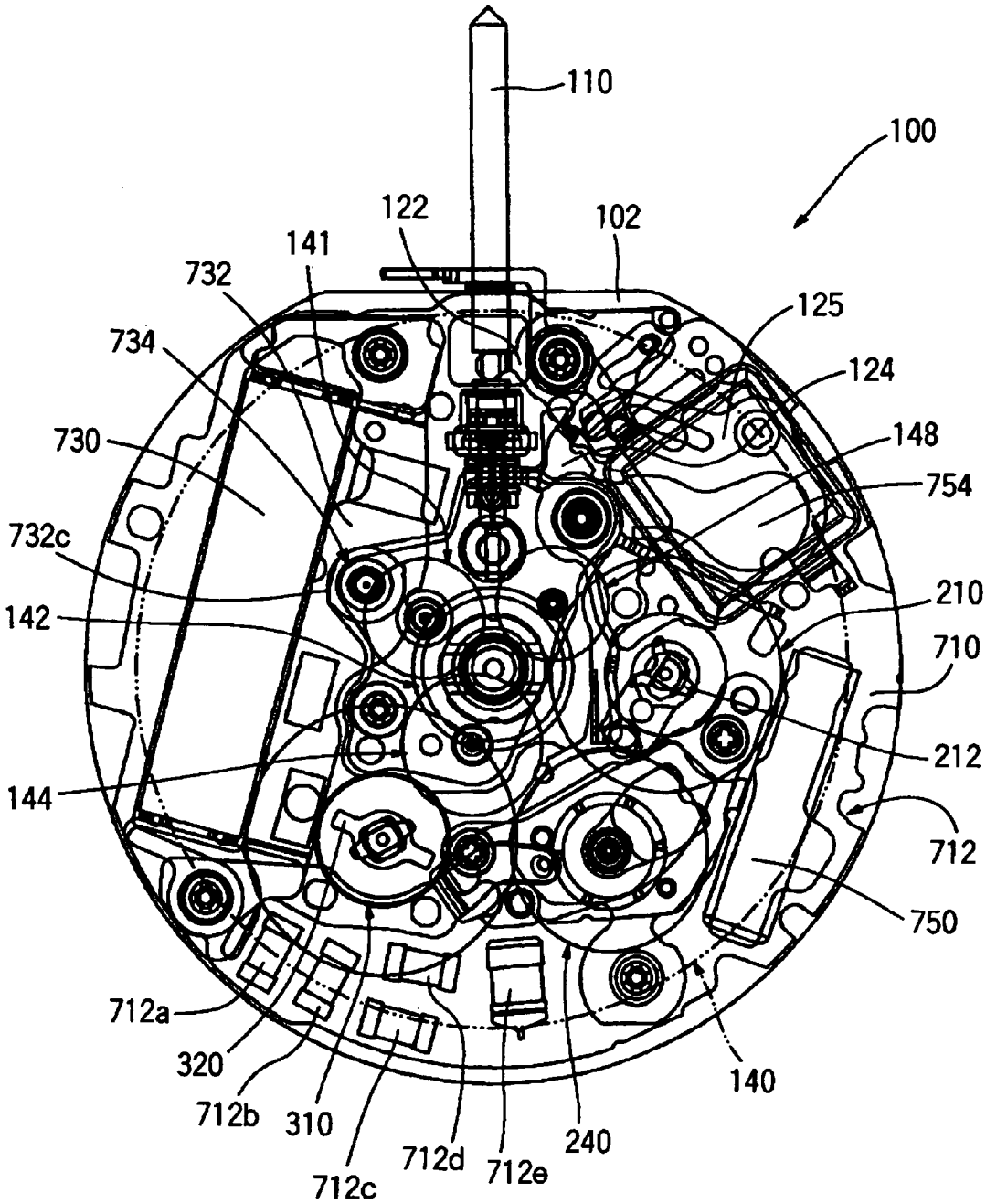
FIG. 2 is a schematic plan view (see-through view) showing the structure when the movement is seen from a case back side in the 1st embodiment of the timepiece with the calendar mechanism of the present invention.

Hereunder, it is explained about constitutions of a rocking mechanism and a hand corrector mechanism. Referring to FIG. 2, FIG. 3 and FIG. 25, in the movement 100, the setting lever 122 is rotatably disposed in the front side of the main plate 102. The yoke 124 is rotatably disposed in the front side of the main plate 102. The yoke 124 is biased so as to be pressed to a tip part of the setting lever 122 by a spring force of a yoke spring part (not shown in the drawing). The yoke holder 125 is provided so as to press the setting lever 122 and the yoke 124. A setting lever positioning pin provided in the setting lever 122 engages with a setting lever positioning angle part of the yoke, thereby determining a position of the setting lever 122 in a rotation direction. A winding stem guide part of the setting lever 122 engages with a setting lever reception part of the winding stem 110, thereby determining a position of the winding stem 110 in an axial direction on the basis of a rotation of the setting lever 122. The setting lever 122 is constituted so as to position the winding stem 110 to 3 positions (0th, stage, 1st stage, 2nd stage) in the axial direction. A clutch wheel guide part of the yoke 124 engages with a step part of the clutch wheel 114, thereby determining a position of the clutch wheel 114 in a rotation axis direction on the basis of a rotation of the yoke 124. On the basis of the rotation of the setting lever 122, the yoke 124 is positioned to 3 positions in the rotation direction.

A minute gear wheel (not shown in the drawing) of the minute wheel 148 is disposed so as to mesh with a setting wheel 155. The setting wheel 155 is disposed between the main plate 102 and the train wheel bridge 158. A minute pinion (not shown in the drawing) of the minute wheel 148 is located in the dial side of the main plate 102, and constituted so as to mesh with the minute gear wheel 182. A hole part of the hour jumper pinion 186 of the hour wheel 180 is rotatably supported by an outer periphery part of an axle portion of the center pipe 102*c*. A hand washer 306 is disposed between the 24-hour hour wheel. 222 and the hour display wheel 188. The clutch wheel 114 has A teeth 114*a* and B teeth 114*b*. The A teeth 114*a* are provided in an end part of the clutch wheel 114 in a side (inner side) near to a center of the movement 100. The B teeth 114*b* are provided in an end part of the clutch wheel 114 in a side (outer side) remote from the center of the movement 100. For example, a teeth number of the B teeth 1146 is 2. It is constituted such that, under a state that the winding stem 110 exists in its "0th stage", the clutch wheel 114 exists in its 1st position intermediate with respect to the movement and, under a state that the winding stem 110 exists in its "1st stage", the clutch wheel 11.4 exists in its 2nd position near to the outer side of the movement and, under a state that the winding stem 110 exists in its "2nd stage", the clutch wheel 114 exists in its 3rd position near to the inner side of the movement. It is constituted such that, under the state that the winding stem 110 exists in its "0th stage" and the state that it exists in its "1st stage", the setting wheel 155 does not mesh with the A teeth 114*a* of the clutch wheel 114 and, under the state that the winding stem 110 exists in its "2nd stage", it meshes with the A teeth 114*a* of the clutch wheel 114.

(1.5) Constitution of Ultrasonic Motor

Hereunder, it is explained about a constitution of an ultrasonic motor. Referring to FIG. 2, FIG. 4 and FIG. 25, in the movement 100, an ultrasonic motor 240 contains an ultrasonic rotor 242, an ultrasonic stator 244, and an ultrasonic rotor friction spring 246. An ultrasonic rotor axle 248 is fixed to the train wheel bridge 158. The ultrasonic stator 244 is located between the train wheel bridge 158 and the main plate 102. The ultrasonic rotor 242 is located in a hole of the main plate 102. The ultrasonic rotor friction spring 246 is located in the dial side of the main plate 102. The ultrasonic rotor 242 is rotatably incorporated into the ultrasonic rotor axle 248. It is constituted such that, by an elastic force of the ultrasonic rotor friction spring 246, the ultrasonic rotor 242 is pressed to the ultrasonic stator 244. The ultrasonic rotor 242 contains an ultrasonic rotor pinion 242*b*.

(1.6) Constitution of 1st Date Indicator Unlocking Mechanism

Hereunder, it is explained about a constitution of a 1st date indicator unlocking mechanism. Referring to FIG. 1-FIG. 4 and FIG. 25, in the movement 100, a date unlocking mechanism contains a date indicator driving intermediate wheel 308, a date indicator driving wheel 310, and a 1st date jumper 314. The date indicator driving intermediate wheel 308 contains a date indicator driving intermediate gear wheel 308*a*, and a date indicator driving intermediate pinion 308*b*. The date indicator driving wheel 310 contains a date indicator driving gear wheel 310*c*, and 4 date indicator driving teeth 310*a*. The date indicator driving teeth 310*a* may be provided by 2, or may be provided by 3 or more. The ultrasonic rotor pinion 242*b* meshes with the date indicator driving intermediate gear wheel 308*a* of the date indicator driving intermediate wheel 308. The date indicator driving intermediate pinion 308*b* of the date indicator driving intermediate wheel 308 meshes with the date indicator driving gear wheel 310*c* of the date indicator driving wheel 310. It is constituted such that, by the fact that the ultrasonic rotor 242 rotates, the date indicator driving intermediate wheel 308 rotates. It is constituted such that, by the fact that the date indicator driving intermediate wheel 308 rotates, the date indicator driving wheel 310 rotates. A 1st date indicator 312 is rotatably incorporated into the calendar platform 304. The 1st date jumper 314 is incorporated into the calendar platform 304. The 1st date jumper 314 contains a spring part 314*b*, and setting parts 314*c*, 314*d* provided in a tip of the spring part. The setting parts 314*c*, 314*d* of the 1st date jumper 314 set the teeth part of the 1st date indicator 312. It is constituted such that, by the fact that the date indicator driving wheel 310 rotates by 90 degrees, the 1st date indicator 312 rotate by for one pitch (one tooth). The date indicator driving wheel 310 has a date indicator driving wheel contact spring 320. The date indicator driving wheel contact spring 320 is disposed so as to be capable of contacting with a date indicator driving wheel contact pattern 712*d* of the circuit block 712.

Figure 5:
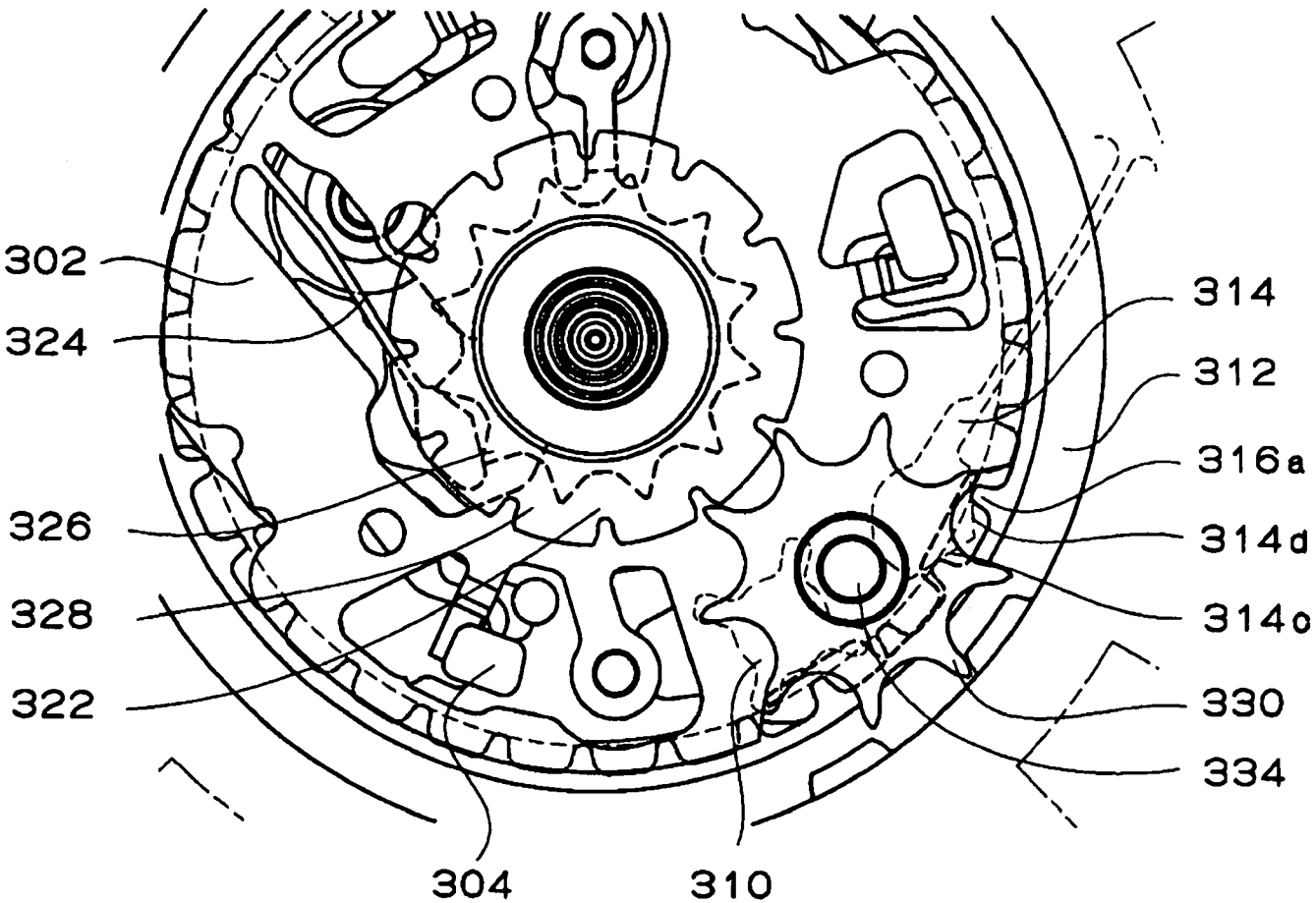
FIG. 5 is an enlarged partial plan view showing one portion of the calendar mechanism when the movement is seen from the dial side in the 1st embodiment of the timepiece with the calendar mechanism of the present invention.

(1.7) Constitution of Calendar Mechanism (1.7.1) Constitutions of 1st Date Indicator and 2nd Date Indicator Hereunder, it is explained about a constitution of a calendar mechanism of the timepiece with the calendar mechanism of the present invention. FIG. 5 is a partial plan view showing a structure of the back side of the movement seen from the dial side under a state that the 1st date indicator 312 is being attempted to be rotated in a positive direction (clockwise direction) in the timepiece with the calendar mechanism of the present invention. Referring to FIG. 3, FIG. 5 and FIG. 25, the movement 100 possesses the date indicator driving wheel 310 rotated by the rotation of the date indicator driving intermediate wheel 308, the 1st date indicator 312 displaying the place of units among dates, the 1st date jumper 314 for setting a position of the 1st date indicator 312 in its rotation direction, a 2nd date indicator 322 displaying the place of tens among dates, a 2nd date jumper 324 for setting a position of the 2nd date indicator 322 in its rotation direction, and a date intermediate wheel 330 which rotates on the basis of the rotation of the 1st date indicator 312, there by being capable of rotating the 2nd date indicator 322. The 1st date indicator 312 is provided so as to be rotatable with respect to the calendar platform 304. The 2nd date indicator 322 is provided so as to be rotatable with respect to the hour wheel 180. A rotation center of the 1st date indicator 312 and a rotation center of the 2nd date indicator 322 exist in the same position. That is, the rotation center of the 1st date indicator 312 and the rotation center of the 2nd date indicator 322 are disposed in the same position as a rotation center of the hour hand 164 (i.e., rotation center of the hour wheel 0.180). The date intermediate wheel 330 is provided so as to be rotatable with respect to a date intermediate wheel pin 334 fixed to a date indicator maintaining plate. The setting parts 314*c*, 314*d* of the 1st date jumper 314 set a teeth part of the 1st date indicator 312.

Figure 6:
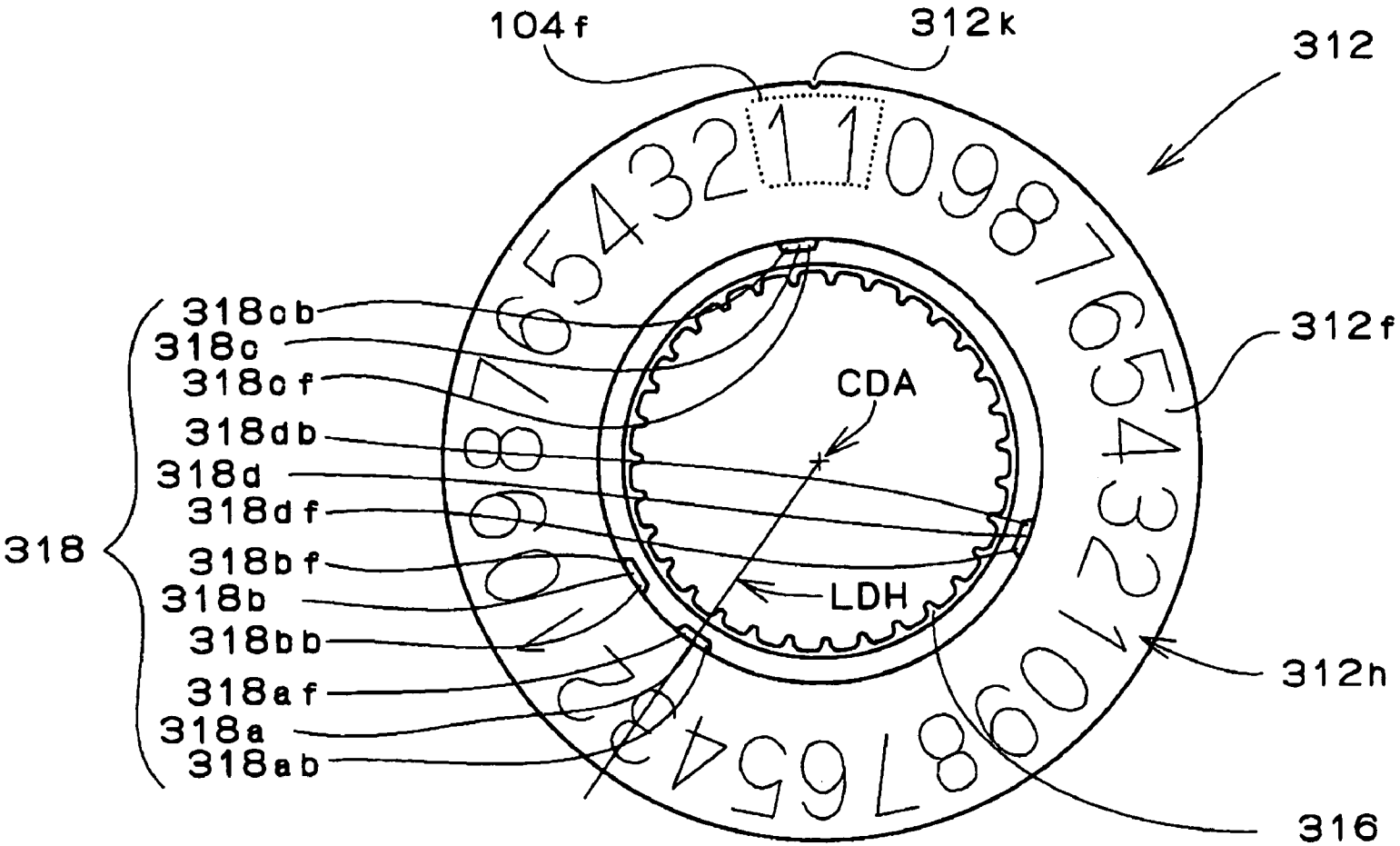
FIG. 6 is a plan view showing a 1st date indicator in a constitution in which a date window is disposed in a 12 o'clock direction of a dial in the 1st embodiment of the timepiece with the calendar mechanism of the present invention.

Referring to FIG. 6, in a case of a constitution in which a date window 104*f* is formed in a 12 o'clock position of a dial 104, the 1st date indicator 312 possesses a ring-shaped 1st date letter display face 312*f*. The 1st date indicator 312 contains 31 1st date indicator teeth parts 316 formed as internal teeth, and 4 calendar shift teeth 318 formed as internal teeth. The 1st date indicator teeth parts 316 are formed with a spacing of equal angle, i.e., spacing of (360/31) degrees. The calendar shift teeth 318 comprise a 1st calendar shift tooth 318*a* becoming a reference, a 2nd calendar shift tooth 318*b* formed with a spacing of (−360×2/31) degrees in the clockwise direction with the 1st calendar shift tooth 318*a* being made the reference, a 3rd shift tooth 318*c* formed with a spacing of (360×10/31) degrees in the clockwise direction with the 2nd calendar shift tooth 318*b* being made a reference, and a 4th calendar shift tooth 318*d* formed with a spacing of (360×9/31) degrees in the counterclockwise direction with the 1st calendar shift tooth 318*a* being made the reference.

The 1st calendar shift tooth 318*a* possesses a positive rotation unlocking part 318*af* for unlocking the 1st date indicator 312 in a 1st direction (i.e., clockwise direction), and a reverse rotation unlocking part 318*ab* for unlocking the 1st date indicator 312 in a 2nd direction (i.e., counterclockwise direction) opposite to the above 1st direction. The 2nd calendar shift tooth 318*b* possesses a positive rotation unlocking part 318*bf* for unlocking the 1st date indicator 312 in the 1st direction (i.e., clockwise direction), and a reverse rotation unlocking part 318*bb* for unlocking the 1st date indicator 312 in the 2nd direction (i.e., counterclockwise direction) opposite to the above 1st direction. The 3rd calendar shift tooth 318*c* possesses a positive rotation unlocking part 318*cf* for unlocking the 1st date indicator 312 in the 1st direction (i.e., clockwise direction), and a reverse rotation unlocking part 318*cb* for unlocking the 1st date indicator 312 in the 2nd direction (i.e., counterclockwise direction) opposite to the above 1st direction. The 4th calendar shift tooth 318*d* possesses a positive rotation unlocking part 318*df* for unlocking the 1st date indicator 312 in the 1st direction (i.e., clockwise direction), and a reverse rotation unlocking part 318*db* for unlocking the 1st date indicator 312 in the 2nd direction (i.e., counterclockwise direction) opposite to the above 1st direction. In FIG. 6, the rotation center of the 1st date indicator 312 is defined as "CDA", and a straight line passing through the "CDA" and a center part of the 1st calendar shift tooth 318*a* in the rotation direction is defined as "LDH". In the 1st calendar shift tooth 318*a*, the positive rotation unlocking part 318*af* and the reverse rotation unlocking part 318*ab* are formed in an axisymmetric shape whose reference is made the "LDH". The 4 calendar shift teeth 318*a*-318*d* are respectively formed in the same dimension and shape.

1st date letters 312*h* consisting of 31 numerals are provided in the 1st date display face 312*f*. The 1st date letters 312*h* contain 4 sets of numerals. That is, the 1st date letters contain numerals of "1" to "9" and "0" which constitute a 1st set of the 1st date letters, numerals of "1" to "9" and "0" which constitute a 2nd set of the 1st date letters, numerals of "1" to "9" and "0" which constitute a 3rd set of the 1st date letters, and numeral of "1" which constitutes a 4th set of the 1st date letters. That is, the 1st date letters 312*h* contain 31 numerals of "1", "1", "2", "3", "4", "5", "6", "7", "8", "9", "0", "1", "2", "3", "4", "5", "6", "7", "8", "9", "0", "1", "2", "3", "4", "5", "6", "7", "8", "9", "0". The 31 numerals constituting the 1st date letters 312*h* are disposed in the 1st date letter display face 312*f* with a spacing of equal angle, i.e., spacing of (360/31) degrees. In a state shown in FIG. 6, among the 1st date letters 312*h*, "1" and "1" adjacently disposed are disposed in the date window 104*f* provided in the dial 104. A notch part 312*k* is formed in an outer periphery part of the 1st date letter display face 312*f* so as to correspond to a position between "1" and "1" adjacently disposed among the 1st date letters 312*h*.

Figure 7:
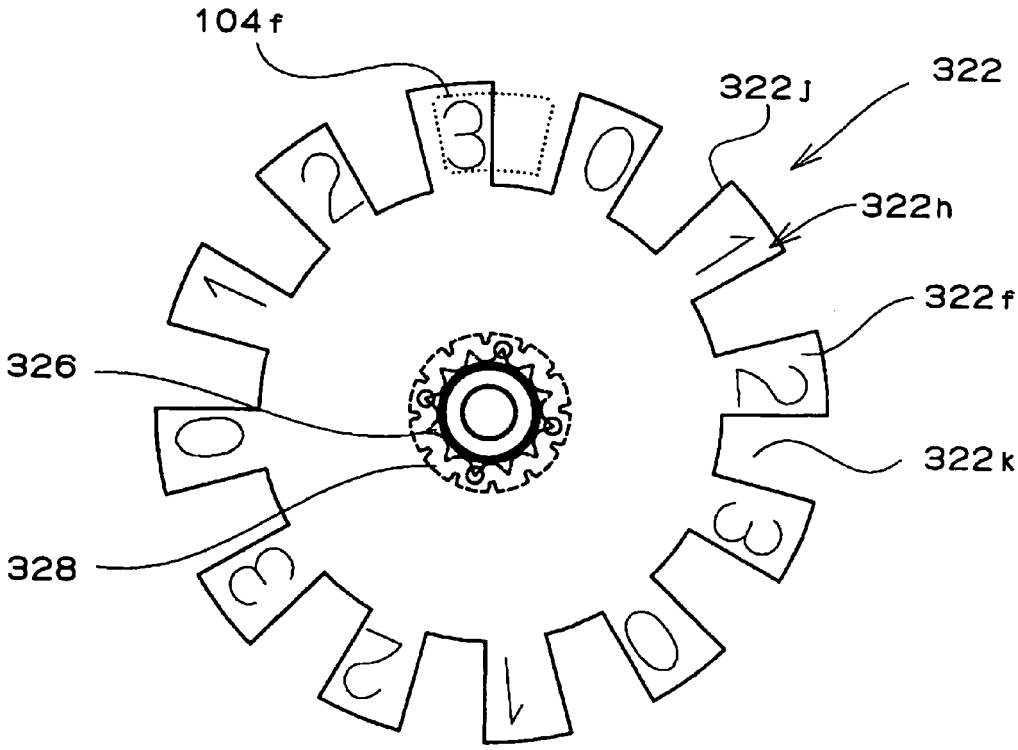
FIG. 7 is a plan view showing a 2nd date indicator in the constitution in which the date window is disposed in the 12 o'clock direction of the dial in the 1st embodiment of the timepiece with the calendar mechanism of the present invention.

Referring to FIG. 5 and FIG. 7, the 2nd date indicator 322 possesses a disc-shaped 2nd date letter display face 322*f* provided with notches. The 2nd date letter display face 322*f* contains 12 trapezoid portions 322*j* formed with a spacing of (360/12) degrees, and 12 notch parts 322*k* formed with the spacing of (360/31) degrees. Additionally, the 2nd date indicator 322 contains 12 positioning teeth parts 326 formed as external teeth, and 12 unlocking teeth 328 formed as external teeth. The positioning teeth parts 326 are formed with the spacing of equal angle, e.g., spacing of (360/12) degrees. The unlocking teeth 328 are formed with the spacing of equal angle, e.g., spacing of (360/12) degrees. 2nd date letters 322*h* consisting of "1", "2", "3", "0" are provided in the 2nd date letter display face 322*f*. Numeral of "1" and numeral of "2" are disposed in the 2nd date letter display face 322*f* with a spacing of 30 degrees. Numeral of "2" and numeral of "3" are disposed in the 2nd date letter display face 322*f* with the spacing of 30 degrees. Numeral of "3" and numeral of "0" are disposed in the 2nd date letter display face 322*f* with the spacing of 30 degrees. Accordingly, in the 2nd date letter display face 322*f*, there are disposed numeral of "1", numeral of "2", numeral of "3" and numeral of "0" so as to mutually form the spacing of 30 degrees. In the 2nd date letter display face 322*f*, there are provided sets of numerals consisting of numeral of "1", numeral of "2", numeral of "3" and numeral of "0" by 3 sets. Or, it is also possible to adopt a constitution in which, instead of providing numeral of "0", that position is made a "white paper" portion (i.e., blank portion in which no numeral is provided). Under the state shown in FIG. 7, among the 2nd date letters 322*h*, "3" is displayed in a left side portion of the date window 104*f* provided in the dial 104.

Figure 8:
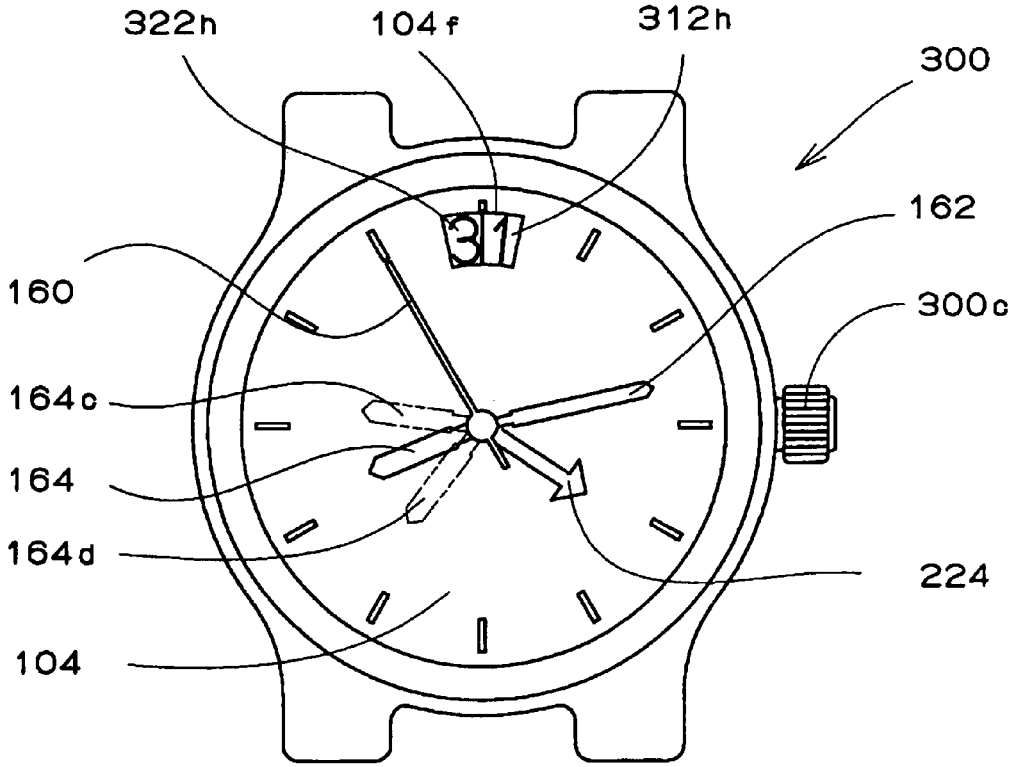
FIG. 8 is a plan view showing a complete in the constitution in which the date window is disposed in the 12 o' clock direction of the dial in the 1st embodiment of the timepiece with the calendar mechanism of the present invention.

Referring to FIG. 3, the 2nd date letter display face 322*f* is disposed in a position nearer to the dial 104 than the 1st date letter display face 312*f*. Referring to FIG. 8, in a complete 300 of the timepiece with the calendar of the present invention, the date window 104*f* is formed in the 12 o'clock position of the dial 104. In the complete 300, in the left side portion within the date window 104*f* of the dial 104, there is disposed "3" among the 2nd date letters 322*h* of the 2nd date indicator 322 and, in a right side portion within the date window 104*f*, there are disposed the notch part 322*k* of the 2nd date indicator 322 and "1" among the 1st date letters 312*h*. Accordingly, the complete 300 is displaying "31st" day.

Figure 9:
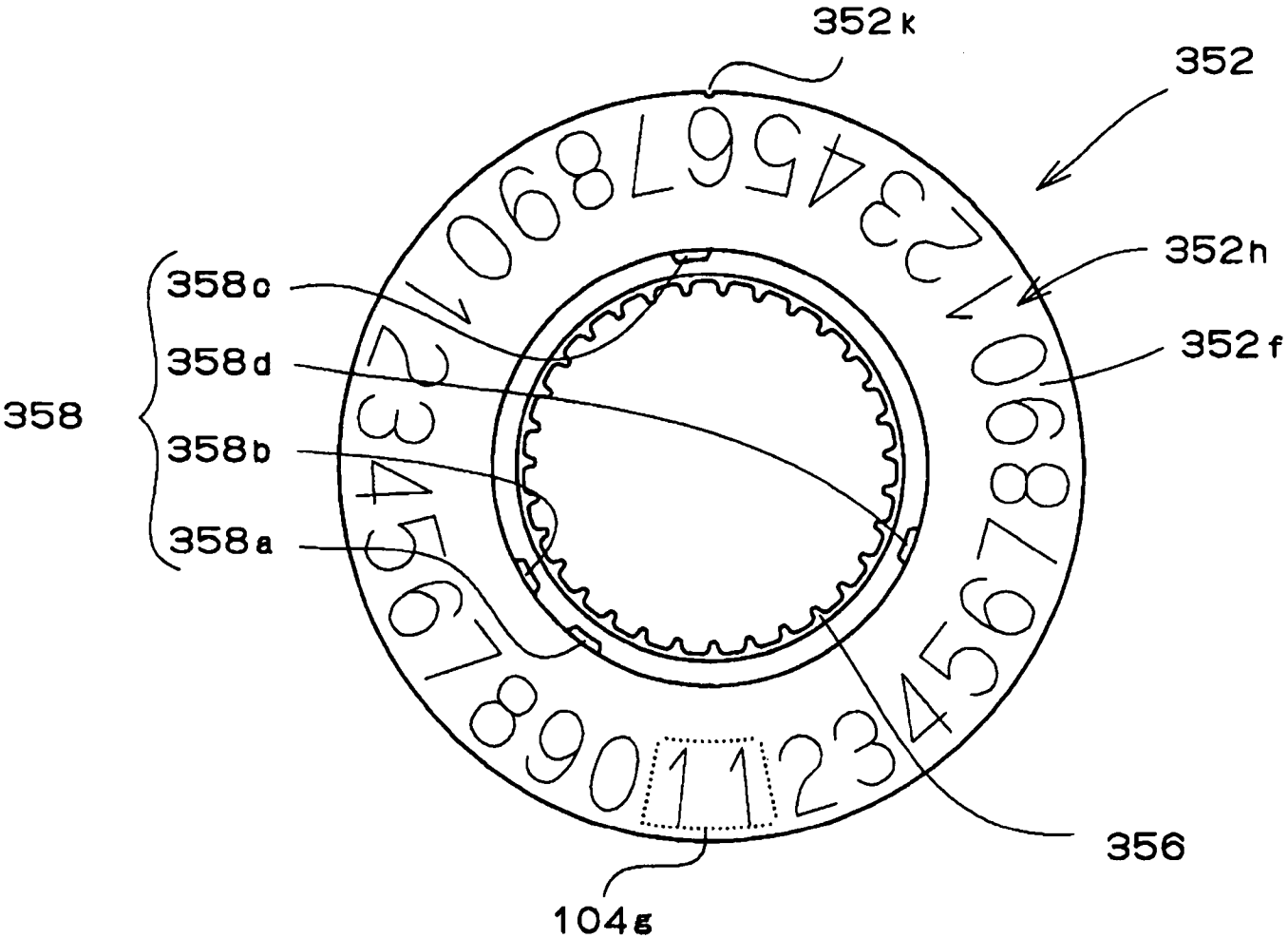
FIG. 9 is a plan view showing the 1st date indicator in a constitution in which the date window is disposed in a 6 o'clock direction of the dial in the 1st embodiment of the timepiece with the calendar mechanism of the present invention.

Referring to FIG. 9, in a case of a constitution in which a date window 104*g* is formed in a 6 o'clock position of the dial 104, a 1st date indicator 352 possesses a ring-shaped 1st date letter display face 352*f*. The 1st date indicator 352 contains 31 1st date indicator teeth parts 356 formed as internal teeth, and 4 calendar shift teeth 358 formed as internal teeth. The 1st date indicator teeth parts 356 are formed with a spacing of equal angle, i.e., spacing of (360/31) degrees. The calendar shift teeth 358 comprise a 1st calendar shift tooth 358*a* becoming a reference, a 2nd calendar shift tooth 358*b* formed with a spacing of (360×2/31) degrees in the clockwise direction with the 1st calendar shift tooth 358*a* being made the reference, a 3rd calendar shift tooth 358*c* formed with a spacing of (360×10/31) degrees in the clockwise direction with the 2nd calendar shift tooth 358*b* being made a reference, and a 4th calendar shift tooth 358*d* formed with a spacing of (360×9/31) degrees in the counterclockwise direction with the 1st calendar shift tooth 358*a* being made the reference. 1st date letters 352*h* consisting of 31 numerals are provided in the 1st date letter display face 352*f*. The 1st date letters 352*h* contain 4 sets of numerals. That is, the 1st date letters contain numerals of "1" to "9" and "0" which constitute a 1st set of the 1st date letters, numerals of "1" to "9" and "0" which constitute a 2nd set of the 1st date letters, numerals of "1" to "9" and "0" which constitute a 3rd set of the 1st date letters, and numeral of "1" which constitutes a 4th set of the 1st date letters. The 31 numerals constituting the 1st date letters 352*h* are disposed in the 1st date letter display face 352*f* with the spacing of equal angle, i.e., spacing of (360/31) degrees. In a state shown in FIG. 9, among the 1st date letters 352*h*, "1" and "1" adjacently disposed are disposed in the date window 104*g* provided in the dial 104. A notch part 352*k* is formed in an outer periphery part of the 1st date letter display face 352*f* so as to correspond to a position of "6" existing in a position opposite to a center of the 1st date indicator 352 with respect to "1" and "1" adjacently disposed among the 1st date letters 352*h*.

Figure 10:
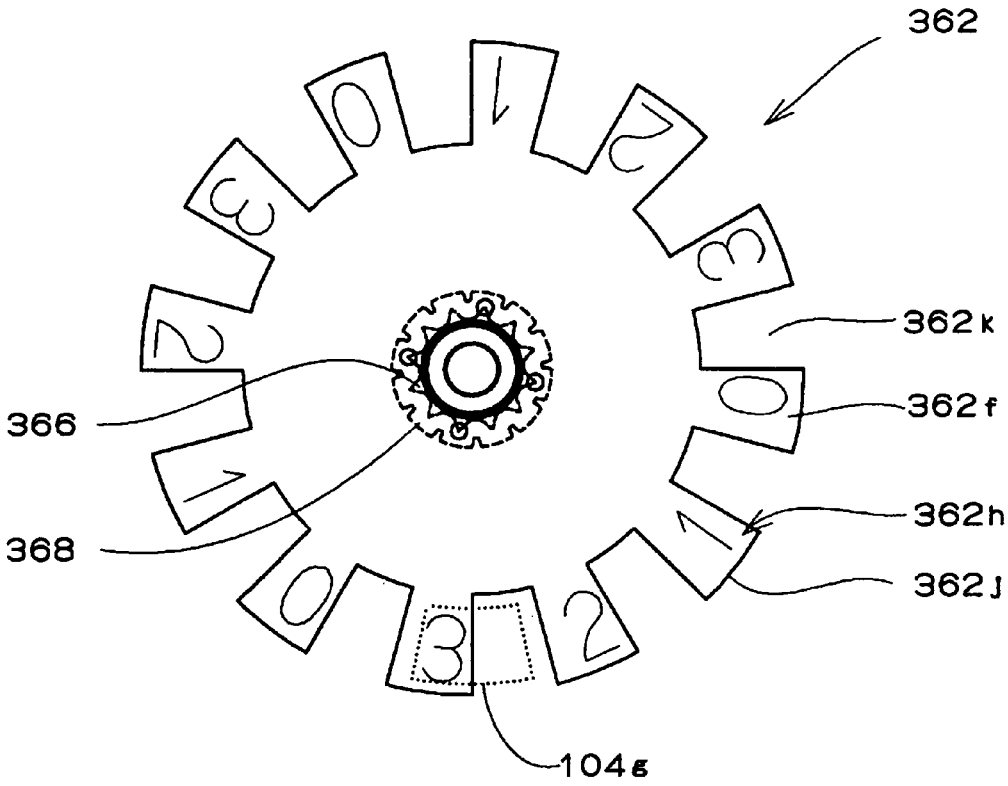
FIG. 10 is a plan view showing the 2nd date indicator in the constitution in which the date window is disposed in the 6 o'clock direction of the dial in the 1st embodiment of the timepiece with the calendar mechanism of the present invention.

Referring to FIG. 10, a 2nd date indicator 362 possesses a disc-shaped 2nd date letter display face 362*f* provided with notches. The 2nd date letter display face 362*f* contains 12 trapezoid portions 362*j* formed with the spacing of (360/12) degrees, and 12 notch parts 362*k* formed with the spacing of (360/12) degrees. Additionally, the 2nd date indicator 362 contains 12 positioning teeth parts 366 formed as external teeth, and 12 unlocking teeth 368 formed as external teeth. The positioning teeth parts 366 are formed with the spacing of equal angle, e.g., spacing of (360/12) degrees. The unlocking teeth 368 are formed with the spacing of equal angle, e.g., spacing of (360/12) degrees. 2nd date letters 362*h* consisting of "1", "2", "3", "0" are provided in a 2nd date letter display face 362*f*. Numeral of "1" and numeral of "2" are disposed in the 2nd date letter display face 362*f* with the spacing of 30 degrees. Numeral of "2" and numeral of. "3" are disposed in the 2nd date letter display face 362*f* with the spacing of30 degrees. Numeral of "3" and numeral of "0" are disposed in the 2nd date letter display face with the spacing of 30 degrees. Accordingly, in the 2nd date letter display face 362*f*, there are disposed numeral of "1", numeral of "2", numeral of "3" and numeral of "0" so as to mutually form the spacing of 30 degrees. In the 2nd date letter display face 362*f*, there are provided sets of numerals consisting of numeral of "1", numeral of "2", numeral of "3" and numeral of "0" by 3 sets. Or, it is also possible to adopt the constitution in which, instead of providing numeral of "0", that position is made the "white paper" portion (i.e., blank portion in which no numeral is provided). Under the state shown in FIG. 10, among the 2nd date letters 362*h*, "3" is disposed in a left side portion of the date window 104*g* provided in the dial 104.

Figure 11:
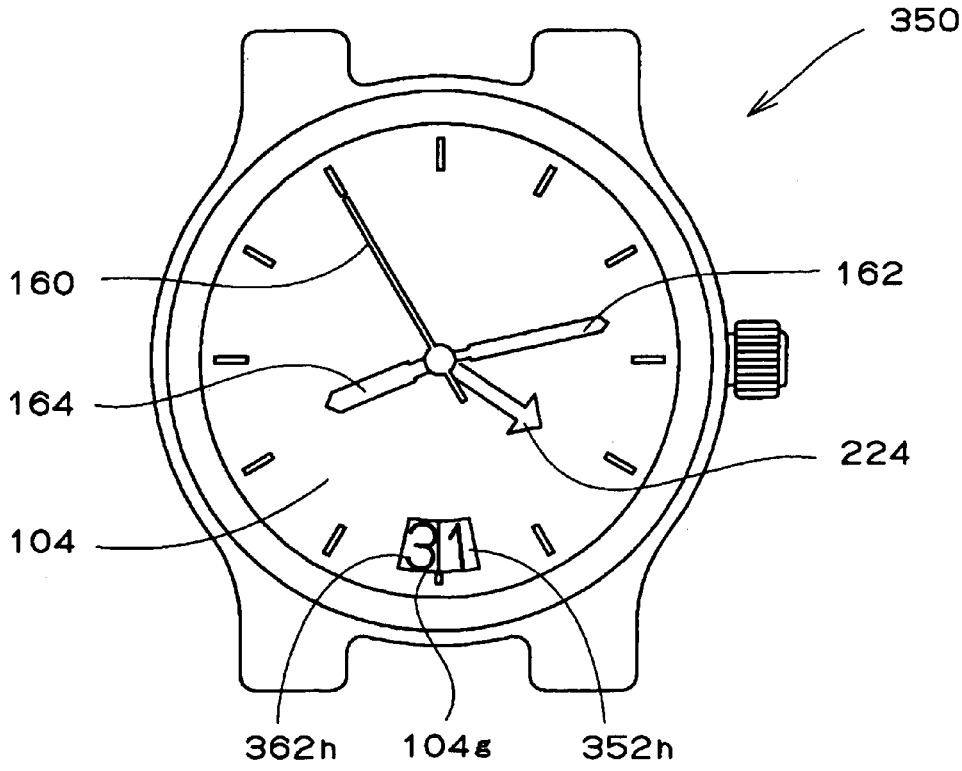
FIG. 11 is a plan view showing the complete in the constitution in which the date window is disposed in the 6 o'clock direction of the dial in the 1st embodiment of the timepiece with the calendar mechanism of the present invention.

Referring to FIG. 11, in a complete 350 of the timepiece with the calendar mechanism of the present invention, the date window 104*g* is formed in the 6 o'clock position of the dial 104. In the complete 350, in the left side portion within the date window 104*g* of the dial 104, there is disposed "3" among the 2nd date letters 362*h* of the 2nd date indicator 362 and, in a right side portion within the date window 104*g*, there are disposed the notch part 362*k* of the 2nd date indicator 362 and "1" among the 1st date letters 352*h*. Accordingly, the complete 350 is displaying "31st" day.

Figure 12:
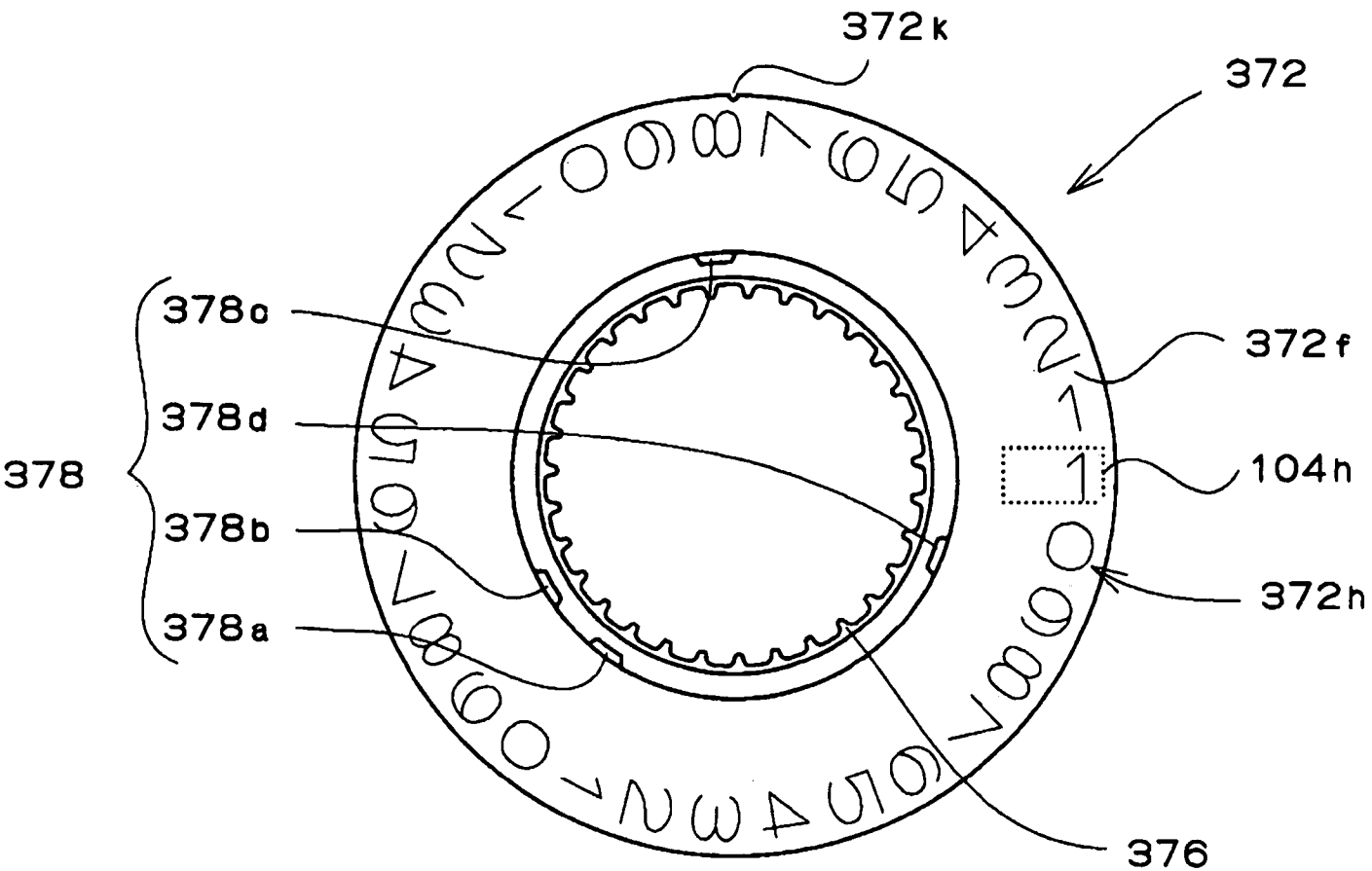
FIG. 12 is a plan view showing the 1st date indicator in a constitution in which the date window is disposed in a 3 o'clock direction of the dial in the 1st embodiment of the timepiece with the calendar mechanism of the present invention.

Referring to FIG. 12, in a case of a constitution in which a date window 104*h* is formed in a 3 o'clock position of the dial 104, a 1st date indicator 372 possesses a-ring-shaped 1st date letter display face 372*f*. The 1st date indicator 372 contains 31 1st date indicator teeth parts 376 formed as internal teeth, and 4 calendar shift teeth 378 formed as internal teeth. The 1st date indicator teeth parts 376 are formed with a spacing of equal angle, i.e., spacing of (360/31) degrees. The calendar shift teeth 378 comprise a 1st calendar shift tooth 378*a* becoming a reference, a 2nd calendar shift tooth 378*b* formed with a spacing of (360×2/31) degrees in the clockwise direction with the 1st calendar shift tooth 378*a* being made the reference, a 3rd calendar shift tooth 378*c* formed with a spacing of (360×10/31) degrees in the clockwise direction with the 2nd calendar shift tooth 378*b* being made a reference, and a 4th calendar shift tooth 378*d* formed with a spacing of (360×9/31) degrees in the counterclockwise direction with the 1st calendar shift tooth 378*a* being made the reference. 1st date letters 372*h* consisting of 31 numerals are provided in the 1st date letter display face 372*f*. The 1st date letters 372*h* contain 4 sets of numerals. That is, the 1st date letters contain numerals of "1" to "9" and "0" which constitute a 1st set of the 1st date letters, numerals of "1" to "9" and "0" which constitute a 2nd set of the 1st date letters, numerals of "1" to "9" and "0" which constitute a 3rd set of the 1st date letters, and numeral of "1" which constitutes a 4th set of the 1st date letters. The 31 numerals constituting the 1st date letters 372*h* are disposed in the 1st date letter display face 372*f* with the spacing of equal angle, i.e., spacing of (360/31) degrees. In a state shown in FIG. 12, among the 1st date letters 372*h*, "1" and "1" adjacently disposed are disposed in the date window 104*h* provided in the dial 104. A notch part 372*k* is formed in an outer periphery part of the 1st date letter display face 372*f* so as to correspond to a position of "8" existing in a position in the counterclockwise direction with respect to "1" and "1" adjacently disposed among the 1st date letters 372*h*.

Figure 13:
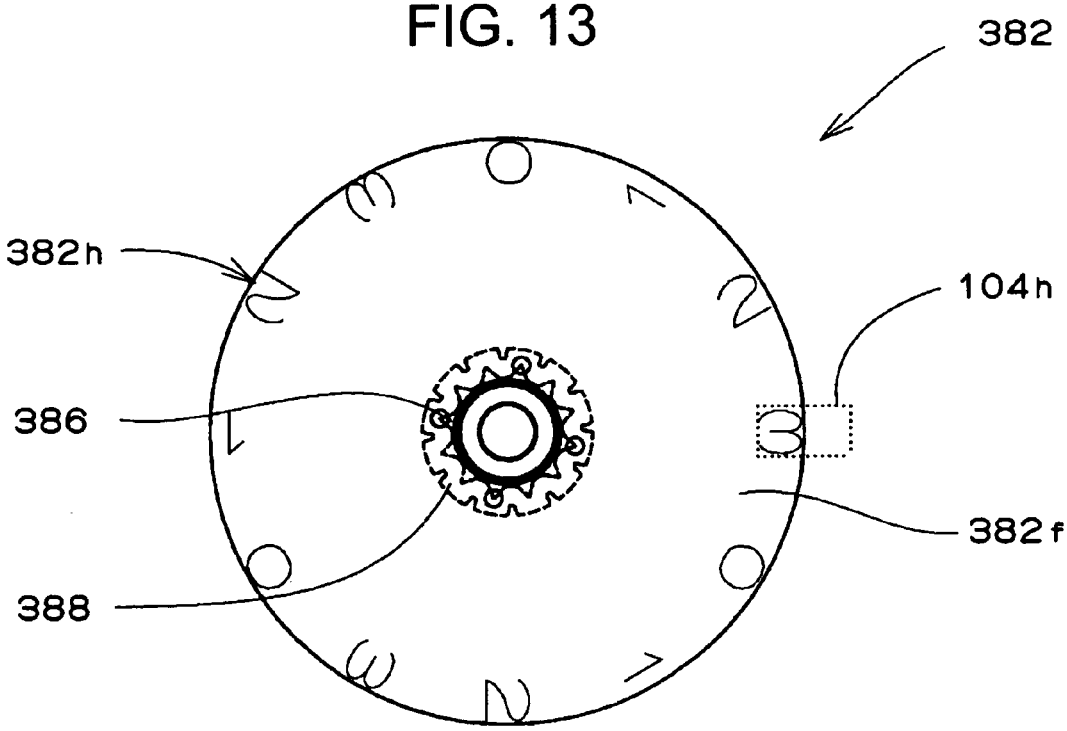
FIG. 13 is a plan view showing the 2nd date indicator in the constitution in which the date window is disposed in the 3 o' clock direction of the dial in the 1st embodiment of the timepiece with the calendar mechanism of the present invention.

Referring to FIG. 13, a 2nd date indicator 382 possesses a disc-shaped 2nd date letter display face 382*f*. It is constituted such that an outer diameter of the 2nd date letter display face 382*f* is smaller than a size of a region where the date letters of the 1st date letter display face 3.72*f* are disposed. The 2nd date indicator 382 contains 12 positioning teeth parts 386 formed as external teeth, and 12 unlocking teeth 388 formed as external teeth. The positioning teeth parts 386 are formed with the spacing of equal angle, e.g., spacing of (360/12) degrees. The unlocking teeth 388 are formed with the spacing of equal angle, e.g., spacing of (360/12) degrees. 2nd date letters 382*h* consisting of "1", "2", "3", "0" are provided in the 2nd date letter display face 382*f*. Numeral of "1" and numeral of "2" are disposed in the 2nd date letter display face 382*f* with a spacing of 30 degrees. Numeral of "2" and numeral of "3" are disposed in the 2nd date letter display face 382*f* with the spacing of 30 degrees. Numeral of "3" and numeral of "0" are disposed in the 2nd date letter display face with the spacing of 30 degrees. Accordingly, in the 2nd date letter display face 382*f*, there are disposed numeral of "1", numeral of "2", numeral of "3" and numeral of "0" so as to mutually form the spacing of 30 degrees. In the 2nd date letter display face 382*f*, there are provided sets of numerals consisting of numeral of "1", numeral of "2", numeral of "3" and numeral of "0" by 3 sets. Or, it is also possible to adopt the constitution in which, instead of providing numeral of "0", that position is made the "white paper" portion (i.e., blank portion in which no numeral is provided). Under the state shown in FIG. 13, among the 2nd date letters 382*h*, "3" is displayed in a left side portion of the date window 104*h* provided in the dial 104.

Figure 14:
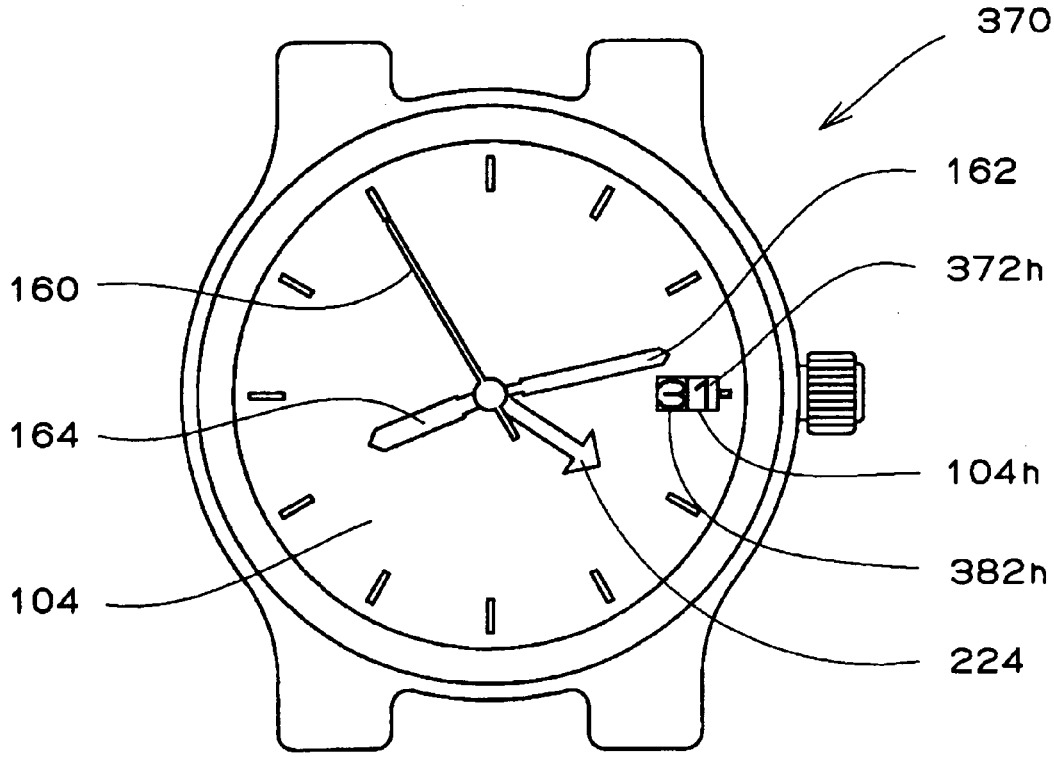
FIG. 14 is a plan view showing the complete in the constitution in which the date window is disposed in the 3 o'clock direction of the dial in the 1st embodiment of the timepiece with the calendar mechanism of the present invention.

Referring to FIG. 14, in a complete 370 of the timepiece with the calendar mechanism of the present invention, the date window 104*h* is formed in the 3 o'clock position of the dial 104. In the complete 370, in the left side portion within the date window 104*h* of the dial 104, there is disposed "3" among the 2nd date letters 382*h* of the 2nd date indicator 382 and, in a right side portion within the date window 104*h*, the 2nd date indicator 382 does not exist and there is disposed "1" among the 1st date letters 372*h*. Accordingly, the complete 370 is displaying "31st" day.

Figure 15:
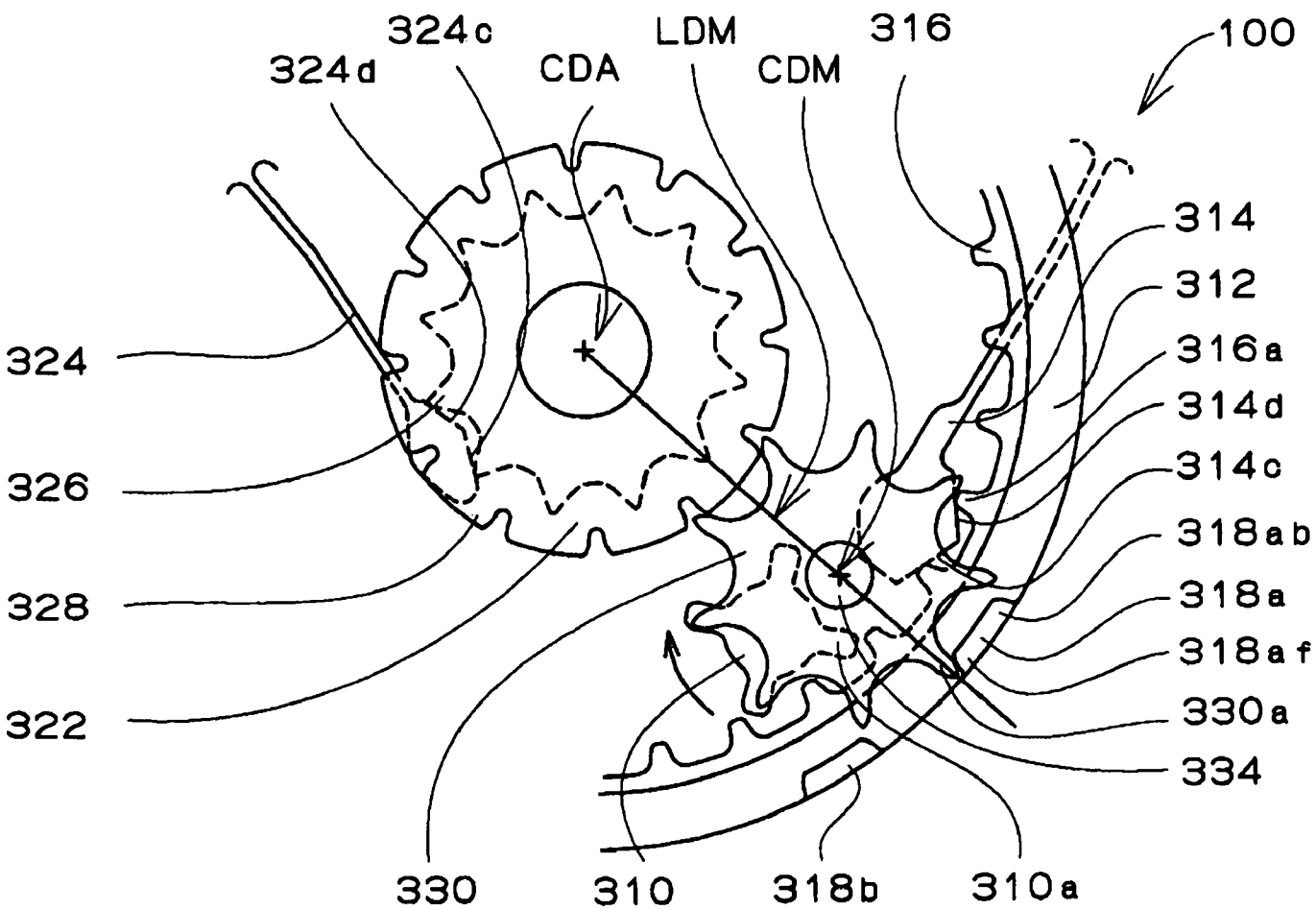
FIG. 15 is a partial plan view showing the structure of a back side of the movement seen from the dial side under a state that the 1st date indicator is attempted to be rotated in a positive direction in the 1st embodiment of the timepiece with the calendar mechanism of the present invention.

(1.7.2) State that 1st Date Indicator is Attempted to be Rotated in Positive Direction FIG. 15 is a partial plan view showing the structure of the back side of the movement 100 seen from the dial side under a state that the 1st date indicator 312 is attempted to be rotated in the positive direction (clockwise direction) in the timepiece with the calendar mechanism of the present invention. In FIG. 15, a rotation center of the 2nd date indicator 322 is defines as "CDA", a rotation center of a date intermediate wheel 330 is defines as "CMD", and a straight line passing through the "CDA" and the "CMD" is defined as "LDM". Setting parts 324*c*, 324*d* of the 2nd date jumper 324 set the positioning teeth parts 326. The date indicator driving wheel 310 contains 4 date indicator driving teeth 310*a*. By the fact that the date indicator driving wheel 310 rotates in the direction shown by the arrow, the date indicator driving teeth 310*a* unlock the 1st date indicator teeth parts 316, thereby rotating the 1st date indicator 312 in the clockwise direction by (360/31) degrees once in one day. The date intermediate wheel 330 contains 9 date intermediate teeth 330*a* formed as external teeth. When the date letter displayed from the date window by the 1st date indicator 312 changes from "9" to "0" (or, state of "white paper"), by the fact that the 1st date indicator 312 rotates by (360/31) degrees in the clockwise direction, the positive rotation unlocking part of the 2nd calendar shift tooth 318*b* or the 3rd calendar shift tooth 318*c* or the 4th calendar shift tooth 318*d* rotates the date intermediate teeth 330*a*, and the date intermediate teeth 330*a* rotate an unlocking tooth 328, thereby rotating the 2nd date indicator 322 by 30 degrees in the counterclockwise direction once in every 10 days. When the date letter displayed from the date window by the 2nd date indicator 322 changes from "3" to "0" (or, state of "white paper") and the date letter displayed from the date window by the 1st date indicator 312 changes from "1" to adjoining next "1", by the fact that the 1st date indicator 312 rotates by (360/31) degrees in the clockwise direction, the positive rotation unlocking part 318*af* of the 1st calendar shift tooth 318*a* rotates the date intermediate teeth 330*a*, and the date intermediate teeth 330*a* rotates the unlocking tooth 328, thereby rotating the 2nd date indicator 322 by 30 degrees in the counterclockwise direction once in every 31 days.

(1.7.3) State that 1st Date Indicator is Being Rotated in Positive Direction

Figure 16:
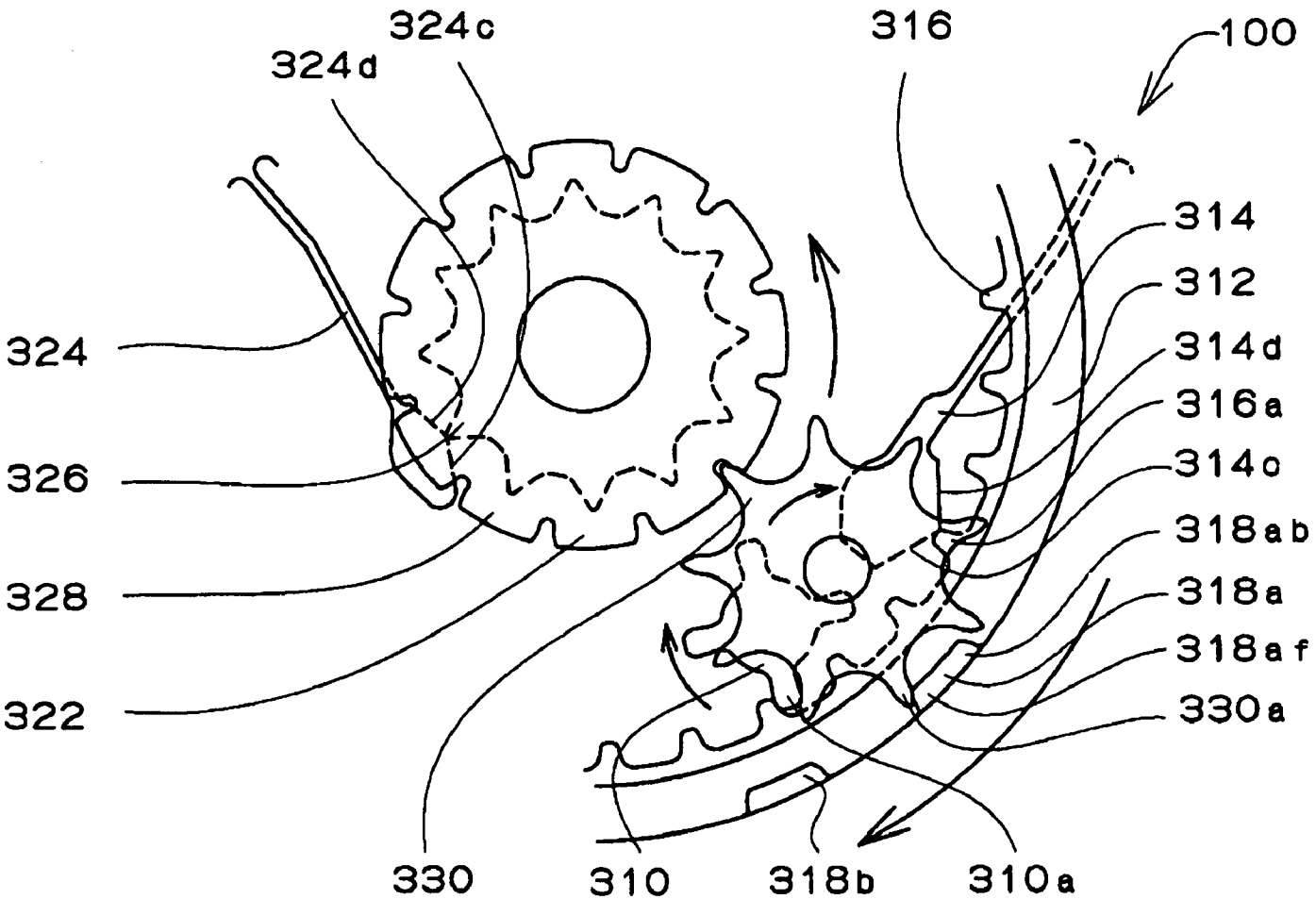
FIG. 16 is a partial plan view showing the structure of the back side of the movement seen from the dial side under a state that the 1st date indicator is rotating in the positive direction in the 1st embodiment of the timepiece with the calendar mechanism of the present invention.

FIG. 16 is a partial plan view showing the structure of the back side of the movement 100 seen from the dial side under a state that the 1st date indicator 312 rotates in the positive direction and a tip part of a tooth part 316*a* of the 1st date indicator 312 contacts with a tip part where the setting parts 314*c* and 314*d* of the 1st date jumper 314 intersect under a state that the 1st date indicator 312 is rotated in the positive direction in the timepiece with the calendar mechanism of the present invention. Referring to FIG. 16, when the display of the 1st date indicator 312 is "1" and the display of the 2nd date indicator 322 is "3", the date indicator driving wheel 310 rotates in the direction shown by the arrow, and the date indicator driving tooth 310*a* rotates the 1st date indicator 312 in the direction shown by the arrow. In a midway of this unlocking state of the 1st date indicator 312, it becomes the state that the tip part of the tooth part 316*a* of the 1st date indicator 312 contacts with the tip part where the setting parts 314*c* and 314*d* of the 1st date jumper 314 intersect. Further, by the fact that the 1st date indicator 312 rotates in the direction shown by the arrow, the positive rotation unlocking part 318*af* of the 1st calendar shift tooth 318*a* rotates the date intermediate tooth 330*a*, and the date intermediate tooth 330*a* rotates the unlocking tooth 328, thereby rotating the 2nd date indicator 322 in the counterclockwise direction in the direction shown by the arrow. In a midway of this unlocking state of the 2nd date indicator 322, it becomes a state that a tip part of a positioning tooth part 326*a* of the 2nd date indicator 322 contacts with a tip part where the setting parts 324*c* and 324*d* of the 2nd jumper 324 intersect.

Figure 17:
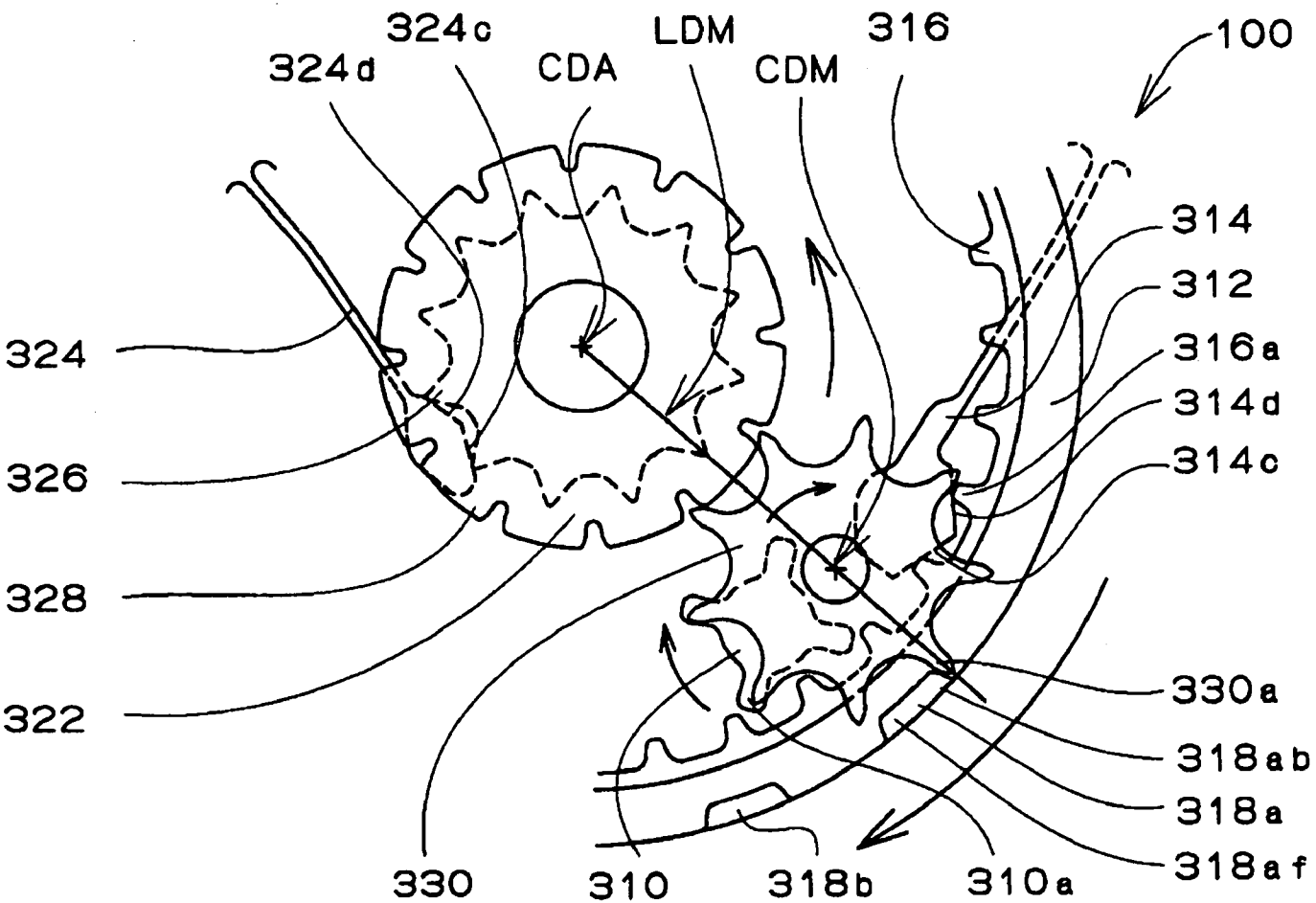
FIG. 17 is a partial plan view showing the structure of the back side of the movement seen from the dial side under a state that the 1st date indicator has rotated by one pitch in the positive direction in the 1st embodiment of the timepiece with the calendar mechanism of the present invention.

(1.7.4) State that 1st Date Indicator has Rotated by One Pitch in Positive Direction FIG. 17 is a partial plan view showing the structure of the back side of the movement seen from the dial side under a state that the 1st date indicator 312 has rotated by one pitch (for one tooth of the 1st date indicator, i.e., by (360/31) degrees) in the positive direction in the timepiece with the calendar mechanism of the present invention. Referring to FIG. 17, if the date indicator driving wheel 310 additionally rotates in the direction shown by the arrow from the state shown in FIG. 16 and the date indicator driving tooth 310*a* rotates the 1st date indicator 312 in the direction shown by the arrow, by an elastic force of the 1st date jumper 314, the 1st date indicator 312 is positioned in a position rotated by (360/31) degrees in the clockwise direction from the state shown in FIG. 15. Further, by an elastic force of the 2nd date jumper 324, the 2nd date indicator 322 is positioned in a position rotated by 30 degrees in the counterclockwise direction from the state shown in FIG. 15. As a result, the display of the 2nd date indicator 322 is changed from "3" to "0" (or, state of "white paper"), and the display of the 1st date indicator 312 is changed from "1" to adjoining next "1". That is, under the state shown in FIG. 17, in the date window of the dial of the timepiece with the calendar mechanism, there is displayed "1st day" in which the display of the 2nd date indicator 322 is "0" (or, state of "white paper") and the display of the 1st date indicator 312 is "1". The reverse rotation locking part 318*ab* of the date indicator driving tooth 310*a* and the date intermediate tooth 330*a* under the state shown in FIG. 17 are constituted in an axisymmetric relation whose reference line is made the "LDM" with respect to the positive rotation locking part 318*af* of the date indicator driving tooth 310*a* and the date intermediate tooth 330*a* under the state shown in FIG. 15. That is, a disposition of the 1st calendar shift tooth 318*a* under a state before the 1st date indicator 312 is unlocked in the clockwise direction (positive direction) and a disposition of the 1st calendar shift tooth 318*a* under a state that the 1st date indicator 312 has been finished to be rotated in the clockwise direction (positive direction) are constituted in the axisymmetric relation whose reference line is made the "LDM".

Figure 18:
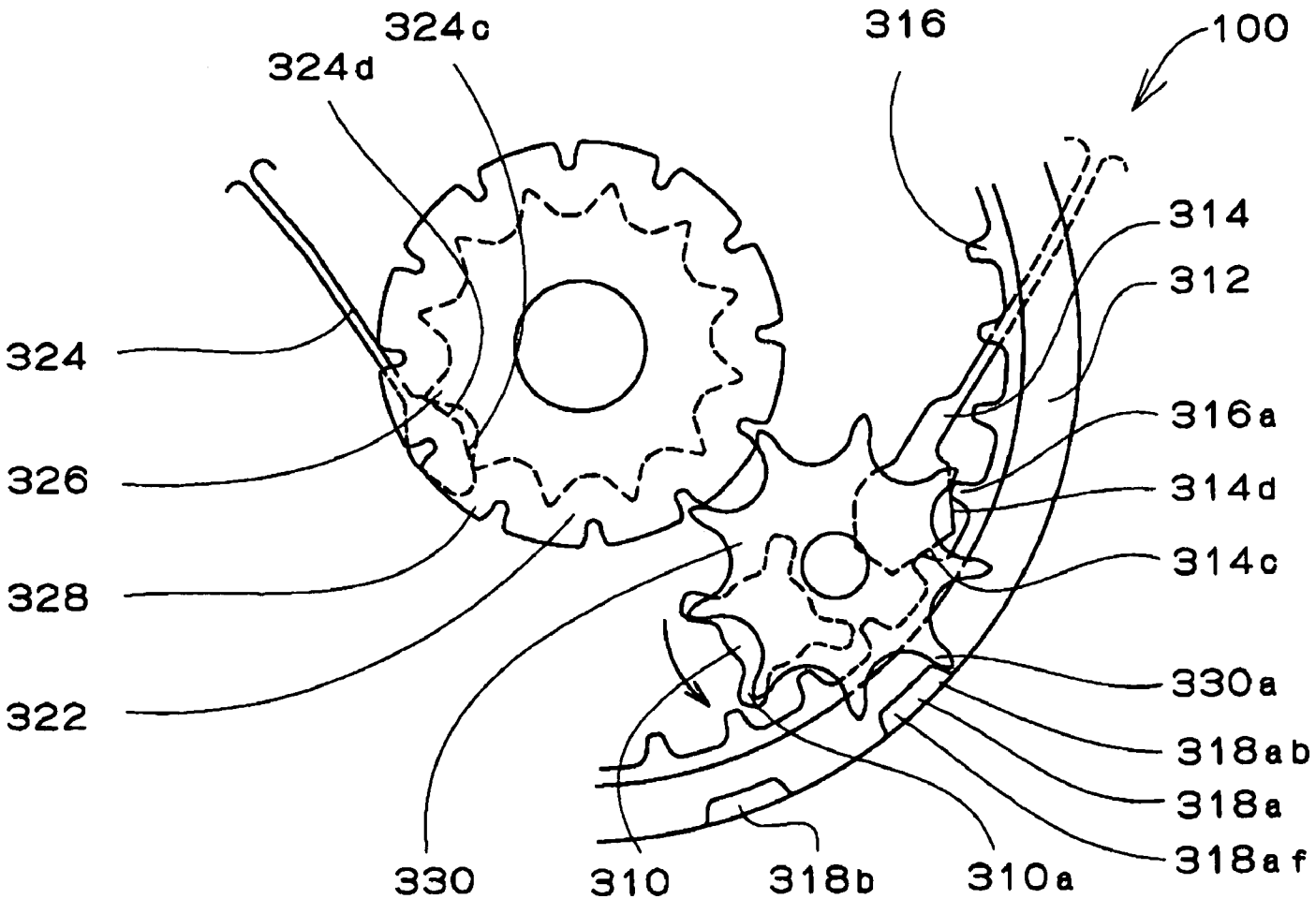
FIG. 18 is a partial plan view showing the structure of the back side of the movement seen from the dial side under a state that the 1st date indicator is attempted to be rotated in a reverse direction in the 1st embodiment of the timepiece with the calendar mechanism of the present invention.

(1.7.5) State that 1st Date Indicator is Attempted to be Rotated in Reverse Direction FIG. 18 is a partial plan view showing the structure of the back side of the movement 100 seen from the dial side under a state that the 1st date indicator 312 is attempted to be rotated in a reverse direction (counterclockwise direction) in the timepiece with the calendar mechanism of the present invention. Referring to FIG. 18, the setting parts 324*c*, 324*d* of the 2nd date jumper 324 set the positioning teeth parts 326. By the fact that the date indicator driving wheel 310 rotates in the direction (counterclockwise direction) shown by the arrow, the date indicator driving tooth 310*a* unlocks the 1st date indicator teeth parts 316, thereby rotating the 1st date indicator 312 by (360/31) degrees in the clockwise direction. When the date letter displayed from the date window by the 1st date indicator 312 changes from "0" (or, state of "white paper") to "9", by the fact that the 1st date indicator 312 rotates by (360/31) degrees in the counterclockwise direction, the reverse rotation unlocking part of the 2nd calendar shift tooth 318*b* or the 3rd calendar shift tooth 318*c* or the 4th calendar shift tooth 318*d* rotates the date intermediate tooth 330*a*, and the date intermediate tooth 330*a* rotates the unlocking tooth 328, thereby rotating the 2nd date indicator 322 by 30 degrees in the clockwise direction. When the date letter displayed from the date window by 2nd date indicator 322 returns from "0" (or, state of "white paper") to "3" and the date letter displayed from the date window by the 1st date indicator 312 returns from "1" to adjoining next "1", by the fact that the 1st date indicator 312 rotates by (360/31) degrees in the counterclockwise direction, the reverse rotation unlocking part 318*ab* of the 1st calendar unlocking tooth 318*a* rotates the date intermediate tooth 330*a*, and the date intermediate tooth 330*a* rotates the unlocking tooth 328, thereby rotating the 2nd date indicator 322 by 30 degrees in the clockwise direction.

(1.7.6) State that 1st Date Indicator is Being Rotated in Reverse Direction

Figure 19:
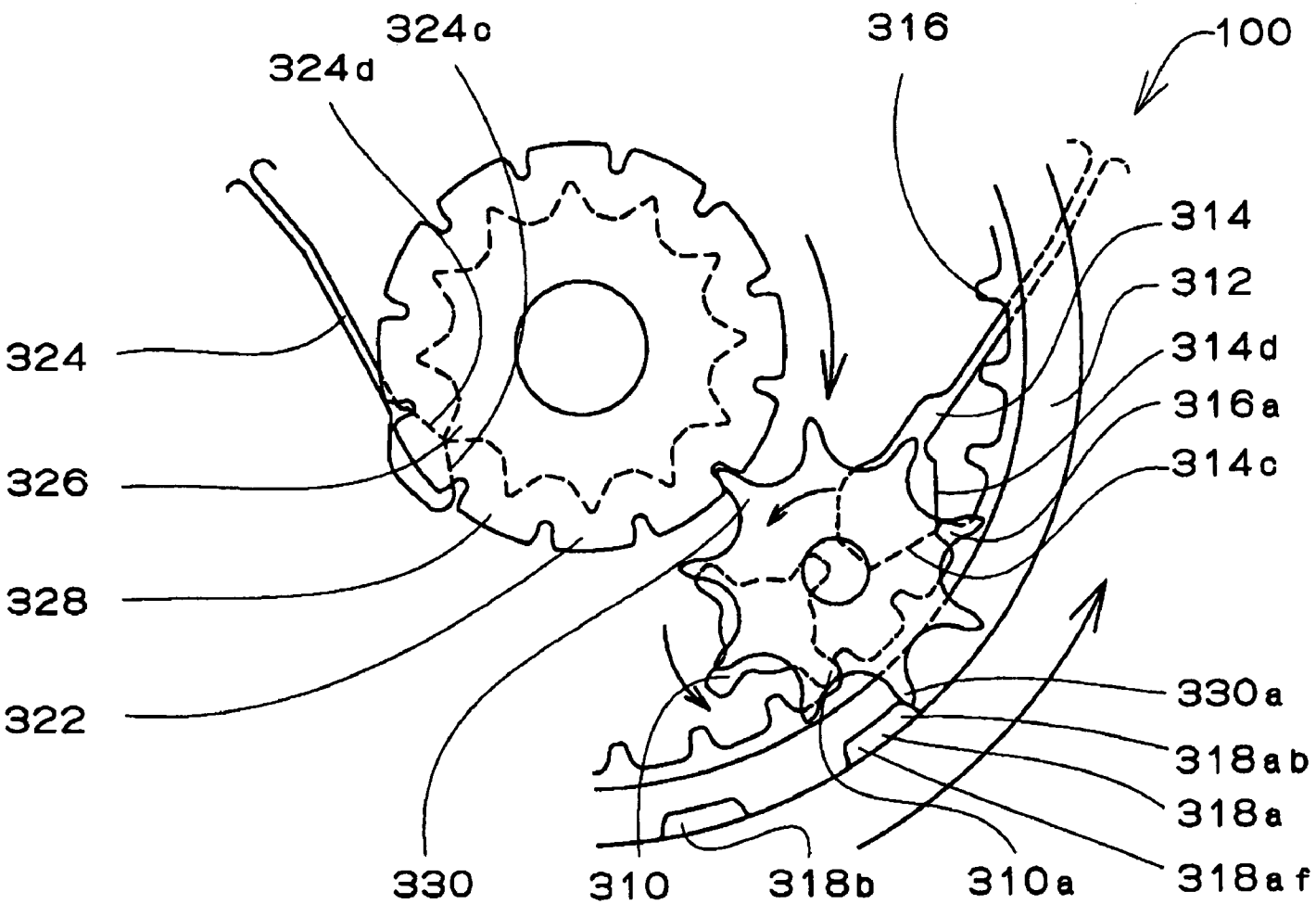
FIG. 19 is a partial plan view showing the structure of the back side of the movement seen from the dial side under a state that the 1st date indicator is rotating in the reverse direction in the 1st embodiment of the timepiece with the calendar mechanism of the present invention.

FIG. 19 is a partial plan view showing the structure of the back side of the movement 100 seen from the dial side under a state that, the 1st date calendar 312 rotates in a reverse direction under a state that the 1st date indicator 312 is being rotated in the reverse direction, the tip part of the tooth part 316*a* of the 1st date indicator 312 contacts with the tip part where the setting parts 314*c* and 314*d* of the 1st jumper 314 intersect in the timepiece with the calendar mechanism of the present invention. Referring to FIG. 19, when the display of the 1st date indicator 312 is "1" and the display of the 2nd date indicator 322 is "0" (or state of "white paper"), the date indicator driving wheel 310 rotates in the direction shown by the arrow, and the date indicator driving tooth 310*a* rotates the 1st date indicator 312 in the direction shown by the arrow. In a midway of this unlocking state of the 1st date indicator 312, it becomes the state that the tip part of the tooth part 316*a* of the 1st date indicator 312 contacts with the tip part where the setting parts 314*c* and 314*d* of the 1st jumper 314 intersect. Further, by the fact that the 1st date indicator 312 rotates in the direction shown by the arrow, the reverse rotation unlocking part 318*ab* of the 1st calendar shift tooth 318*a* rotates the date intermediate tooth 330*a*, and the date intermediate tooth 330*a* rotates the unlocking tooth 328, thereby rotating the 2nd date indicator 322 in the clockwise direction in the direction shown by the arrow. In a midway of this unlocking state of the 2nd date indicator 322, it becomes a state that the tip part of the positioning tooth part 326*a* of the 2nd date indicator 322 contacts with the tip part where the setting parts 324*c* and 324*d* of the 2nd jumper 324 intersect.

Figure 20:
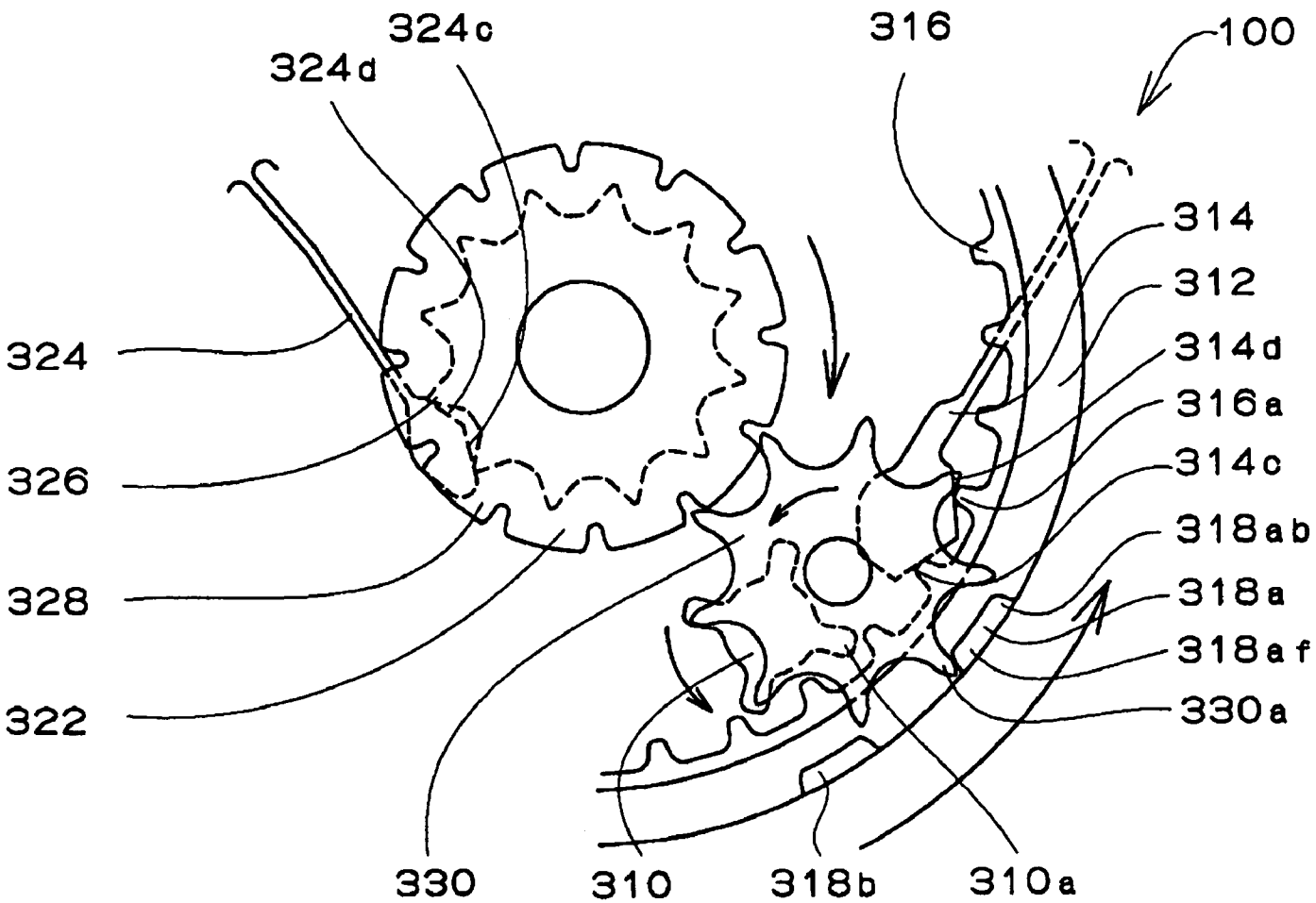
FIG. 20 is a partial plan view showing the structure of the back side of the movement seen from the dial side under a state that the 1st date indicator has rotated by one pitch in the reverse direction in the 1st embodiment of the timepiece with the calendar mechanism of the present invention.

(1.7.7) State that 1st Date Indicator has Rotated by one Pitch in Reverse Direction FIG. 20 is a partial plan view showing the structure of the back side of the movement seen from the dial side under a state that the 1st date indicator 312 has rotated by one pitch (for one tooth of the 1st date indicator, i.e., by (360/31) degrees) in the reverse direction in the timepiece with the calendar mechanism of the present invention. Referring to FIG. 20, if the date indicator driving wheel 310 additionally rotates in the direction shown by the arrow from the state shown in FIG. 19 and the date indicator driving tooth 310*a* rotates the 1st date indicator 312 in the direction shown by the arrow, by an elastic force of the 1st date jumper 314, the 1st date indicator 312 is positioned in a position rotated by (360/31) degrees in the counterclockwise direction from the state shown in FIG. 18. Further, by an elastic force of the 2nd date jumper 324, the 2nd date indicator 322 is positioned in a position rotated by 30 degrees in the counterclockwise direction from the state shown in FIG. 18. As a result, the display of the 2nd date indicator 322 returns from "0" (or, state of "white paper") to "3" and the display of the 1st date indicator 312 returns from "1" to adjoining next "1". That is, under a state shown in FIG. 20, in the date widow of the dial of the timepiece with the calendar mechanism, there is displayed "31st day" in which the display of the 2nd date indicator 322 is "3" and the display of the 1st date indicator 312 is "1". The positive rotation unlocking part 318*af* of the 1st calendar unlocking tooth 318*a* and the date intermediate tooth 330*a* under the state shown in FIG. 20 are constituted in the axisymmetric relation whose reference line is made the "LDM" with respect to the reverse rotation unlocking part 318*ab* of the 1st calendar unlocking tooth 318*a* and the date intermediate tooth 330*a* under the state shown in FIG. 18. That is, a disposition of the 1st calendar shift tooth 318*a* under a state before the 1st date indicator 312 is unlocked in the counterclockwise direction (reverse direction) and a disposition of the 1st calendar shift tooth 318*a* under a state that the 1st date indicator 312 has been finished to be rotated in the counterclockwise direction (reverse direction) are constituted in the axisymmetric relation whose reference line is made the "LDM". By this constitution, in the timepiece with the calendar mechanism of the present invention, it is also possible to surely correct the date display by rotating the 1st date indicator 312 and the 2nd date indicator 322 in the positive direction and, further, it is also possible to surely correct the date display by rotating the 1st date indicator 312 and the 2nd date indicator 322 in the reverse direction.

(1.8) Constitution of Ultrasonic Motor Drive Part

Figure 22:
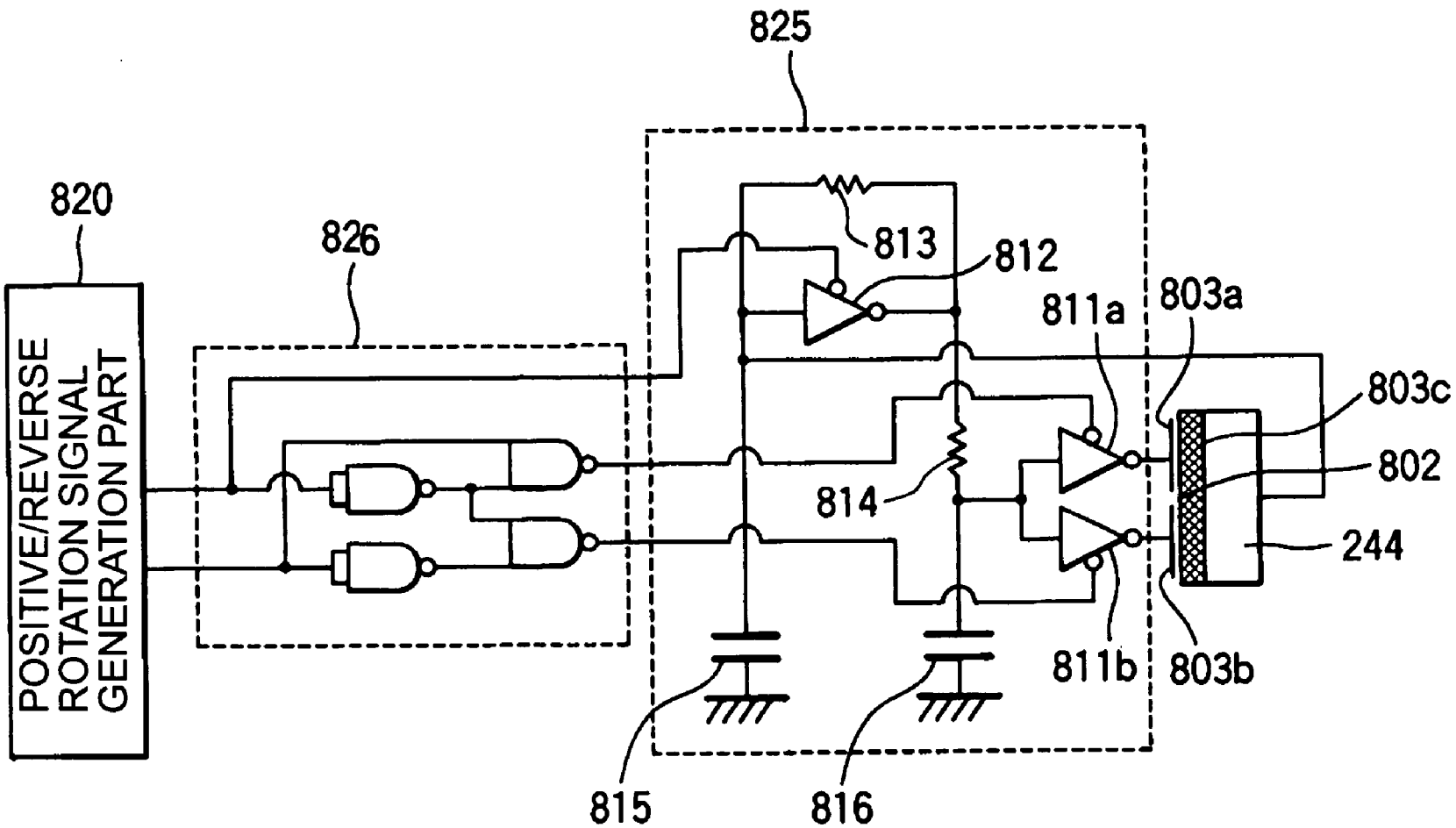
FIG. 22 is a block diagram showing a drive circuit of the ultrasonic motor in the 1st embodiment of the timepiece with the calendar mechanism of the present invention.

Hereunder, it is explained about a constitution of an ultrasonic motor drive part. Referring to FIG. 4 and FIG. 22 -FIG. 25, the frequency-dividing control part 704 is constitutes so as to count information relating to the time and the date, thereby outputting a date signal. An ultrasonic motor drive part 738 is constituted so as to output, on the basis of the date signal that the frequency-dividing control part 704 outputs, an ultrasonic motor drive signal for driving the ultrasonic motor 240. Referring to FIG. 22, a piezoelectric element 802 in which 2 sets of electrode groups 803*a*, 803*b* comprising plural electrodes have been formed is bonded to one face of an ultrasonic stator 244 constituting a vibration body of the ultrasonic motor 240. An oscillation drive part 825 is connected to the electrode groups 803*a*, 803*b* of the piezoelectric element 802. An inverter 812 performs a role of an inversion electric power amplifier for inversion-amplifying an electric signal that is an excitation information, by one face in which the electrode groups 803*a*, 803*b* of the piezoelectric element 802 have been formed and an electrode 803*c* formed in the other face or the ultrasonic stator 244. A resistance 813 is connected to the inverter 812 in parallel and stabilizes an operation point of the inverter 812.

An output terminal of the inverter 812 is connected to input terminals of 2 sets of buffers 811*a*, 811*b* through a resistance 814. Each of output terminals of the 2 buffers 811*a*, 811*b* is connected respectively to the electrode groups 803*a*, 803*b* of the piezoelectric element 802. A capacitor 815 is connected in its one end to an input terminal of the inverter 812, and a capacitor 816 is connected in its one end to the output terminal of the inverter 812 through the resistance 814. The capacitors 815, 816 are grounded in their the other ends, thereby performing a phase adjustment within an oscillation drive part 825. Each of the inverter 812 and the buffers 811*a*, 811*b* respectively has also a control terminal together with the input terminal and the output terminal, and is an inverter and buffer of a try state constitution capable of making the output terminal into a high impedance state in dependence on a signal inputted to this control terminal.

A positive/reverse rotation signal generation part 820 outputs a positive/reverse rotation signal for setting a rotation direction of the ultrasonic rotor 242 to a switching circuit part 826. Output terminals of the switching circuit part 826 are connected respectively to the control terminals of the try state buffers 811*a*, 811*b* and the try state inverter 812 and, on the basis of an output signal that the positive/reverse rotation signal generation part 820 outputs, cause one of the try state buffers 811*a*, 811*b* to function as a usual buffer and make the output terminal of the other of the buffers disable by making it into the high impedance state. The ultrasonic stator 244 is driven by the try state buffer functioning as the usual buffer selected by an output signal of the switching circuit part 826. The ultrasonic stator 244 is driven only by the try state buffer allowed to function as the usual buffer by the switching circuit part 826 and, if the try state buffer allowed to function as the usual buffer by the switching circuit part 826 is exchanges, the rotation direction of the ultrasonic rotor 242 is reversed.

Figure 23:
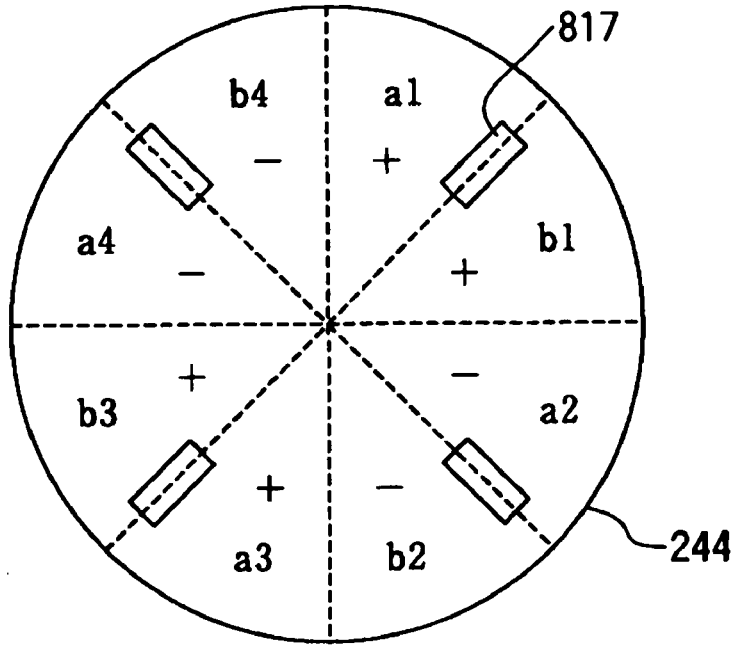
FIG. 23 is a plan view showing an ultrasonic stator of the ultrasonic motor in the 1st embodiment of the timepiece with the calendar mechanism of the present invention.
Figure 24:
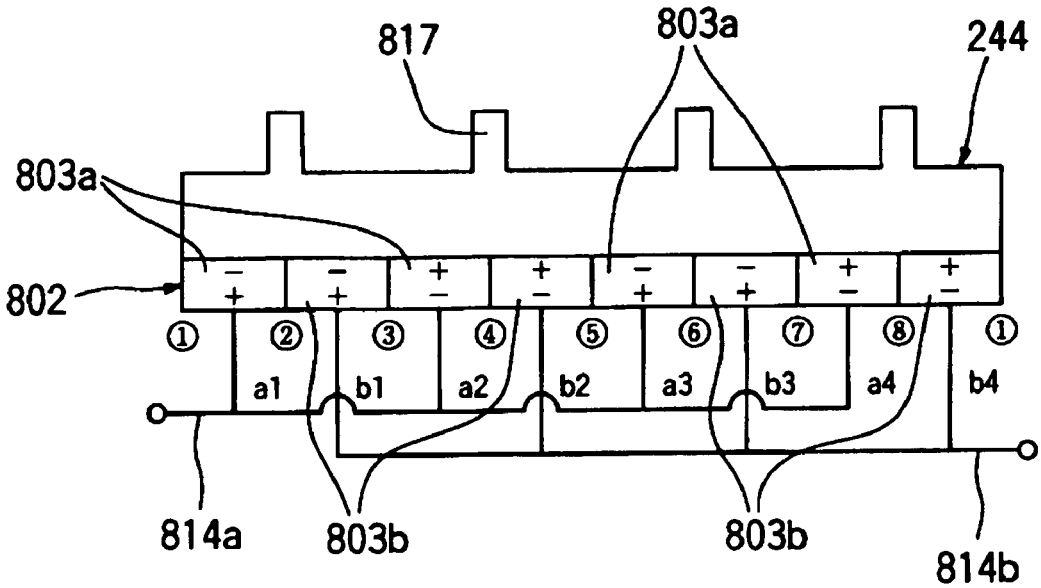
FIG. 24 is a sectional view showing the ultrasonic stator of the ultrasonic motor in the 1st embodiment of the timepiece with the calendar mechanism of the present invention.

By the output signal from the switching circuit part 826, which is outputted on the basis of the output from the positive/reverse rotation signal generation part 820, the try state inverter can make the output terminal into the high impedance state and, when the try state inverter becomes disable, both the try state buffers 811*a*, 811*b* become disable, so that it is possible to stop a rotation of the ultrasonic rotor 242. Referring to FIG. 23 and FIG. 24, the disc-shaped piezoelectric element 802 is jointed to a plane of the disc-shaped ultrasonic stator 244 by an adhesion or a thin film forming method and the like. It is constituted such that, by the ultrasonic motor drive signal that the ultrasonic motor drive part 738 outputs, a standing wave of 2 wavelengths is excited in a circumferential direction of the ultrasonic stator 244, thereby being capable of rotation-driving the ultrasonic rotor 242. The piezoelectric element 802 is formed such that, in its one plane, electrodes divided into 8 pieces in its circumferential direction, each of which is 4 times with respect to a wave number, are provided on every other one so as to become the 1st electrode group 803*a* and the 2nd electrode group 803*b*, and a polarization treatment (+) and (−) is applied thereto as shown in FIG. 23 and FIG. 24.

The 1st electrode group 803*a* is constituted by electrodes a1, a2, a3, a4, and each electrode is short circuited by a 1st connection means 814*a*. The 2nd electrode group 803*b* is constituted by electrodes b1, b2, b3, b4, and each electrode is short circuited by a 2nd connection means 814*b*. (+) and (−) in FIG. 23 and FIG. 24 denote directions of the polarization treatment, and are ones polarization-treated by applying respectively a positive electric field and a negative electric field to a joint face side, of the piezoelectric element 802, with the ultrasonic stator 244. Protrusions (comb teeth) 817 for enlarging a displacement of the ultrasonic stator 244 to thereby transmit a driving force from the ultrasonic stator 244 to the ultrasonic rotor 242 are provided on a surface of the ultrasonic stator 244 on every other one in a boundary vicinity of each electrode. The ultrasonic stator 244 is driven by applying a high frequency voltage that the oscillation drive part 825 generates to either of the electrode group 803*a* or 803*b*. A rotation direction of the ultrasonic rotor 242 is switched in dependence on by which electrode group the ultrasonic stator 244 is driven. In the case where the integrated circuit (IC) 754 is constituted by the C-MOS, the ultrasonic motor drive part 738, the positive/reverse rotation signal generation part 820, the oscillation drive part 825 and the switching circuit part 826 are built in the integrated circuit. In the case where the integrated circuit (IC) 754 is constituted by the PLA, it is constituted such that the ultrasonic motor drive part 738, the positive/reverse rotation signal generation part 820, the oscillation drive part 825 and the switching circuit part 826 are operated by the program stored in the PLA.

It is desirable that the ultrasonic motor used in the timepiece with the calendar mechanism of the present invention is driven by the above constitution of the ultrasonic motor drive part, the piezoelectric element and the ultrasonic stator, but it can be driven also by other constitution. If the frequency-dividing control part 704 outputs 0 o'clock a.m. in its count result, it outputs an ultrasonic motor control signal to the ultrasonic motor drive part 738. It is constituted such that thereupon the ultrasonic motor drive part 738 outputs an ultrasonic motor drive signal for rotating the 1st date indicator 312 by (360/31) degrees once in one day to the ultrasonic motor 240. The frequency-dividing control part 704 counts "year", "month", "day" and time. If a count result of the frequency-dividing control part 704 outputs 0 o'clock a.m. of a usual day, the ultrasonic motor control signal corresponding to the usual day is outputted to the ultrasonic motor drive part 738. It is constituted such that thereupon the ultrasonic motor drive part 738 outputs the ultrasonic motor drive signal for rotating the 1st date indicator 312 by (360/31) degrees once in one day to the ultrasonic motor 240.

Further, if the count result of the frequency-dividing control part 704 outputs 0 o'clock a.m. of March 1 in a year which is not a leap year, e.g., Mar. 1, 1997, the frequency-dividing control part 704 outputs the ultrasonic motor control signal corresponding to March 1 to the ultrasonic motor drive part 738. It is constituted such that thereupon the ultrasonic motor drive part 738 outputs the ultrasonic motor drive signal for rotating the 1st date indicator 312 by (360/31)×4 degrees to the ultrasonic motor 240. Accordingly, an information relating to the place of units of "day" that the 1st date indicator 312 displays changes from a display of "8" corresponding to February 28 to a display of "1" corresponding to March 1 without displaying ""9" of the place of units in the display of 29th day", ""0" of the place of units in the display of 30th day" and ""1" of the place of units in the display of 31st day". Further, if the count result of the frequency-dividing control part 704 outputs 0 o'clock a.m. of March 1 in the leap year, e.g., Mar. 1, 2000, the frequency-dividing control part 704 outputs the ultrasonic motor control signal corresponding to March 1 in the leap year to the ultrasonic motor drive part 738. It is constituted such that thereupon the ultrasonic motor drive part 738 outputs the ultrasonic motor drive signal for rotating the 1st date indicator 312 by (360/31)×3 degrees. Accordingly, the information relating to the place of units of "day" that the 1st date indicator 312 displays changes from a display of "9" corresponding to February 29 to the display of "1" corresponding to March 1 without displaying ""0" of the place of units in the display of 30th day" and ""1" of the place of units in the display of 31st day".

Similarly, if the count result of the frequency-dividing control part 704 outputs 0 o'clock a.m. of a day at the end of "month with thirty or less days", that is, 1st day coming next to "30th day", e.g., May 1, the frequency-dividing control part 704 outputs the ultrasonic motor control signal corresponding to May 1 to the ultrasonic motor drive part 738. It is constituted such that thereupon the ultrasonic motor drive part 738 outputs the ultrasonic motor drive signal for rotating the 1st date indicator 312 by (360/31) degrees×2. Accordingly, the information relating to the place of units of "day" that the 1st date indicator 312 displays changes from a display of "0" corresponding to April 30 to the display of "1" corresponding to May 1. As explained above, the timepiece with the calendar mechanism of the present invention can constitute a so-called "auto-calendar timepiece" or "perpetual calendar timepiece".

(1.9) Constitution of Rotation Detection Part

Hereunder, it is explained about a constitution of a rotation detection part. Referring to FIG. 3, FIG. 4 and FIG. 25, in the movement 100, a 24-hour signal detection part 740 is provided in order to detect a rotation of the 24-hour contact wheel 210. By the rotation of the 24-hour contact wheel 210, if the 24-hour contact spring 212 contacts with the 24-hour contact pattern 712*c* by once in one day, a 24-hour detection signal is outputted to the 24-hour signal detection part 740. The 24-hour signal detection part 740 outputs a result that has detected the rotation of the 24-hour contact wheel 210 to the ultrasonic motor drive part 738. The ultrasonic motor drive part 738 stores an information relating to the present time on the basis of a rotation detection result of the date indicator driving wheel 310. Additionally, a date indicator driving wheel rotation signal detection part 742 is provided in order to detect a rotation of the date indicator driving wheel 310. By the rotation of the date indicator driving wheel 310, if the date indicator driving wheel contact spring 320 contacts with the date indicator driving wheel contact pattern 712*d* by once in one day, a date indicator driving wheel detection signal is outputted to the date indicator driving wheel rotation signal detection part 742. The date indicator driving wheel rotation signal detection part 742 outputs a result that has detected the rotation of the date indicator driving wheel 310 to the ultrasonic motor drive part 738. The ultrasonic motor drive part 738 stores an information relating to the present day on the basis of the rotation detection result of the date indicator driving wheel 310. In the case where the integrated circuit (IC) 754 is constituted by the C-MOS, the 24-hour signal detection part 740 and the date indicator driving wheel rotation signal detection part 742 are built in the integrated circuit 754. In the case where the integrated circuit (IC) is constituted by the PLA, it is constituted such that the 24-hour signal detection part 740 and the date indicator driving wheel rotation signal detection part 742 are operated by the program stored in the PLA. Additionally, in the timepiece with the calendar of the present invention, in compliance with a necessity, it is possible to use externally attached elements such as resistance, capacitor, coil and diode.

(1.10) Constitution of Hour Difference Corrector Train Wheel Mechanism

Figure 26:
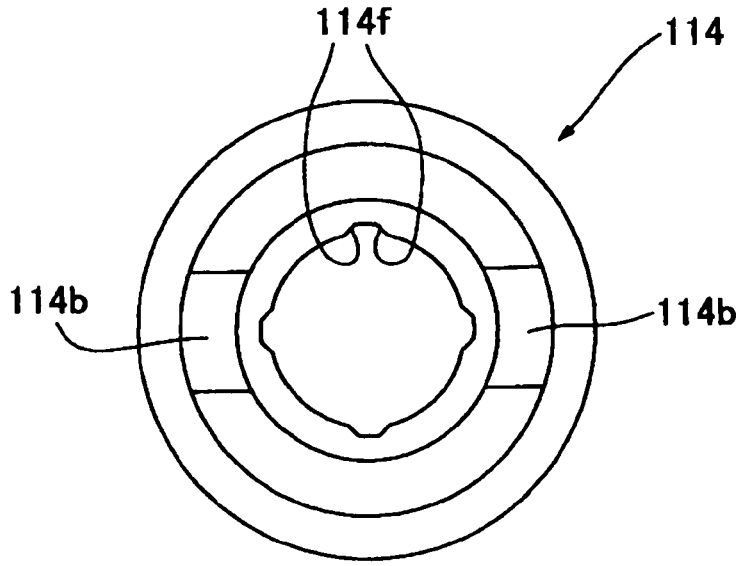
FIG. 26 is a plan view showing a clutch wheel used in an hour difference corrector mechanism in the 1st embodiment of the timepiece with the calendar mechanism of the present invention.
Figure 27:
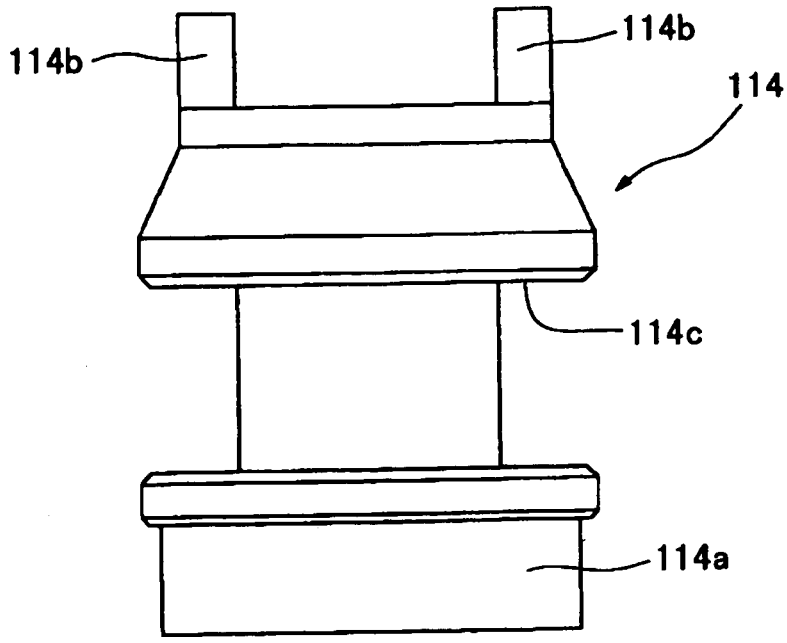
FIG. 27 is a front view showing the clutch wheel used in the hour difference corrector mechanism in the 1st embodiment of the timepiece with the calendar mechanism of the present invention.

Hereunder, it is explained about a constitution of an hour difference corrector train wheel mechanism. Referring to FIG. 3 and FIG. 26-FIG. 34, in the movement 100, an hour difference corrector train wheel of the timepiece with the calendar of the present invention contains the clutch wheel 114 which rotates with the rotation axis of the winding stem 110 being made its rotation center, a 1st hour difference corrector wheel 132 which rotates with the rotation axis of the winding stem 110 being made its rotation center, a 2nd hour difference corrector wheel 134 which rotates on the basis of a rotation of the 1st hour difference corrector wheel 132, and a 3rd hour difference corrector wheel 136 which rotates on the basis of a rotation of the 2nd hour difference corrector wheel 134. The 1st hour difference corrector wheel 132 is incorporated into the winding stem 110 so as to rotate with the rotation axis of the winding stem 110 being made its rotation center. The 2nd hour difference corrector wheel 134 is incorporated into the dial side of the calendar platform 304 so as to be rotatable to the calendar platform 304. The 3rd hour difference corrector wheel 136 is incorporated into the dial side of the calendar platform 304 so as to be rotatable to the calendar platform 304. One portion of the 2nd hour difference corrector wheel 134 is disposed between the calendar platform 304 and the main plate 102. The other one portion of the 2nd hour difference corrector wheel 134 is disposed between the date indicator maintaining plate 302 and the main plate 102. The 3rd hour difference corrector wheel 136 is disposed between the date indicator maintaining plate 302 and the calendar platform 30.4. Referring to FIG. 26 and FIG. 27, the clutch wheel 114 has the A tooth 114*a* and the B tooth 114*b*.

Figure 28:
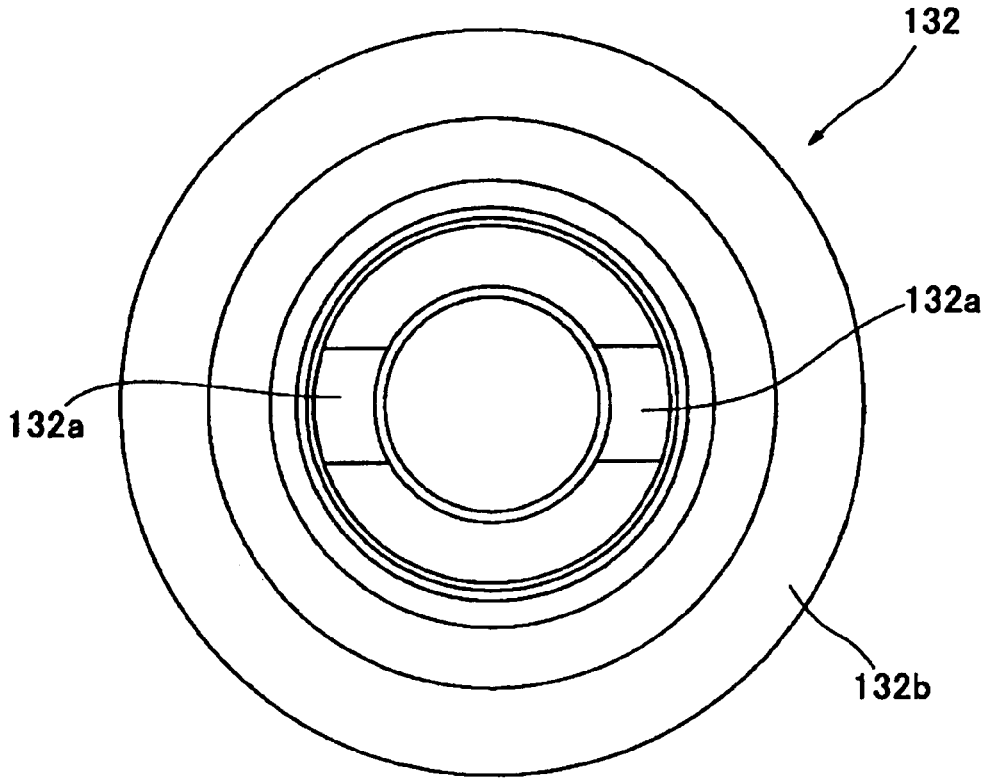
FIG. 28 is a plan view showing a 1st hour difference corrector wheel used in the hour difference collector mechanism in the 1st embodiment of the timepiece with the calendar mechanism of the present invention.
Figure 29:
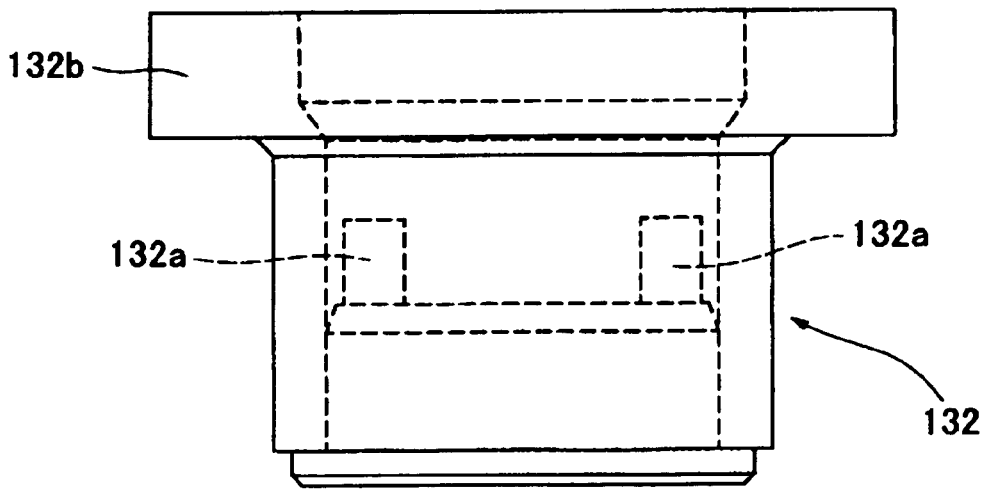
FIG. 29 is a front view showing the 1st hour difference corrector wheel used in the hour difference corrector mechanism in the 1st embodiment of the timepiece with the calendar mechanism of the present invention.
Figure 30:
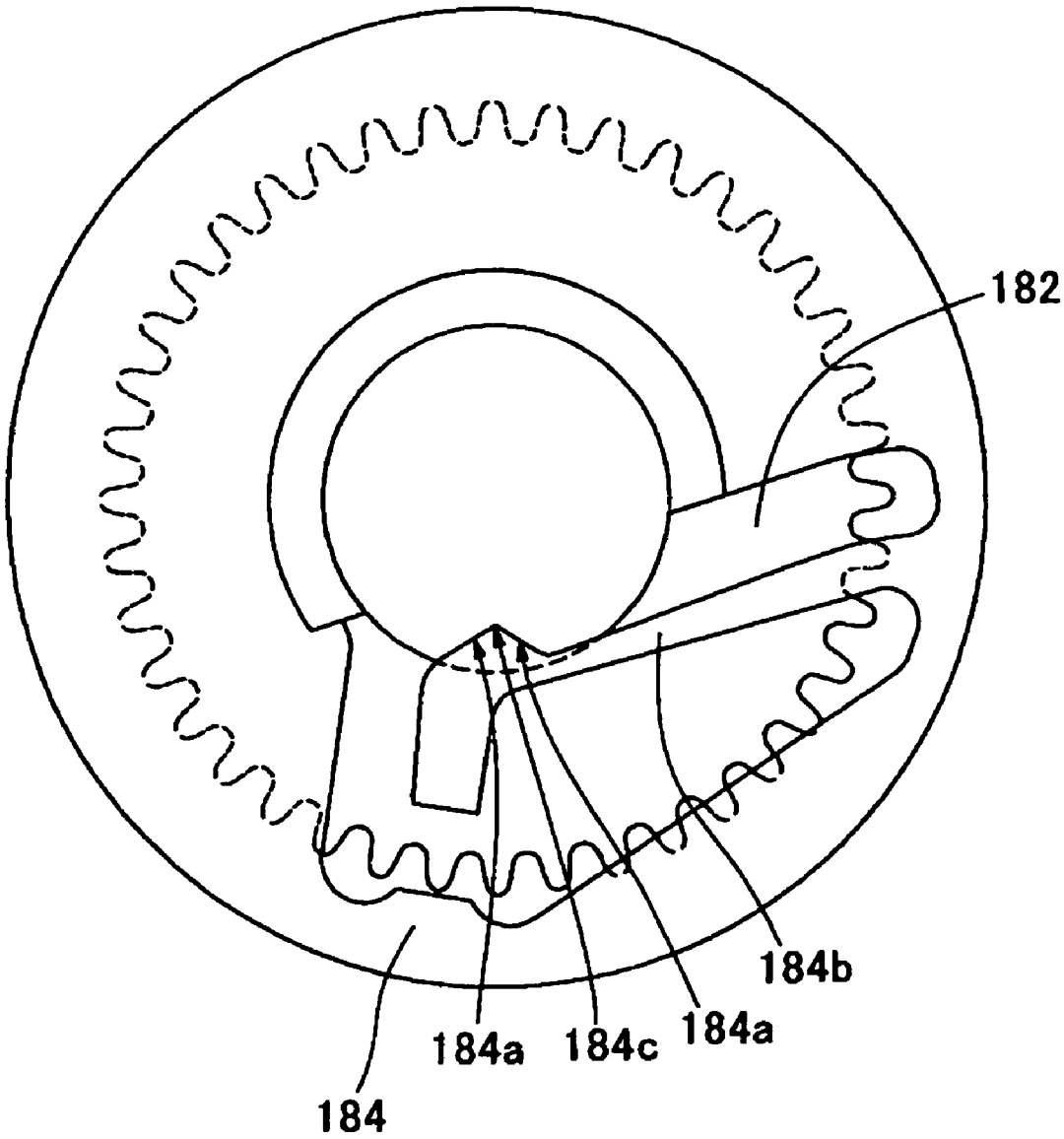
FIG. 30 is a plan view showing an hour gear wheel with an hour jumper used in the hour difference corrector mechanism in the 1st embodiment of the timepiece with the calendar mechanism of the present invention.
Figure 31:
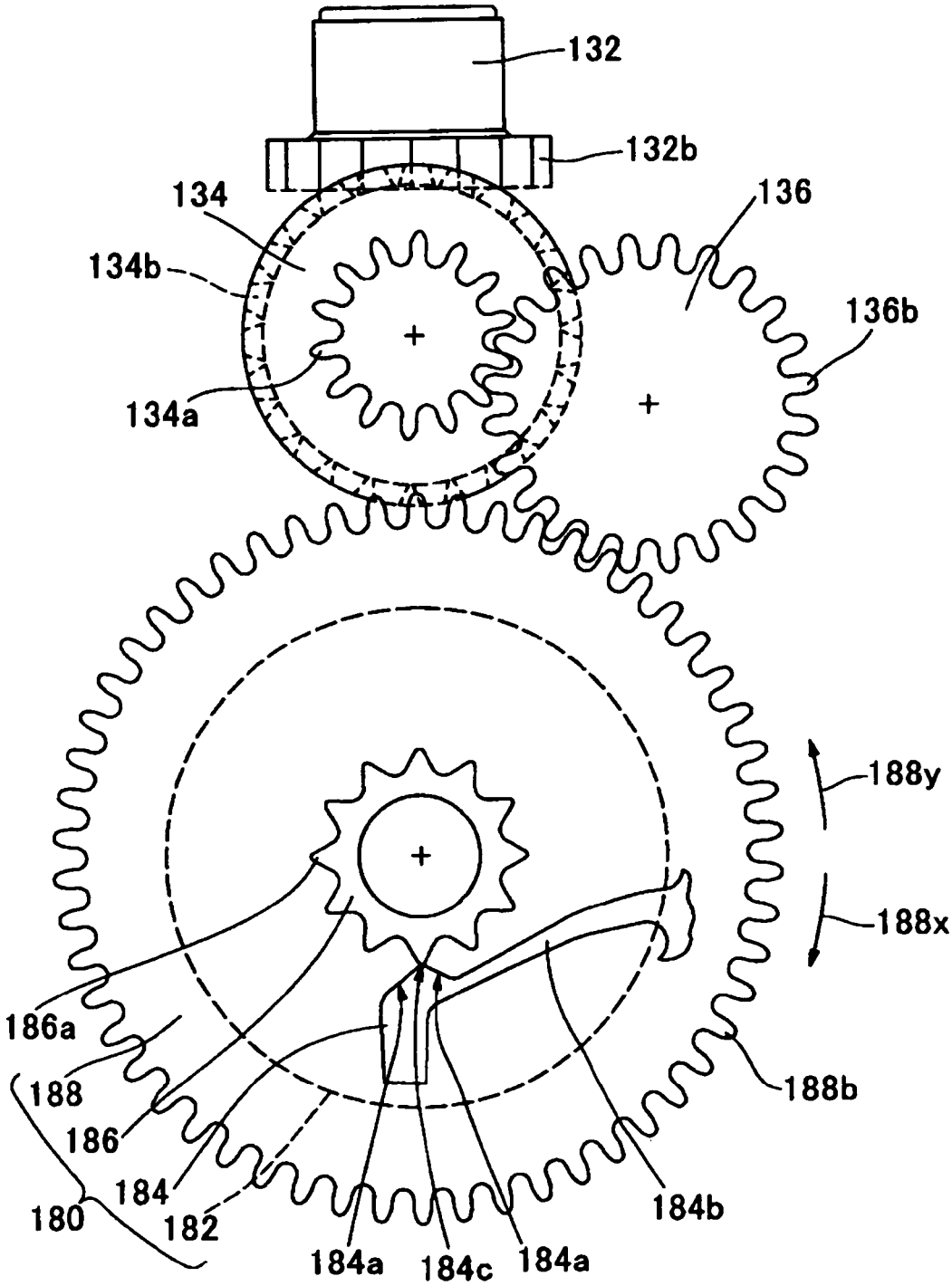
FIG. 31 is a plan view showing an operation when setting parts of the hour jumper constituting the hour difference corrector mechanism butt against an apex of a tooth of an hour jumper pinion in the 1st embodiment of the timepiece with the calendar mechanism of the present invention.

Referring to FIG. 28 and FIG. 29, the 1st hour difference corrector wheel 132 possesses a 1st hour difference corrector pinion 132*a* meshing with the B tooth 114*b* of the clutch wheel 114 under a state that the hour difference correction is possible, and a 1st hour difference corrector gear wheel 132*b* for rotating the 2nd hour difference corrector wheel 134. A teeth number of the 1st hour difference corrector pinion 132*a* of the 1st hour difference corrector wheel 132 is 2. That is, the teeth number of the 1st hour difference corrector pinion 132*a* is equal to a teeth number of the B tooth 114*b* of the clutch wheel 114. Referring to FIG. 31, the 2nd hour difference corrector wheel 134 possesses a 2nd hour difference corrector gear wheel 134*b* meshing with the 1st hour difference corrector gear wheel 132*b*, and a 2nd hour difference corrector pinion 134*a* for rotating the 3rd hour difference corrector wheel 136. A 3rd hour difference collector gear wheel 136*b* of the 3rd hour difference collector wheel 136 meshes with the 2nd hour difference corrector pinion 134*a*, and meshes with an hour display gear wheel 188*b* of an hour wheel 188. As mentioned before, the hour wheel 180 contains the hour gear wheel 182, the hour jumper 184, the hour jumper pinion 186, the hour display wheel 188, and the contact operation wheel 189. A slip mechanism is constituted by the hour jumper pinion 186 and the hour jumper 184. The hour jumper pinion 186 is fixed to the hour display wheel 188. The hour jumper pinion 186 has an hour jumper pinion teeth parts 186*a*. The teeth number of the hour jumper pinion teeth parts 186*a* is 12. The teeth number of the hour jumper pinion teeth parts 18.6*a* corresponds to a display of "12-hour" by the hour hand 164 attached to the hour display wheel 188. Referring to FIG. 30, the hour jumper 184 is fixed to the hour gear wheel 182. The hour jumper 184 has 2 setting portions 184*a*. The setting portions 184*a* are monolithically formed in the hour jumper 184 through a setting spring portion 184*b*. An apex 184*c* is provided in an intersection point of the setting portions 184*a* of the hour jumper 184.

(1.11) Operation of Embodiment of Timepiece with Calendar Mechanism of the Present Invention (1.11.1) Operation of Normal Hand Motion Next, it is explained about an operation of a normal hand motion of the timepiece with the calendar mechanism of the present invention. Referring to FIG. 1-FIG. 4 and FIG. 25, the battery 140 constitutes the power source of the timepiece. The crystal oscillator accommodated in the crystal oscillator unit 750 oscillates at 32,768 Hertz for instance. On the basis of this oscillation of the crystal oscillator, the oscillation part 702 built in the integrated circuit 754 outputs a reference signal, and the frequency-dividing control part 704 frequency-divides the output signal of the oscillation part 702. The motor drive part 706 outputs the motor drive signal for driving the step motor to the coil block 730 on the basis of an output signal of the frequency-dividing control part 704. If the coil block 730 inputs the motor drive signal, the stator 732 is magnetized, thereby rotating the rotor 734. The rotor 734 rotates by, e.g., 180 degrees in every one second. On the basis of the rotation of the rotor 734, the second wheel & pinion 142 rotates through the rotation of the fifth wheel & pinion 141. The second wheel & pinion 142 performs one rotation in one minute. By the second hand 160 attached to the second wheel & pinion 142, "second" among the time information is displayed.

The third wheel & pinion 144 rotates on the basis of the rotation of the second wheel & pinion 142. The center wheel & pinion 146 rotates on the basis of the rotation of the third wheel & pinion 144. The minute wheel may be used instead of the center wheel & pinion 146. The center wheel & pinion 146 performs one rotation in one hour. By the minute hand 162 attached to the center wheel & pinion 146, "minute" among the time information is displayed. The slip mechanism is provided in the center wheel & pinion 146 or the minute wheel. By the slip mechanism, when performing the hand correction, it is possible to rotate the minute hand 162 and the hour hand 164 by rotating the winding stem 110 under the state that the second hand 160 has been stopped. The minute wheel 148 rotates on the basis of the rotation of the center wheel & pinion 146. The hour wheel 180 rotates on the basis of the rotation of the minute wheel 148. The hour wheel 180 performs one rotation in 12 hours. By the hour hand 164 attached to the hour display wheel 188 of the hour wheel 180, "hour" among the time information is displayed. The 24-hour contact wheel 210 rotates by the rotation of the contact operation wheel 189. The 24-hour contact spring 212 of the 24-hour contact wheel 210 is disposed so as to be capable of contacting with the 24-hour contact pattern 712*c* of the circuit block 712. The 24-hour intermediate wheel 220 rotates by the rotation of the hour wheel 180. The 24-hour wheel 222 rotates by the rotation of the 24-hour intermediate wheel 220. The 24-hour hour wheel 222 performs one rotation in one day (24 hours). By the 24-hour hand 224 attached to the 24-hour hour wheel 222, "hour" among the time information is displayed by the "24-hour system" in which one revolution becomes 24 hours.

(1.11.2) Operation of Calendar Unlocking

Next, it is explained about an action of a calendar unlocking of the timepiece with the calendar mechanism of the present invention. Referring to FIG. 1-FIG. 5, FIG. 22 and FIG. 25, the ultrasonic motor drive part 738 outputs the ultrasonic motor drive signal for driving the ultrasonic motor 240 to the ultrasonic motor 240 on the basis of the output signal of the frequency-dividing control part 704. The ultrasonic motor drive part 738 is built in the integrated circuit 754. The date indicator driving intermediate wheel 308 rotates on the basis of an operation of the ultrasonic rotor 242 of the ultrasonic motor 240. The date indicator driving wheel 310 rotates on the basis of the rotation of the date indicator driving intermediate wheel 308. By the fact that the date indicator driving wheel 310 rotates, the date indicator driving tooth 310*a* of the date indicator driving wheel 310 rotates the 1st date indicator 312. A signal that the ultrasonic motor drive part 738 outputs is outputted so as to rotate the 1st date indicator 312 by for one tooth (one pitch) per one day. By the fact that the date indicator driving wheel 310 rotates, the date indicator driving wheel contact spring 320 rotates. By the fact that the date indicator driving wheel contact spring 320 rotates, it becomes a state that a 1st contact portion (not shown in the drawing) contacts with a reference electric potential pattern (not shown in the drawing), and a 2nd contact portion (not shown in the drawing) contacts with a contact switch pattern (not shown in the drawing). Under this state, a rotation signal of the date indicator driving wheel is outputted to the date indicator driving wheel rotation signal detection part 742. The date indicator driving wheel rotation signal detection part 742 is built in the integrated circuit 754.

If the date indicator driving wheel rotation signal detection part 742 inputs the rotation signal of the date indicator driving wheel, the date indicator driving wheel rotation signal detection part 742 outputs the ultrasonic motor control signal to the ultrasonic motor drive part 738 in order to control an operation of the ultrasonic motor 240. If the ultrasonic motor drive part 738 inputs the ultrasonic motor control signal, it stops an output of the ultrasonic motor drive signal. By constituting like this, it is possible to control the rotation of the 1st date indicator 312. Additionally, by the fact that the date indicator driving wheel 310 rotates, the date indicator driving wheel contact spring 320 additionally rotates. By the fact that the date indicator driving wheel contact spring 320 rotates; it becomes a state that the 1st contact portion separates from the reference electric potential pattern to thereby contact with the contact switch pattern, and the 2nd contact portion separates from the contact switch pattern to thereby contact with the reference electric potential pattern. Even under this state, the rotation signal of the date indicator driving wheel is outputted to the date indicator driving wheel rotation signal detection part 742. If the date indicator driving wheel rotation signal detection part 742 inputs the rotation signal of the date indicator driving wheel, the date indicator driving wheel rotation signal detection part 742 outputs the ultrasonic motor control signal to the ultrasonic motor drive part 738 in order to control the operation of the ultrasonic motor 240. If the ultrasonic motor drive part 738 inputs the ultrasonic motor control signal, it stops the output of the ultrasonic motor drive signal. By constituting like this, it is possible to rotate the 1st date indicator 312 by for one tooth (one pitch) once in every day.

Referring to FIG. 15 and FIG. 16, by the fact that the date indicator driving wheel 310 rotates in the direction (clockwise direction) shown by the arrow, the date indicator driving tooth 310*a* unlocks the 1st date indicator tooth part 316, thereby rotating the 1st date indicator 312 by (360/31) degrees in the clockwise direction once in one day. When the date letter displayed from the date window by the 1st date indicator 312 changes from "9" to "0" (or, state of "white paper"), by the fact that the 1st date indicator 312 rotates by (360/31) degrees in the clockwise direction, the positive rotation unlocking parts of the 2nd calendar shift tooth 318*b*, the 3rd calendar shift tooth 318*c* and the 4th calendar shift tooth 318*d* rotate the date intermediate tooth 330*a*, and the date intermediate tooth 330*a* rotates the unlocking teeth 328, thereby rotating the 2nd date indicator 322 by 30 degrees in the counterclockwise direction once in every 10 days. When the date letter displayed from the date window by the 2nd date indicator 322 changes from "3" to "0" (or, state of "white paper") and the date letter displayed from the date window by the 1st date indicator 312 changes from "1" to adjoining next "1", by the fact that the 1st date indicator 312 rotates by (360/31) degrees in the clockwise direction, the positive rotation unlocking part 318*af* of the 1st calendar shift tooth 318*a* rotates the date intermediate tooth 330*a*, and the date intermediate tooth 330*a* rotates the unlocking teeth 328, thereby rotating the 2nd date indicator 322 by 30 degrees in the counterclockwise direction once in every 31 days.

Referring to FIG. 17, if the date indicator driving wheel 310 additionally rotates in the direction shown by the arrow from the state shown in FIG. 16 and the date indicator driving tooth 310*a* rotates the 1st date indicator 312 in the direction shown by the arrow, by the elastic force of the 1st date jumper 314, the 1st date indicator 312 is positioned in a position where it has rotated by (360/31) degrees in the clockwise direction from the state shown in FIG. 15. Further, by the elastic force of the 2nd date jumper 324, the 2nd date indicator 322 is positioned in a position where it has rotated by 30 degrees in the counterclockwise direction from the state shown in FIG. 15. As a result, the display of the 2nd date indicator 322 changes from "3" to "0" (or, state of "white paper"), and the display of the 1st date indicator 312 changes from "1" to adjoining next "1". That is, under a state shown in FIG. 17, in the date window of the dial of the timepiece with the calendar mechanism, there is displayed "1st day" in which the display of the 2nd date indicator 322 is "0" (or, state of "white paper") and the display of the 1st date indicator 312 is "1".

(1.12) Operation of Hour Difference Correction

Figure 32:
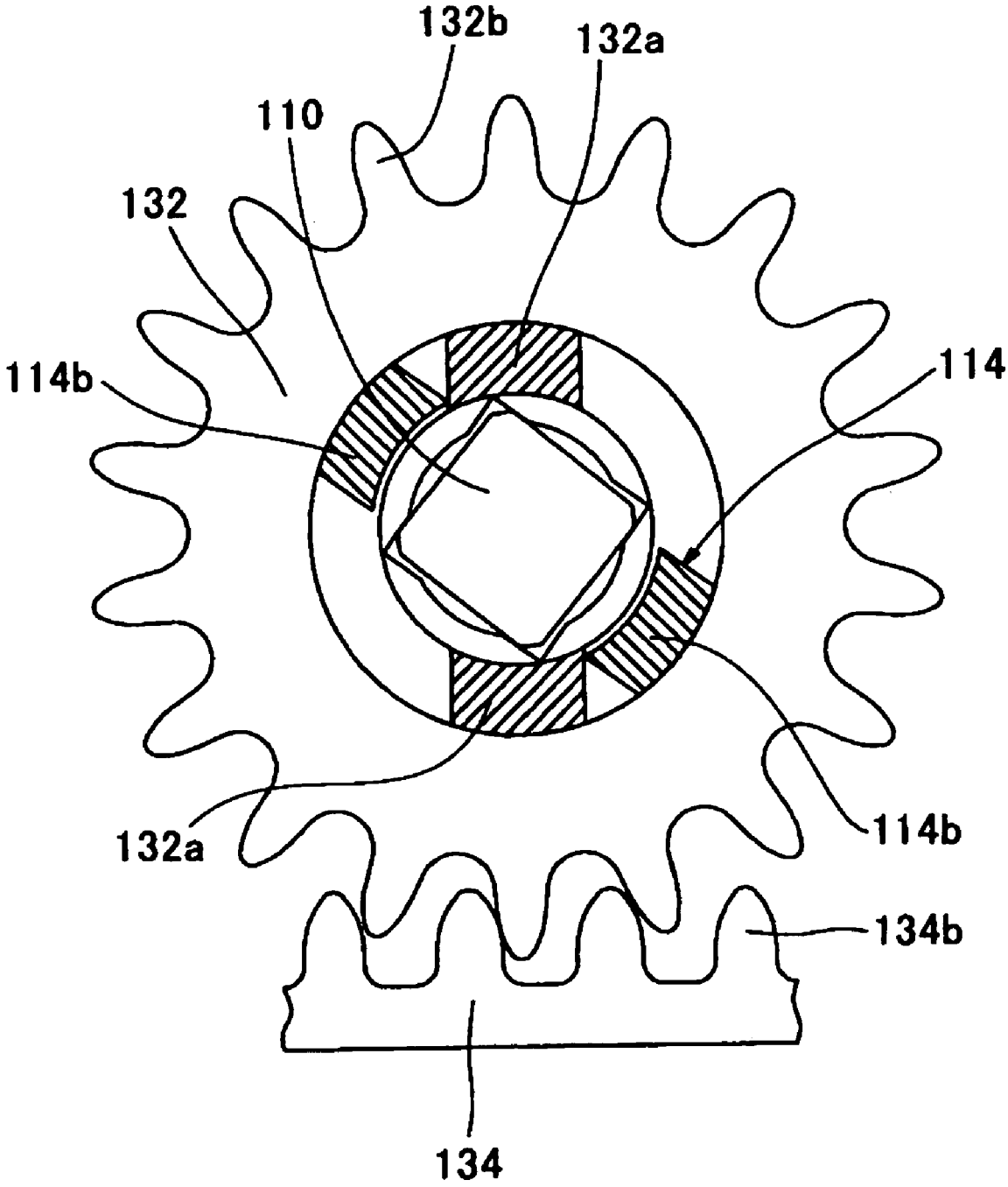
FIG. 32 is a side view corresponding to FIG. 31 when seen from an axial direction in the 1st embodiment of the timepiece with the calendar mechanism of the present invention.
Figure 33:
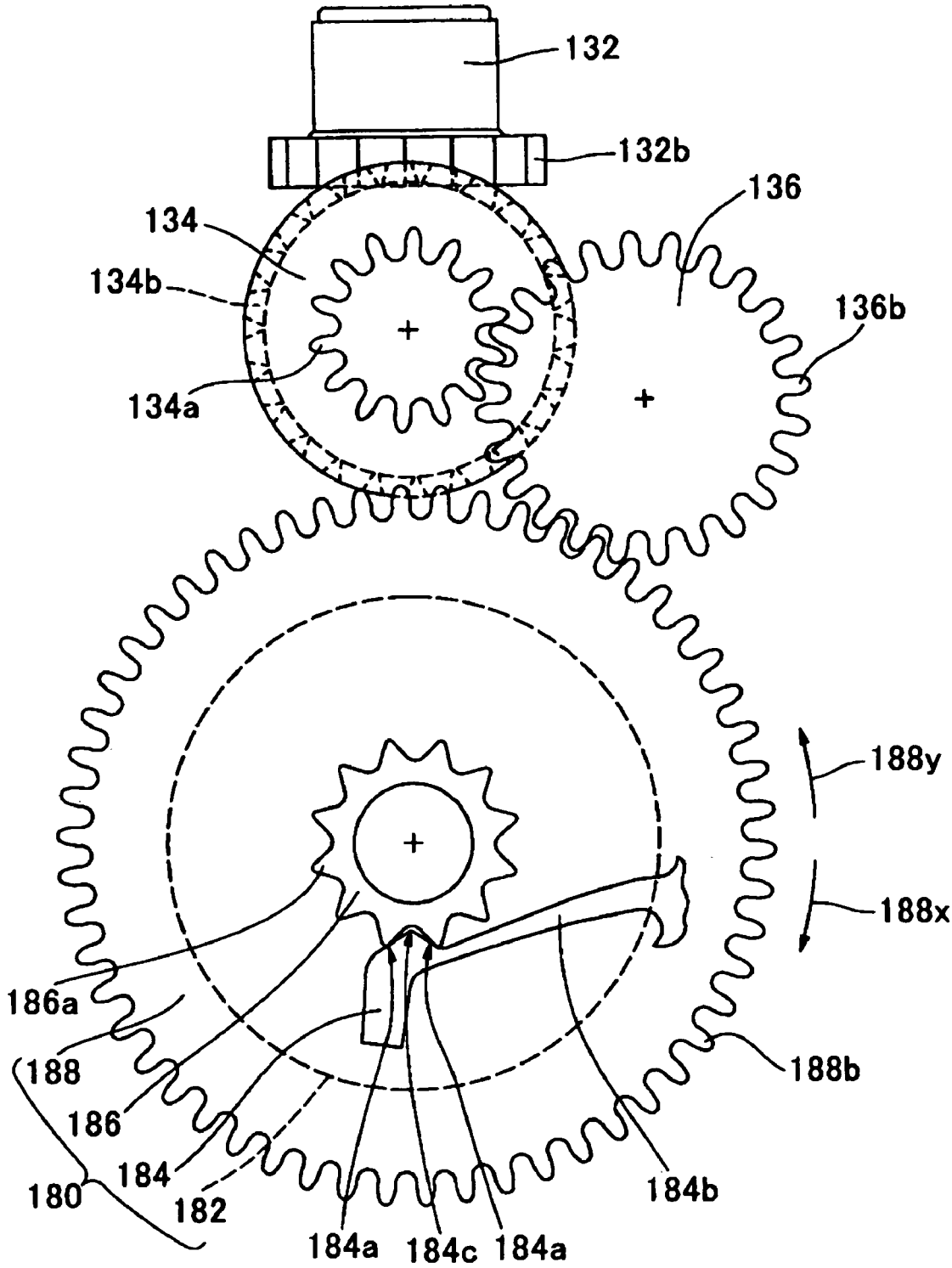
FIG. 33 is a plan view showing an operation when the setting parts of the hour jumper constituting the hour difference corrector mechanism have went over the apex of the tooth of the hour jumper pinion and thereby have set the hour jumper pinion in the 1st embodiment of the timepiece with the calendar mechanism of the present invention.
Figure 34:
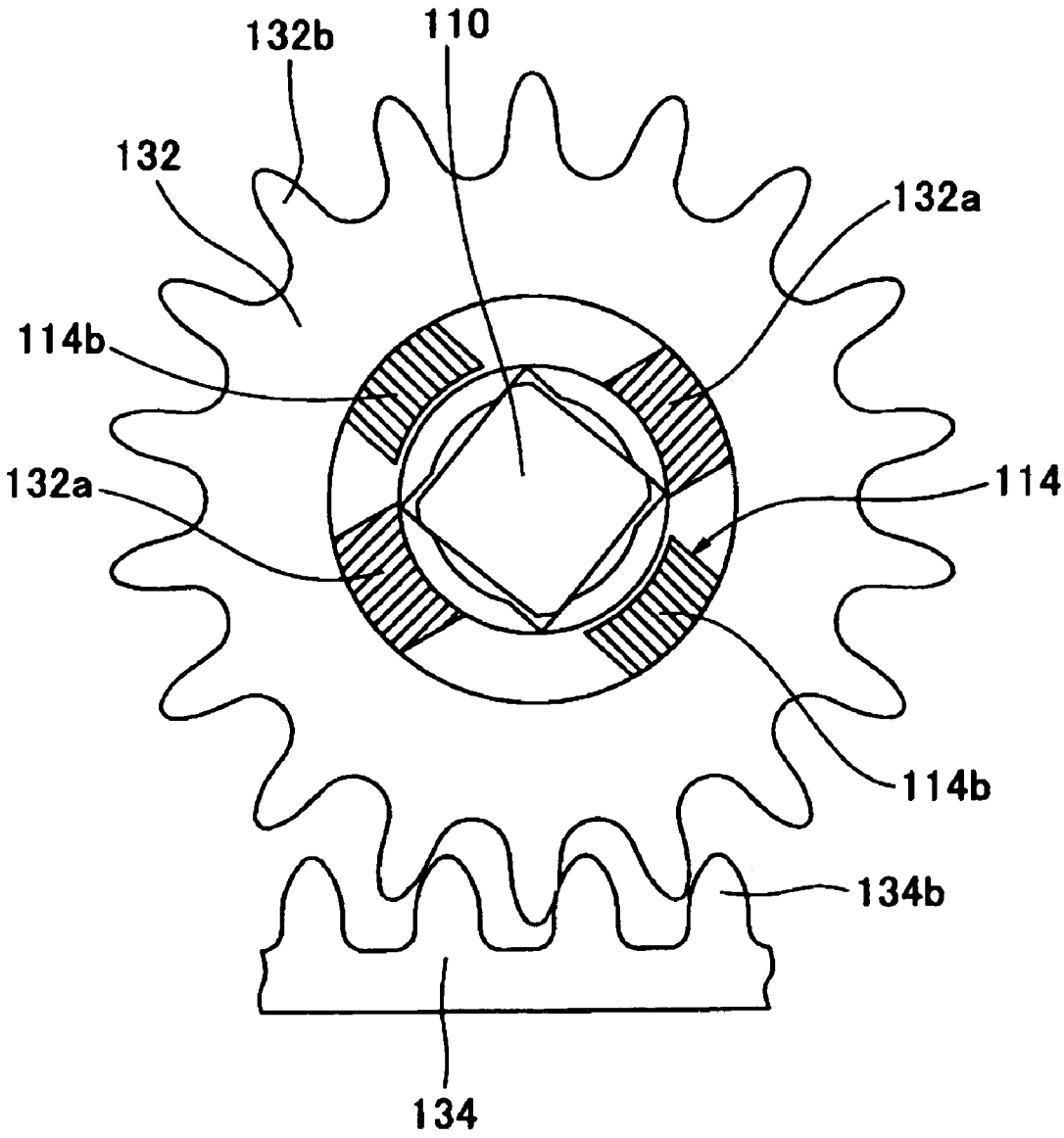
FIG. 34 is a side view corresponding to FIG. 33 when seen from the axial direction in the 1st embodiment of the timepiece with the calendar mechanism of the present invention.

Next, it is explained about an operation in a case of performing an hour difference correction in the timepiece with the calendar mechanism of the present invention. Referring to FIG. 3 and FIG. 33, under a state that the winding stem 110 is pulled out to its 1st stage and the hour difference correction of the timepiece with the calendar mechanism is possible, if the winding stem 110 is rotated, the clutch wheel 114 rotates and, by the rotation of the clutch wheel 114, the hour display wheel 188 rotates through rotations of the 1st hour difference corrector wheel 132, the 2nd hour difference corrector wheel 134, and the 3rd hour difference corrector wheel 136. Referring to FIG. 31 and FIG. 32, by the fact that the hour display wheel 188 rotates, the hour jumper pinion 186 rotate in a direction shown by an arrow 188*x* in FIG. 31, an apex of one tooth of an hour jumper pinion tooth portion 186*a* contacts with the apex 184*c* of the setting portion 184*a* of the hour jumper 184. If the hour jumper pinion 186 is rotated in the direction shown by the arrow 188*x* by additionally rotating the winding stem 110, the apex of one tooth of the hour jumper pinion tooth portion 186*a* goes over the apex 184*c* of the setting portion 184.*a* of the hour jumper 184. Thereupon, as shown in FIG. 33 and FIG. 34, by the spring force of the setting spring portion 184*b* of the hour jumper 184, the hour jumper 184 rotates in the direction shown by the arrow 188*x* in FIG. 33, thereby finishing the unlocking for one pitch of the hour jumper pinion 186. Under a state shown in FIG. 33 and FIG. 34, the hour jumper 184 is positioned so as not to be rotated by the driving force of the step motor for driving the timepiece.

Referring to FIG. 8, in the complete 300 of the timepiece with the calendar mechanism of the present invention, by rotating a crown 300*c* attached to the winding stem 110, the hour hand 164 rotates from a position (position shown by a reference numeral 164) before the hour correction shown by a solid line in FIG. 8, and moves to a position having proceeded by "one hour" shown by an imaginary line in FIG. 8, i.e., position having proceeded by one pitch (position shown by a reference numeral 164*c*). Since, even if the hour display wheel 188 is rotated by the rotations of the crown 300*c* and the winding stem 110, the hour jumper 184 does not rotate and, even if the hour display wheel 188 is rotated, the hour jumper 184 does not rotate, it is possible that the second hand 160 accurately displays the second and the minute hand 162 accurately displays the minute under a state that the hour difference correction is being performed in the timepiece with the calendar mechanism. By rotating the crown 300*c* and the winding stem 110 in a direction opposite to the above-mentioned operation, it is possible to rotate the hour jumper pinion 186 in a direction shown by an arrow 188*y* in FIG. 31. Accordingly, in the timepiece with the calendar mechanism of the present invention, by rotating the crown 300*c* and the winding stem 110 in a 1st direction, it is possible to put forward the hour hand 164 by "one hour" at a time, i.e., by one pitch at a time. Additionally, in the timepiece with the calendar mechanism of the present invention, by rotating the crown 300*c* and the winding stem 110 in a 2nd direction opposite to the 1st direction, it is possible to move the hour hand 164 to a position (position shown by a reference numeral 164*d*) shown by a dotted line in FIG. 8 by reversely rotating the it by "one hour" at a time, i.e., by one pitch at a time.

If the winding stem 110 is rotated under the state the hour difference correction of the timepiece with the calendar mechanism is possible by pulling out the winding stem 110 to its 1st stage, the hour wheel 180 rotates through the rotations of the clutch wheel 114, the setting wheel 155, and the minute wheel 148. If the hour wheel 180 rotates, the hour display wheel 188 simultaneously rotates, and the contact operation wheel 189 rotates. If the contact operation wheel 189 rotates, the 24-hour contact wheel 210 rotates. When the 24-hour contact wheel 210 has rotated and has become 24 o'clock, the 24-hour contact spring 212 of the 24-hour contact wheel 210 contacts with the 24-hour contact pattern 712*c* of the circuit block 712. That is, if the 24-hour contact spring 212 contacts with the 24-hour contact pattern 712*c* by the rotation of the 24-hour contact wheel 210, a 24-hour detection signal is outputted to the 24-hour signal detection part 740. The 24-hour signal detection part 740 outputs a result that has detected the rotation of the 24-hour contact wheel 210 to the ultrasonic motor drive part 738. The ultrasonic motor drive part 738 outputs the ultrasonic motor drive signal for driving the ultrasonic motor 240 to the ultrasonic motor 240. The date indicator driving intermediate wheel 308 rotates on the basis of the operation of the ultrasonic rotor 242 of the ultrasonic motor 240. The date indicator driving wheel 310 rotates on the basis of the rotation of the date indicator driving intermediate wheel 308. By the fact that the date indicator driving wheel 310 rotates, the date indicator driving tooth 310*a* of the date indicator driving wheel 310 rotates the 1st date indicator 312. In the timepiece with the calendar mechanism of the present invention, when the hour difference correction has been performed in the positive rotation direction, it is possible to rotate the 1st date indicator 312 in the positive rotation direction and, when the hour difference correction has been performed in the reverse rotation direction, it is possible to rotate the 1st date indicator 312 in the reverse rotation direction.

(1-13) Operation of Hand Correction

Next, it is explained about an operation in a case of performing a hand correction in the timepiece with the calendar mechanism of the present invention. Referring to FIG. 1-FIG. 4 and FIG. 25, in the movement 100, if the winding stem 110 is pulled out to its 2nd stage, the A tooth 114*a* of the clutch wheel 114 meshes with the setting wheel 155. Under this state, if the winding stem 110 is rotated, the setting wheel 155 rotates on the basis of the rotation of the clutch wheel 114. On the basis of the setting wheel 155, the minute wheel 148 rotates. Accordingly, when the winding stem 110 exists in its 2nd stage, by rotating the winding stem 110, it is possible to perform "hand correction". That is, when the winding stem 110 exists in its 2nd stage, by rotating the winding stem 110, it is possible, by rotating the hour wheel 180, to correct a display content of "hour" that the hour hand 164 attached to the hour wheel 180 displays and, at the same time by rotating the center wheel & pinion 146, to correct a display content of "minute" that the minute hand 162 attached to the center wheel & pinion 146 displays. And, by an action of the train wheel setting lever, the 2nd wheel & pinion 142 does not rotate during the display contents of "hour" and "minute" are being corrected, and a display content of "second" does not change.

If the winding stem 110 is rotated under the state the hand correction of the timepiece with the calendar mechanism is possible by pulling out the winding stem 110 to its 2nd stage, the hour wheel 180 rotates through the rotations of the clutch wheel 114, the setting wheel 155, and the minute wheel 148. If the hour wheel 180 rotates, the hour display wheel 188 simultaneously rotates, and the contact operation wheel 189 rotates. If the contact operation wheel 189 rotates, the 24-hour contact wheel 210 rotates. When the 24-hour contact wheel 210 has rotated and has become 24 o'clock, the 24-hour contact spring 212 of the 24-hour contact wheel 210 contacts with the 24-hour contact pattern 712*c* of the circuit block 712. That is, if the 24-hour contact spring 212 contacts with the 24-hour contact pattern 712*c* by the rotation of the 24-hour contact wheel 210, the 24-hour detection signal is outputted to the 24-hour signal detection part 740. The 24-hour signal detection part 740 outputs the result that has detected the rotation of the 24-hour contact wheel 210 to the ultrasonic motor drive part 738. The ultrasonic motor drive part 738 outputs the ultrasonic motor drive signal for driving the ultrasonic motor 240 to the ultrasonic motor 240. The date indicator driving intermediate wheel 308 rotates on the basis of the operation of the ultrasonic rotor 242 of the ultrasonic motor 240. The date indicator driving wheel 310 rotates on the basis of the rotation of the date indicator intermediate wheel 308. By the fact that the date indicator driving wheel 310 rotates, the date indicator driving tooth 310*a* of the date indicator driving wheel 310 rotates the 1st date indicator 312. In the timepiece with the calendar mechanism of the present invention, when the hand correction has been performed in the positive rotation direction, it is possible to rotate the 1st date indicator 312 in the positive rotation direction and, when the hand correction has been performed in the reverse rotation direction, it is possible to rotate the 1st date indicator 312 in the reverse rotation direction.

(2) 2nd Embodiment

Next, a 2nd embodiment of the timepiece with the calendar mechanism of the present invention is explained. The following explanations mainly mention points that the 2nd embodiment of the timepiece with the calendar mechanism of the present invention differs from the 1st embodiment of the timepiece with the calendar mechanism of the present invention. Accordingly, as to portions about which there are no descriptions in the following, here there are applied the above mentioned explanations about the 1st embodiment of the timepiece with the calendar mechanism of the present invention.

Figure 21:
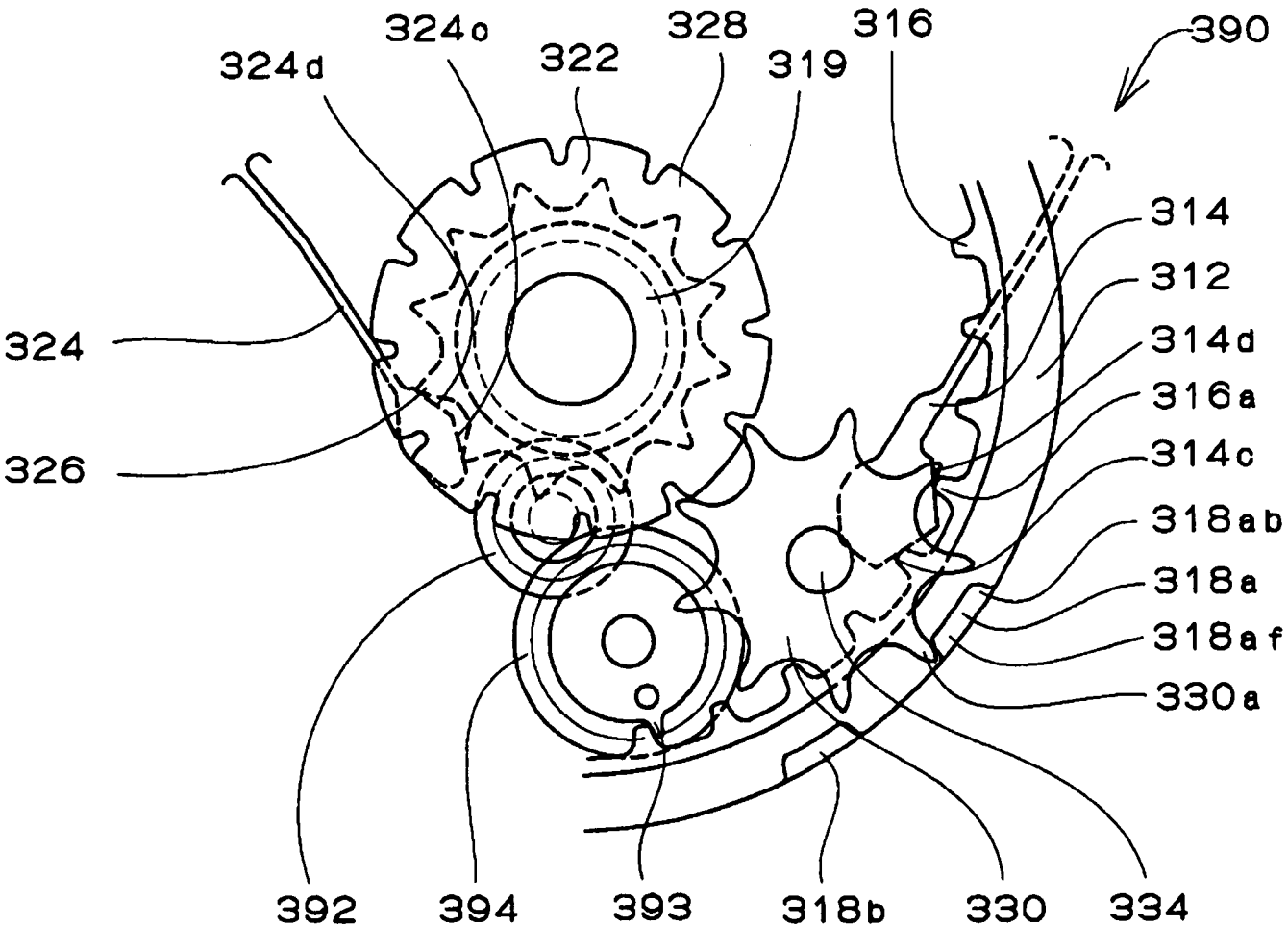
FIG. 21 is a partial plan view showing the structure of the back side of the movement seen from the dial side under the state that the 1st date indicator is attempted to be rotated in the positive direction in a 2nd embodiment of the timepiece with the calendar mechanism of the present invention.

Referring to FIG. 21, in a movement 390, a date unlocking mechanism contains a date indicator driving intermediate wheel 392, a date indicator driving wheel 393, and a date indicator driving pawl 394. The date indicator driving intermediate wheel 392 is constituted so as to rotate by a rotation of an hour wheel 391. That is, the date unlocking mechanism is constituted so as to rotate by the rotation of the step motor (not shown in the drawing) which rotate the front train wheel. The date indicator driving pawl 394 is constituted so as to rotate monolithically with the date indicator driving wheel 393. The date indicator driving wheel 393 is constituted so as to perform one rotation in one day. It is constituted such that, by the fact that the date indicator driving intermediate wheel 392 rotates, the date indicator driving wheel 393 rotates and, by the date indicator driving pawl 394, the 1st date indicator 312 rotates by for one pitch (one tooth) once in one day.

If the winding stem 110 is pulled out to its 2nd stage, the A tooth 114*a* of the clutch wheel 114 meshes with the setting wheel 155. Under this state, if the winding stem 110 is rotated, the setting wheel 155 rotates on the basis of the rotation of the clutch wheel 114, and the minute wheel 126 rotates on the basis of the rotation of the setting wheel 155. Accordingly, when the winding stem 110 exists in its 2nd stage, by rotating the winding stem 110, it is possible to perform "hand correction". That is, when the winding stem 110 exists in its 2nd stage, by rotating the winding stem 110, it is possible, by rotating the hour wheel 391, to correct the display content of "hour" that the hour hand 164 attached to the hour wheel 391 displays and, at the same time by rotating the center wheel & pinion 146, to correct the display content of "minute" that the minute hand 162 attached to the center wheel & pinion 146 displays. Further, by the rotation of the hour wheel 391, the date indicator driving wheel 393 rotates through the rotation of the date indicator driving intermediate wheel 392. By the fact that the date indicator driving wheel 393 rotates, the date indicator driving pawl 394 rotates, and it is possible to rotate the 1st date indicator 312 by the date indicator driving pawl 394. When the winding stem 110 exists in its 2nd stage, by rotating the winding stem 110 in the 1st direction, it is possible to perform a positive rotation correction of the date by rotating the 1st date indicator 312 and the 2nd date indicator 322 in the positive direction. Further, when the winding stem 110 exists in its 2nd stage, by rotating the winding stem 110 in the 2nd direction opposite to the 1st direction, it is possible to perform a reverse rotation correction of the date by rotating the 1st date indicator 312 and the 2nd date indicator 322 in the reverse direction.

A timepiece with a calendar mechanism of the present invention contains the 1st date indicator displaying the place of units among dates and the 2nd date indicator displaying the place of tens among dates, and its operation property is good without increasing the number of times at which the calendar mechanism must be corrected at the end of the month. Further, in a timepiece with a calendar mechanism of the present invention, since the rotation center of the 1st date indicator and the rotation center of the 2nd date indicator can be disposed in the same position, a restriction in design relating to a position where the date indicators are disposed is very small. That is, by the present invention, it is possible to realize a timepiece with a calendar mechanism, which has a degree of freedom in the position of the date display.

The timepiece with the calendar mechanism of the present invention contains the 1st date indicator displaying the place of units among dates and the 2nd date indicator displaying the place of tens among dates, can correct the date display by rotating the 1st date indicator and the 2nd date indicator in the positive direction and, additionally, also can perform the correction which surely and easily turns the date display back by rotating the 1st date indicator and the 2nd date indicator in the reverse direction.

Further, the timepiece with the calendar mechanism contains the 1st date indicator displaying the place of units among dates and the 2nd date indicator displaying the place of tens among dates, can correct the date display in both the positive and reverse directions, and can perform the hour difference correction of the display by the hour hand.

Additionally, in a timepiece with a calendar mechanism of the present invention, it is possible to surely correct the date display by rotating the 1st date indicator and the 2nd date indicator in the positive direction and, further, it is also possible to surely correct the date display by rotating the 1st date indicator and the 2nd date indicator in the reverse direction. Further, a timepiece with a calendar mechanism of the present invention can perform an accurate time display and an accurate date display, and also can easily correct the date display.

What is claimed is:

1. A timepiece with a calendar mechanism containing 2 date indicators, possessing:

a 1st date indicator displaying a place of units among dates, a 1st date jumper for setting a position of the 1st date indicator in a rotation direction, a 2nd date indicator displaying a place of tens among dates, a 2nd date jumper for setting a position of the 2nd date indicator in a rotation direction, and a date intermediate wheel which rotates on the basis of a rotation of the 1st date indicator, thereby being capable of rotating the 2nd date indicator, characterized in that a rotation center of the 1st date indicator and a rotation center of the 2nd date indicator are disposed so as to exist in the same position, the 1st date indicator contains 31 1st date indicator teeth parts formed as internal teeth and 4 calendar shift teeth formed as internal teeth, the 1st date indicator teeth parts are formed with a spacing of equal angle, and the calendar shift teeth comprise a 1st calendar shift tooth becoming a reference, a 2nd calendar shift tooth formed with a spacing of (360×2/31) degrees in a 1st direction with the 1st calendar shift tooth being made the reference, a third calendar shift tooth formed with a spacing of (360×10/31) degrees in the 1st direction with the 2nd calendar shift tooth being made a reference, and a 4th calendar shift tooth formed with a spacing of (360×9/31) degrees in a direction opposite to the 1st direction with the 1st calendar shift tooth being made the reference, each of the calendar shift teeth possesses a positive rotation unlocking part for unlocking the 1st date indicator in the 1st direction and a reverse rotation unlocking part for unlocking it in a 2nd direction opposite to the 1st direction, and when the rotation center of the 2nd date indicator is defined as "CDA", a rotation center of the date intermediate wheel is defined as "CMD" and a straight line passing through the "CDA" and the "CMD" is defined as "LDM", as to each of the calendar shift teeth, a disposition of the calendar shift tooth under a state before the 1st date indicator is unlocked in the 1st direction and a disposition of the calendar shift tooth under a state that the 1st date indicator has been finished to be rotated in the 1st direction are constituted in an axisymmetric relation whose reference line is made the "LDM".

2. A timepiece with a calendar mechanism set forth in claim 1, characterized in that, when a straight line passing through the straight line "CDA" and a center part of each of the calendar shift teeth in a rotation direction is defined as "LDH", as to each of the calendar shift teeth, a positive rotation unlocking part and a reverse rotation unlocking part are formed in an axisymmetric shape whose reference is made the "LDH".

3. A timepiece with a calendar mechanism set forth in claim 1, characterized in that a hand for displaying a time information is operated by a step motor, and the 1st date indicator is operated by an ultrasonic motor.

4. A timepiece with a calendar mechanism set forth in claim 3, characterized by being constituted such that it possesses a 24-hour signal detection part for detecting a rotation of the hand for displaying the time information and a rotation signal detection part for detecting a rotation of a train wheel for rotating the 1st date indicator, and an operation of the ultrasonic motor is controlled on the basis of an output signal that the 24-hour signal detection part outputs and the operation of the ultrasonic motor is controlled on the basis of an output signal that the rotation signal detection part outputs.

5. A timepiece with a calendar mechanism set forth in claim 1, characterized by being constituted such that it possesses a hand corrector mechanism for performing a correction of a hand for displaying a time information, and an operation of an ultrasonic motor is controlled on the basis of an operation of the hand corrector mechanism.

6. A timepiece with a calendar mechanism set forth in claim 1, characterized by being constituted such that it possesses an hour difference corrector mechanism for performing an hour difference correction of an hour hand for displaying a time information, and an operation of an ultrasonic motor is controlled on the basis of an operation of the hour difference corrector mechanism.

7. A timepiece with a calendar mechanism set forth in claim 6, characterized by being constituted such that it possesses an hour wheel for driving the hour hand for displaying the time information, the hour wheel contains an hour gear wheel, an hour jumper, an hour jumper pinion, an hour display wheel and a contact operation wheel, the hour gear wheel, the hour jumper, the hour jumper pinion, the hour display wheel and the contact operation wheel are constituted so as to monolithically rotate, and the operation of the ultrasonic motor is controlled on the basis of a rotation of the contact operation wheel.

8. A timepiece with a calendar mechanism set forth in claim 6, characterized by being constituted such that it possesses an hour wheel for driving the hour hand for displaying the time information, the hour wheel contains an hour gear wheel, an hour jumper, an hour jumper pinion, an hour display wheel and a contact operation wheel, the hour gear wheel, the hour jumper, the hour jumper pinion, the hour display wheel and the contact operation wheel are constituted so as to monolithically rotate, the hour hand is attached to the hour display wheel, additionally it possesses a 24-hour hour wheel which rotates on the basis of a rotation of the date jumper, and the 24-hour hour wheel performs one rotation in 24 hours.

* * * * *